US007201232B2

(12) United States Patent
Turner et al.

(10) Patent No.: US 7,201,232 B2
(45) Date of Patent: Apr. 10, 2007

(54) WASHPIPELESS ISOLATION STRINGS AND METHODS FOR ISOLATION WITH OBJECT HOLDING SERVICE TOOL

(75) Inventors: Dewayne M. Turner, Tomball, TX (US); Donald H. Michel, Broussard, LA (US); Marvin Bryce Traweek, Houston, TX (US); Richard J. Ross, Houston, TX (US); Floyd Romaine Bishop, Humble, TX (US); Gregg W. Stout, Mongtomery, TX (US)

(73) Assignee: BJ Services Company, Houston, TX (US)

( * ) Notice: Subject to any disclaimer, the term of this patent is extended or adjusted under 35 U.S.C. 154(b) by 166 days.

(21) Appl. No.: 10/712,153

(22) Filed: Nov. 13, 2003

(65) Prior Publication Data

US 2004/0094304 A1 May 20, 2004

Related U.S. Application Data

(63) Continuation-in-part of application No. 10/364,945, filed on Feb. 12, 2003, now Pat. No. 7,124,824, which is a continuation-in-part of application No. 10/004,956, filed on Dec. 5, 2001, now Pat. No. 6,722,440, which is a continuation-in-part of application No. 09/378,384, filed on Aug. 20, 1999, now Pat. No. 6,397,949.

(60) Provisional application No. 60/251,293, filed on Dec. 5, 2000, provisional application No. 60/097,449, filed on Aug. 21, 1998.

(51) Int. Cl.
*E21B 34/06* (2006.01)
*E21B 34/10* (2006.01)

(52) U.S. Cl. ..... 166/374; 166/386; 166/329; 166/332.4

(58) Field of Classification Search ..... 166/373, 166/374, 381, 386, 316, 318, 319, 320, 321, 166/323, 325, 328, 329, 240, 332.4
See application file for complete search history.

(56) References Cited

U.S. PATENT DOCUMENTS 2,963,089 A * 12/1960 Sizer ..... 166/72

(Continued)

FOREIGN PATENT DOCUMENTS

WO WO 97/36089 10/1997

OTHER PUBLICATIONS

Baker Hughes, Models CD 6000 and CU 6000 Sliding Sleeves, Flow Control Systems, updated, pp. 52-55 (4 pgs.), Baker Hughes. Weatherford, Completion Isolation Valve, www.weatherford.com, printed Nov. 26, 2002, 3 pages, internet.

(Continued)

*Primary Examiner*—Jennifer H. Gay
(74) *Attorney, Agent, or Firm*—Locke Liddell & Sapp LLP

(57) ABSTRACT

An isolation string having an upper packer and an isolation pipe in mechanical communication with the upper packer, the isolation pipe comprises an operable valve and an object activated valve. An object holding service tool is adapted to release an object to activate the object activated valve. A method of running-in an isolation string, comprising an operable valve and an object activated valve, with an object holding service tool having an object held therewith; setting the isolation string in the casing adjacent perforations; pressurizing the object to cause a release from the object holding service tool, whereby the object travels to the object activated valve; closing the object activated valve with the released object; and withdrawing the object holding service tool from the well.

40 Claims, 46 Drawing Sheets

U.S. PATENT DOCUMENTS 3,051,243 A 8/1962 Grimmer et al.
3,627,049 A 12/1971 Young
3,741,249 A 6/1973 Leutwyler
3,741,300 A * 6/1973 Wolff et al. ..... 166/184
3,749,119 A * 7/1973 Tausch et al. ..... 137/461
3,763,933 A 10/1973 Mott
3,771,603 A 11/1973 Crowe
3,786,866 A 1/1974 Tausch et al.
3,814,181 A 6/1974 Young
3,814,183 A 6/1974 Kishel
3,823,773 A * 7/1974 Nutter ..... 166/336
3,845,815 A * 11/1974 Garwood ..... 166/154
3,856,085 A 12/1974 Holden et al.
3,882,935 A 5/1975 Calhoun
3,970,147 A * 7/1976 Jessup et al. ..... 166/374
3,993,130 A * 11/1976 Papp ..... 166/330
4,040,488 A 8/1977 Nelson
4,113,012 A 9/1978 Evans et al.
4,143,712 A 3/1979 James et al.
4,144,937 A 3/1979 Jackson et al.
4,189,003 A 2/1980 James et al.
4,280,561 A 7/1981 Fredd
4,319,634 A 3/1982 McMahan et al.
4,383,578 A * 5/1983 Baker ..... 166/373
4,388,968 A * 6/1983 Brandell ..... 166/236
4,399,870 A 8/1983 Baugh et al.
4,403,659 A 9/1983 Upchurch
4,415,038 A 11/1983 Schmuck
4,420,043 A * 12/1983 Brooks ..... 166/319
4,429,747 A 2/1984 Williamson, Jr.
4,452,313 A 6/1984 McMahan
4,498,536 A 2/1985 Ross et al.
4,560,005 A 12/1985 Helderle et al.
4,605,062 A 8/1986 Klumpyan et al.
4,627,492 A * 12/1986 MacLaughlin ..... 166/250.08
4,749,044 A * 6/1988 Skipper et al. ..... 166/323
4,903,775 A 2/1990 Manke
4,915,175 A 4/1990 Manshaw, Jr.
4,928,772 A 5/1990 Hopmann
4,940,093 A * 7/1990 Hilsman, III ..... 166/319
4,967,845 A * 11/1990 Shirk ..... 166/386
5,010,955 A 4/1991 Springer
5,090,481 A * 2/1992 Pleasants et al. ..... 166/373
5,137,088 A * 8/1992 Farley et al. ..... 166/319
5,180,007 A * 1/1993 Manke et al. ..... 166/321
5,180,016 A * 1/1993 Ross et al. ..... 166/387
5,183,115 A 2/1993 Gano
5,226,494 A * 7/1993 Rubbo et al. ..... 166/250.17
5,240,071 A 8/1993 Shaw, Jr. et al.
5,257,663 A * 11/1993 Pringle et al. ..... 166/66.4
5,263,683 A * 11/1993 Wong ..... 251/145
5,287,930 A 2/1994 McGill
5,295,538 A 3/1994 Restarick
5,373,899 A 12/1994 Dore et al.
5,377,750 A 1/1995 Arterbury et al.
5,413,180 A * 5/1995 Ross et al. ..... 166/387
5,456,322 A 10/1995 Tucker et al.
5,518,073 A * 5/1996 Manke et al. ..... 166/240
5,558,162 A * 9/1996 Manke et al. ..... 166/319
5,597,042 A 1/1997 Tubel et al.
5,609,178 A 3/1997 Hennig et al.
5,609,204 A * 3/1997 Rebardi et al. ..... 166/51
5,676,208 A * 10/1997 Finley ..... 166/278
5,730,223 A 3/1998 Restarick
5,775,421 A 7/1998 Duhon et al.
5,810,087 A 9/1998 Patel
5,826,662 A 10/1998 Beck et al.
5,865,251 A 2/1999 Rebardi et al.
5,890,540 A 4/1999 Pia et al.
5,901,796 A 5/1999 McDonald
5,909,769 A 6/1999 Duhon et al.
5,950,733 A 9/1999 Patel
6,125,930 A 10/2000 Moyes
6,148,915 A 11/2000 Mullen et al.
6,148,919 A 11/2000 Burris, II et al.
6,220,357 B1 4/2001 Carmichael et al.
6,220,360 B1 * 4/2001 Connell et al. ..... 166/373
6,227,298 B1 5/2001 Patel
6,230,808 B1 5/2001 French et al.
6,302,216 B1 * 10/2001 Patel ..... 166/375
6,349,772 B2 2/2002 Mullen et al.
6,352,119 B1 3/2002 Patel
6,386,289 B1 5/2002 Patel
6,397,949 B1 * 6/2002 Walker et al. ..... 166/374
6,446,729 B1 * 9/2002 Bixenman et al. ..... 166/386
6,515,886 B2 * 2/2003 Hasegawa ..... 365/63
6,516,886 B2 2/2003 Patel
6,520,257 B2 2/2003 Allamon et al.
6,575,246 B2 * 6/2003 Bixenman et al. ..... 166/278
6,634,429 B2 10/2003 Henderson et al.
6,659,186 B2 12/2003 Patel
6,662,877 B2 12/2003 Patel
6,684,950 B2 2/2004 Patel
6,722,440 B2 * 4/2004 Turner et al. ..... 166/374
6,763,892 B2 7/2004 Kaszuba
2001/0013415 A1 * 8/2001 Mullen et al. ..... 166/374
2001/0030049 A1 * 10/2001 Patel ..... 166/386
2002/0112862 A1 * 8/2002 Patel ..... 166/386
2002/0189814 A1 12/2002 Freiheit et al.
2004/0094303 A1 5/2004 Brockman et al.

OTHER PUBLICATIONS

Weatherford, Technical Data Manual, printed Oct. 20, 2001, 39 pages, internet.
Weatherford, CIV/RM, 2001, 2 pages.
Weatherford, CIV/RM, Jul. 3, 2000, 10 pages.
Schlumberger, FIV Technology, SMP5836, Feb. 2003, 8 pages.
Schlumberber, Downhole Valve reduces formation damage in sand-cnntrol completions, www.slb.com, Nov. 25, 2002, 2 pages.
Schlumberger, Oilfiled Bulletin: Focus on Completions, date unknown, 3 pages.
Baker Hughes, Model "B" Multi-Reverse Circulation Valve, Jun. 1997, 5 of 6 pages.
Osca, HPR-150 System, Technical Bulletin, 2000, 2 pages.
Baker Hughes, Model CMP Non-elastomeric Circulating Sliding Sleeve, Flow Control, Aug. 1997, 4 pages.

* cited by examiner

SECTION 'A-A'

WASHPIPELESS ISOLATION STRINGS AND METHODS FOR ISOLATION WITH OBJECT HOLDING SERVICE TOOL

This application is a continuation-in-part of U.S. application Ser. No. 10/364,945, filed Feb. 12, 2003 now U.S. Pat. No. 7,124,824; which is a continuation-in-part of application Ser No. 10/004,956, filed Dec. 5, 2001 and issued as U.S. Pat. No. 6,722,440; which claims the benefit of U.S. Provisional Application Ser. No. 60/251,293, filed Dec. 5, 2000. U.S. patent application Ser. No. 10/364,945 is also a continuation-in-part of U.S. patent application Ser. No. 09/378,384, filed Aug. 20, 1999 and issued as U.S Pat. No. 6,397,949, which claims the benefit of U.S. Provisional Application Ser. No. 60/097,449, filed Aug. 21, 1998.

FIELD OF THE INVENTION

The present invention relates to the field of well completion assemblies for use in a well. More particularly, the invention relates to valves used for production zone isolation.

BACKGROUND OF THE INVENTION

Early prior art isolation systems involved intricate positioning of tools which were installed down-hole after the gravel pack. These systems are exemplified by a commercial system which at one time was available from Baker. This system utilized an anchor assembly which was run into the wellbore after the gravel pack. The anchor assembly was released by a shearing action, and subsequently latched into position.

Certain disadvantages have been identified with the systems of the prior art. For example, prior conventional isolation systems have had to be installed after the gravel pack, thus requiring greater time and extra trips to install the isolation assemblies. Also, prior systems have involved the use of fluid loss control pills after gravel pack installation, and have required the use of thru-tubing perforation or mechanical opening of a wireline sliding sleeve to access alternate or primary producing zones. In addition, the installation of prior systems within the wellbore require more time consuming methods with less flexibility and reliability than a system which is installed at the surface.

Later prior art isolation systems provided an isolation sleeve which was installed inside the production screen at the surface and thereafter controlled in the wellbore by means of an inner service string. For example, as shown in U.S. Pat. No. 5,865,251, incorporated herein by reference, illustrates an isolation assembly which comprises a production screen, an isolation pipe mounted to the interior of the production screen, the isolation pipe being sealed with the production screen at proximal and distal ends, and a sleeve movably coupled with the isolation pipe. The isolation pipe defines at least one port and the sleeve defines at least one aperture, so that the sleeve has an open position with the aperture of the sleeve in fluid communication with the port in the isolation pipe. When the sleeve is in the open position, it permits fluid passage between the exterior of the screen and the interior of the isolation pipe. The sleeve also has a closed position with the aperture of the sleeve not in fluid communication with the port of the isolation pipe. When the sleeve is in the closed position, it prevents fluid passage between the exterior of the screen and the interior of the isolation pipe. The isolation system also has a complementary service string and shifting tool useful in combination with the isolation string. The service string has a washpipe that extends from the string to a position below the sleeve of the isolation string, wherein the washpipe has a shifting tool at the end. When the completion operations are finalized, the washpipe is pulled up through the sleeve. As the service string is removed from the wellbore, the shifting tool at the end of the washpipe automatically moves the sleeve to the closed position. This isolates the production zone during the time that the service string is tripped out of the well and the production seal assembly is run into the well.

Prior art systems that do not isolate the formation between tool trips suffer significant fluid losses Those prior art systems that close an isolation valve with a mechanical shifting tool at the end of a washpipe prevent fluid loss. However, the extension of the washpipe through the isolation valve presents a potential failure point. For example, the washpipe may become lodged in the isolation string below the isolation valve due to debris or settled sand particles. Also, the shifting tool may improperly mate with the isolation valve and become lodged therein.

Therefore, a need remains for an isolation system for well control purposes and for wellbore fluid loss control which combines simplicity, reliability, safety and economy, while also affording flexibility in use. A need remains for an isolation system which does not require a washpipe with a shifting tool for isolation valve closure.

BRIEF SUMMARY OF THE INVENTION

The invention includes in one embodiment an isolation string having an upper packer and an isolation pipe in mechanical communication with the upper packer, the isolation pipe comprising an operable valve and an object activated valve, and the isolation string coupled to an object holding service tool adapted to release an object to engage the object activated valve. The present invention also includes in one embodiment a method of running-in an isolation string with an object holding service tool having an object held therewith into the well, the isolation string comprising an operable valve and an object activated valve; setting the isolation string in the casing adjacent perforations; pressurizing the object to cause a release from the object holding service tool, whereby the object travels to the object activated valve; closing the object activated valve with the released object; and withdrawing the object holding service tool from the well.

One aspect includes four separate valves in combination: a Radial Flow Valve (RFV), an Annular Flow Valve (AFV), a Pressure Activated Control Valve (PACV), and an Interventionless Flow Valve (IFV). Generally, the RFV is an annulus to inside diameter pressure actuated valve with a double-pin connection at the bottom, the AFV is an annulus to annulus pressure actuated valve with a double-pin connection at the bottom, the PACV is an outside diameter to inside diameter pressure actuated valve, and the IFV is an outside diameter to inside diameter object actuated valve. A double-pin or double-sub connection is one having concentric inner and outer subs.

The present invention provides a valve system for a well, comprising: an isolation string, comprising an upper packer and an isolation pipe in mechanical communication with the upper packer, wherein the isolation pipe comprises a pressure activated valve, an object activated valve; and an object holding service tool coupled to the object activated valve and adapted to release an object to engage the object activated valve.

The present invention provides a method for isolating a production zone of a well, comprising: running-in an isolation string with an object holding service tool having an object held therewith into the well, the isolation string comprising a pressure activated valve, and an object activated valve; setting the isolation string in the casing adjacent perforations in the casing; pressurizing an area of the object to cause the object to be released from the object holding service tool, whereby the object travels to the object activated valve; at least partially closing the object activated valve with the released object; and withdrawing the object holding service tool from the well.

The present invention provides a valve system for a well, comprising: an isolation string, comprising an upper packer; a pressure activated, double-sub valve comprising first and second concentric subs, wherein the double-sub valve is in mechanical communication with the upper packer; an isolation pipe in mechanical communication with the first sub of the double-sub valve, wherein the isolation pipe comprises an object activated valve; and a production pipe in mechanical communication with the second sub of the double-sub valve; and further comprising an object holding service tool coupled to the object activated valve and comprising a holding barrel having a bore in which an object is slidably and sealingly engaged, the object holding service tool being adapted to slidably release the object with sufficient pressure applied to the object to cause a restraining device holding the object to release the object.

The present invention further provides a method for isolating a production zone of a well, comprising: running-in an isolation string with an object holding service tool having an object held therewith into the well, wherein the isolation string comprises a double-sub valve, and an object activated valve; setting the isolation string in the casing adjacent perforations in the casing; pressurizing an area on the object to cause the object to be released from the object holding service tool, whereby the object travels to the object activated valve; at least partially closing the object activated valve with the released object; and withdrawing the object holding service tool from the isolation string.

The present invention also provides a valve system for a wellbore, comprising: an object; an object holding service tool comprising a holding barrel having a bore in which the object is slidably and sealingly engaged, the object holding service tool being adapted to slidably release the object with sufficient pressure applied to the object to cause a restraining device holding the object to release the object, and an object activated valve, comprising a tube having at least one opening, a sleeve being movably connected to the tube, wherein the sleeve covers the at least one opening in a closed configuration and the sleeve does not cover the at least one opening in an open configuration, and an object seat in mechanical communication with the sleeve, wherein the seat receives an object for manipulating the valve from the open configuration to the closed configuration.

Further, the present invention provides an object holding service tool to actuate a downhole valve in a well, comprising a holding barrel having a bore adapted to slidably and sealingly engage an object held therewith, the object holding service tool being adapted to slidably release the object with sufficient pressure applied to the object to cause a restraining device holding the object to release the object.

The present invention also provides a valve system for a well having multiple zones for isolation, comprising: an isolation string, comprising a lower isolation section having a lower section upper packer and a lower section isolation pipe in mechanical communication with the lower section upper packer, wherein the lower section isolation pipe comprises a pressure activated valve and a lower section object activated valve; the isolation string also having an upper isolation section, comprising an upper section upper packer, a double-sub valve comprising first and second concentric subs, wherein the double-sub valve is in mechanical communication with the upper section upper packer; an upper section isolation pipe in mechanical communication with the first sub of the double-sub valve, wherein the isolation pipe comprises an upper section object activated valve; and a production pipe in mechanical communication with the second sub of the double-sub valve; wherein the upper section isolation pipe and the production pipe sting into the lower section upper packer; and further comprising an object holding service tool, comprising a holding barrel having a bore in which an object is slidably and sealingly engaged, the object holding service tool being adapted to slidably release the object with sufficient pressure applied to the object to cause a restraining device holding the object to release the object, the object holding service tool being coupled to at least one of the isolation sections.

The invention also provides a downhole assembly, comprising an object; an object holding service tool adapted to selectively hold the object; and a means for releasing the object from the object holding service tool.

In yet another embodiment, the invention provides a valve system for a well, comprising an isolation string having an upper packer and an isolation pipe in mechanical communication with the upper packer, wherein the isolation pipe comprises an operable valve and an object activated valve; and further comprising an object holding service tool coupled to the object activated valve and adapted to release an object to engage the object activated valve.

BRIEF DESCRIPTION OF THE DRAWINGS

A more complete understanding of the present invention and advantages thereof may be acquired by referring to the following description taken in conjunction with the accompanying drawings, in which like reference numbers indicate like features, and wherein.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

Preferred embodiments of the present invention are illustrated in the Figures, like numeral being used to refer to like and corresponding parts of the various drawings.

The present invention includes various valves, herein "operable valves", as part of the system or method, which can be themselves embodiments of the present invention. A Radial Flow Valve (RFV) is an annulus to inside diameter pressure actuated valve with a double pin connection at the bottom. An Annular Flow Valve (AFV) is an annulus to annulus pressure actuated valve with a double pin connection at the bottom. A Pressure Activated Control Valve (PACV) is an outside diameter to inside diameter pressure actuated valve. An Interventionless Flow Valve (IFV) is an outside diameter to inside diameter object actuated valve. Other valves such as mechanically operated valves, including those valves with sliding sleeves, can be used with the present invention.

Figure 1A:
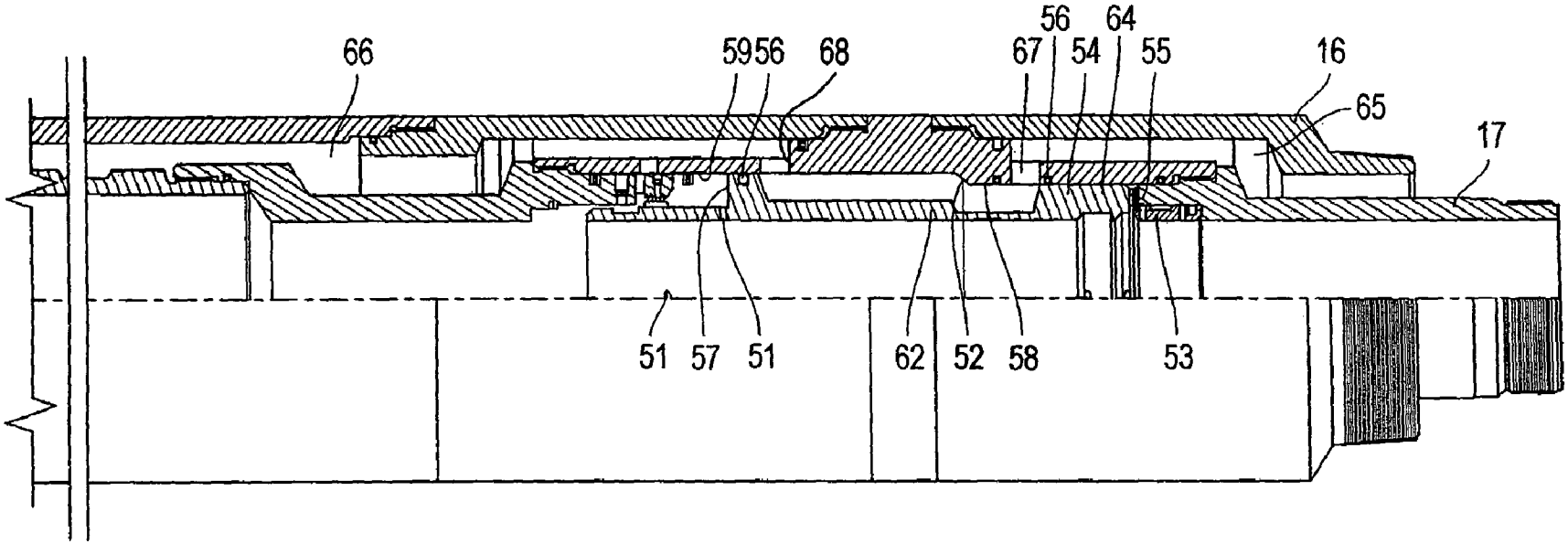
FIGS. 1A–1C show a cross-sectional side view of an AFV, wherein the valve is in an open configuration.
Figure 1B:
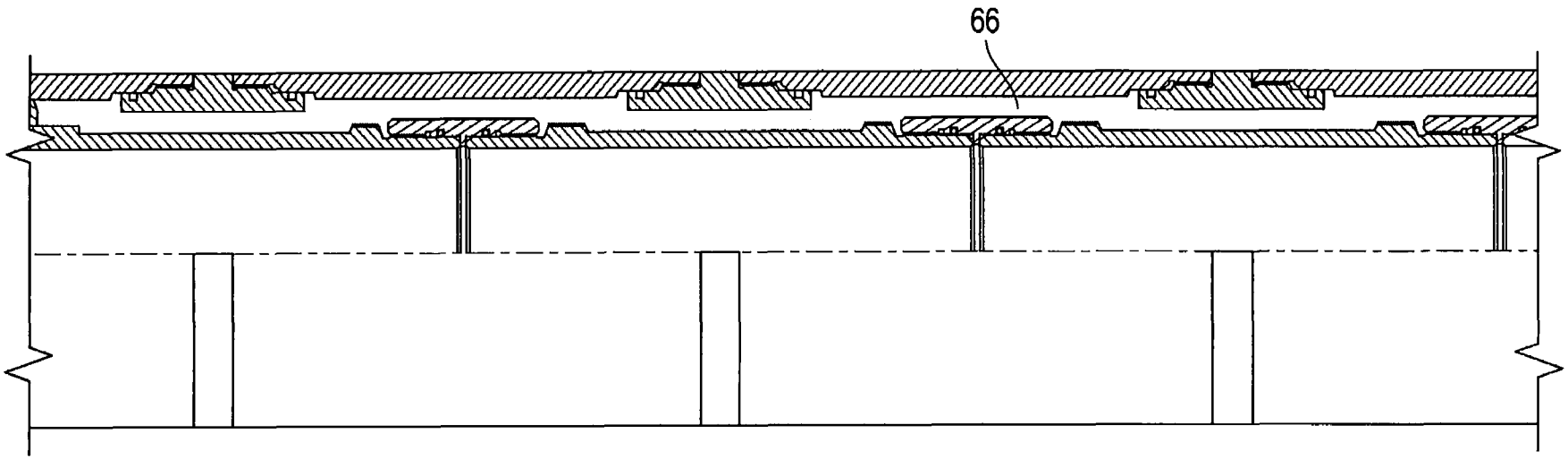
Figure 1C:
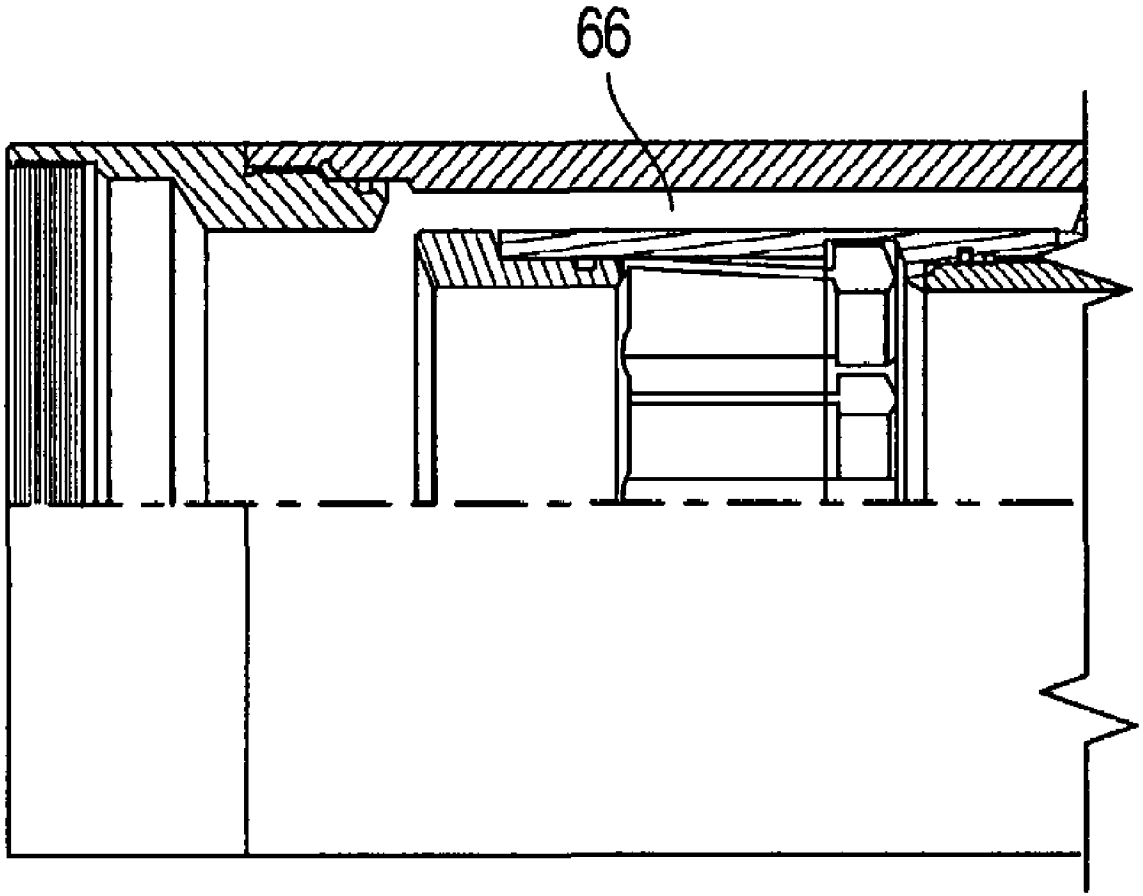

Referring to FIGS. 1A–1C and 2A–2C, detailed drawings of an AFV are shown. In FIGS. 1A–1C, the valve is shown in an open position and in FIGS. 2A–2C, the valve is shown in a closed position. The terms "open" and "uncovered" and "closed" and "cover" and variations thereof are used broadly herein. For example, the terms "open" or "uncovered" position can include at least partially open such as elements are disengaged so that fluid can flow through the valve. Similarly, "closed" or "covered" can include at least partially closed such that elements are engaged so that fluid is restricted or stopped from flowing through the valve.

In the open position, the valve enables fluid communication through the annulus between the interior and exterior tubes of the isolation string. Essentially, these interior and exterior tubes are sections of the base pipe 16 and the isolation pipe 17, wherein a lower annulus 65 is defined between. The AFV comprises a shoulder 52 that juts into the annulus between a small diameter sealing land 58 and a relatively large diameter sealing land 59. A moveable joint 54 is internally concentric to the shoulder 52 and the sealing lands 58 and 59. Seals 56 are positioned between the moveable joint 54 and the sealing lands 58 and 59. The movable joint 54 has a spanning section 62 and a closure section 64, wherein the outside diameter of the spanning section 62 is less than the outside diameter of the closure section 64.

Figure 2A:
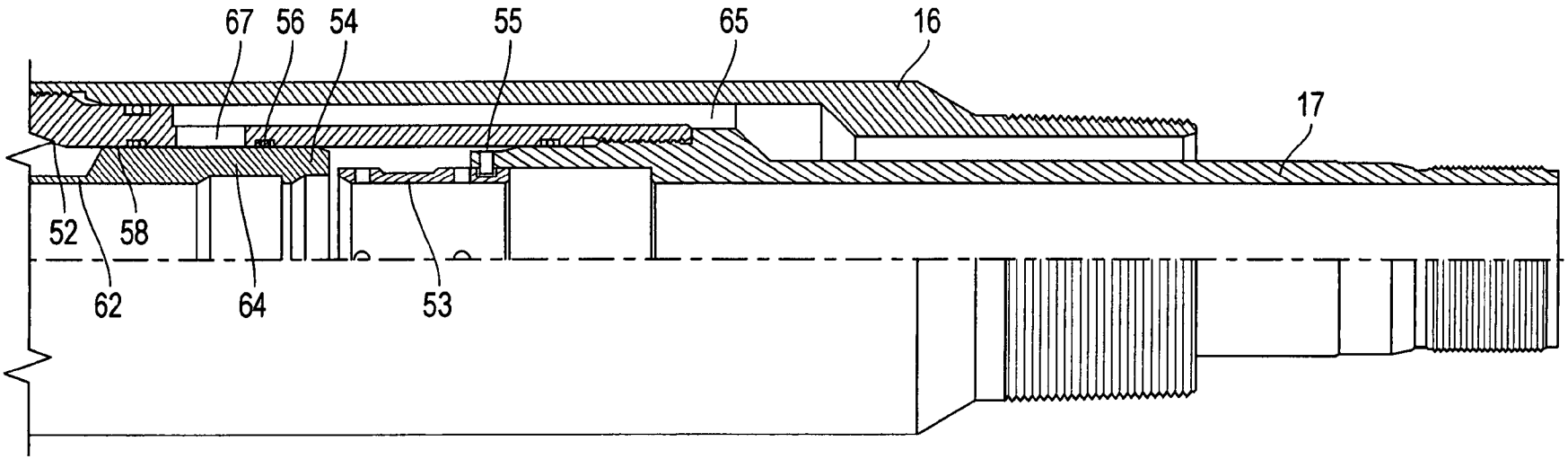
FIGS. 2A–2C show a cross-sectional side view of a portion of the AFV of FIGS. 1A–1C, wherein the valve is in a closed configuration.
Figure 2B:
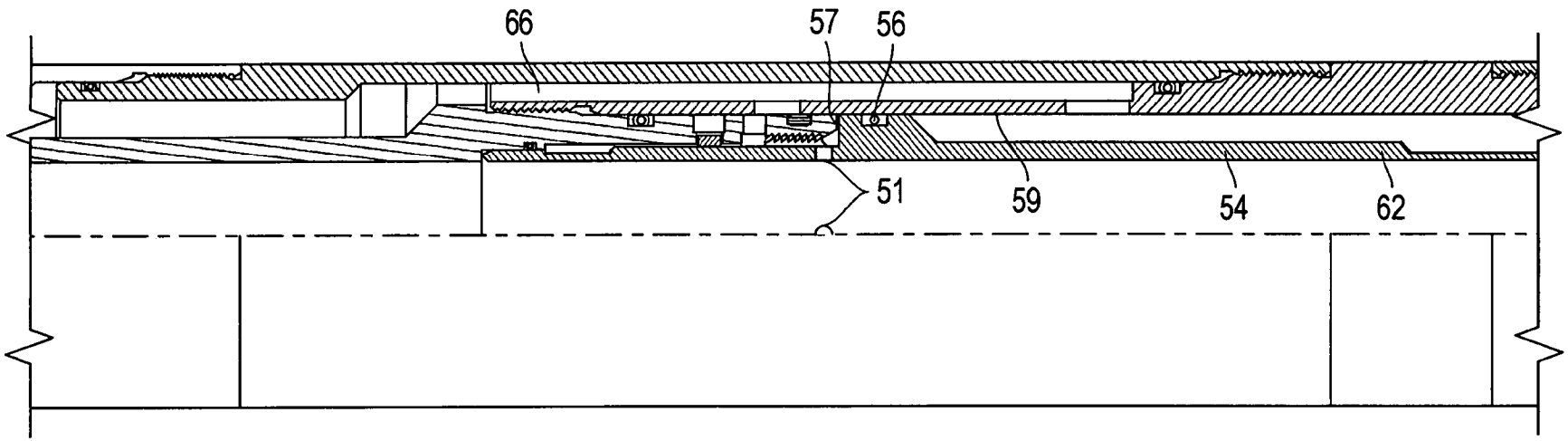
Figure 2C:
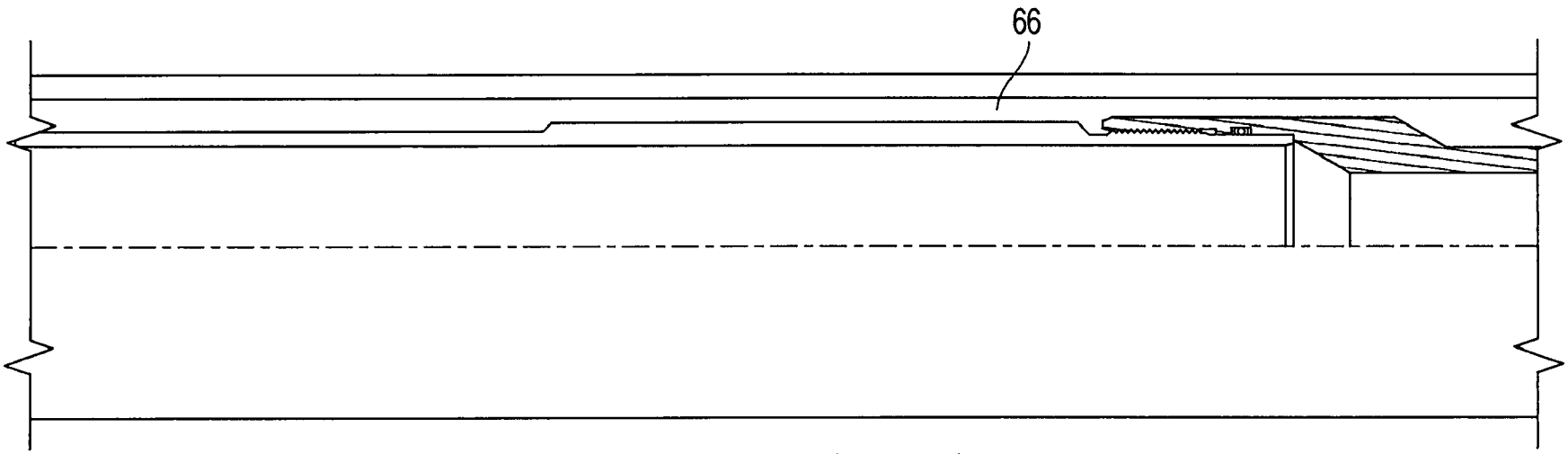

The AFV is in a closed position, as shown in FIGS. 2A–2C, when the valve is inserted in the well. In the closed position, the closure section 64 of the movable joint 54 covers lower ports 67. The AFV is held in the closed position by a shear pin 55. The shear pin 55 holds a lock ring 53 in a fixed position relative to the isolation pipe 17. A certain change in fluid pressure differential between an upper annulus 66 of the AFV and the tubing, usually a pressure increase in the tubing, causes the moveable joint 54 to shift. In particular, excess tubing pressure is communicated through ports 51 to operate against annular wall 57. Because the small diameter sealing land 58 is relatively smaller than the large diameter sealing land 59, the relatively higher tubing pressure drives the movable joint 54 in the direction of the lock ring. 53. The movable joint 54 continues to drive against the lock ring 53 until the force is sufficient to shear the shear pin 55. Upon shear, both the lock ring 53 and the movable joint 54 move in the direction of the isolation pipe 17 until the movable joint 54 is in an open configuration, as shown in FIGS. 1A–1C. When the movable joint 54 is in the open configuration, the spanning section 62 of the movable joint 54 spans the lower ports 67. This allows fluid to pass freely through the AFV between the lower annulus 65, through lower ports 67, through upper ports 68, and through the upper annulus 66.

Figure 3A:
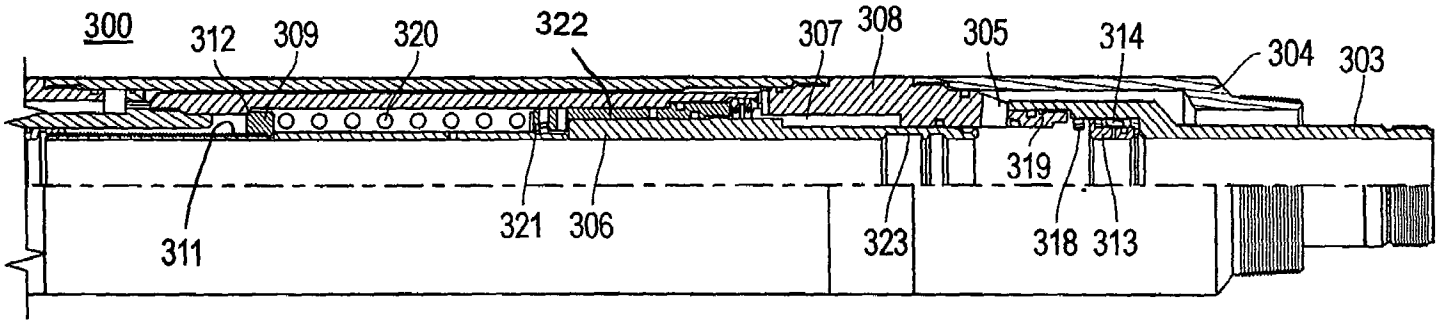
FIGS. 3A–3C show a cross-sectional side view of a RFV, wherein the valve is in an open configuration.
Figure 4A:
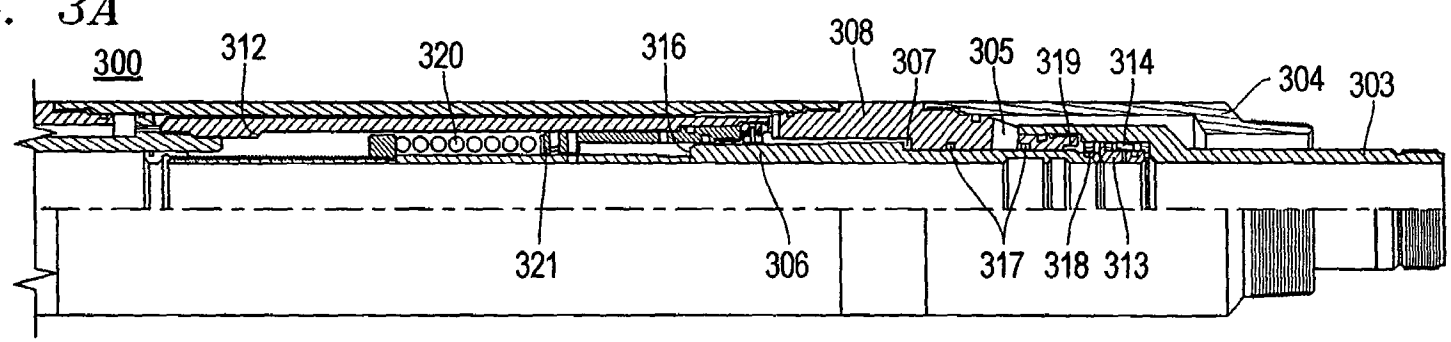
FIGS. 4A–4C show a cross-sectional side view of the RFV of FIGS. 3A–3C, wherein the valve is in an unlocked-closed configuration.
Figure 5A:
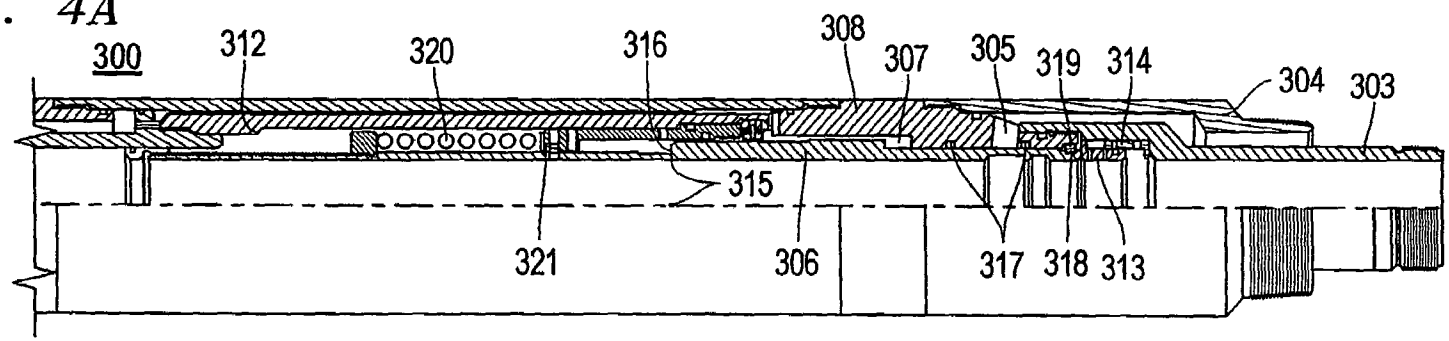
FIGS. 5A–5C show a cross-sectional side view of the RFV of FIGS. 3A–3C, wherein the valve is in a locked-closed configuration.
Figure 3B:
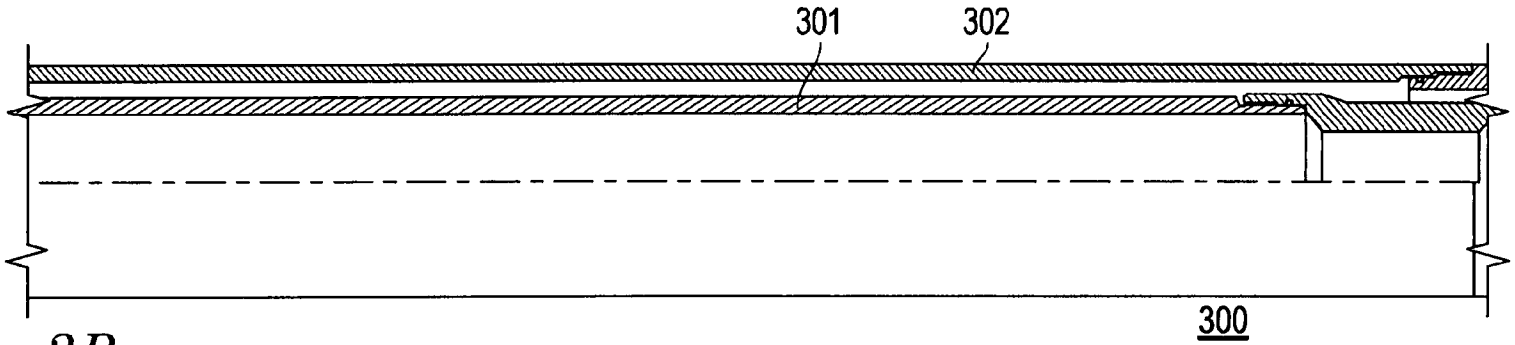
Figure 4B:
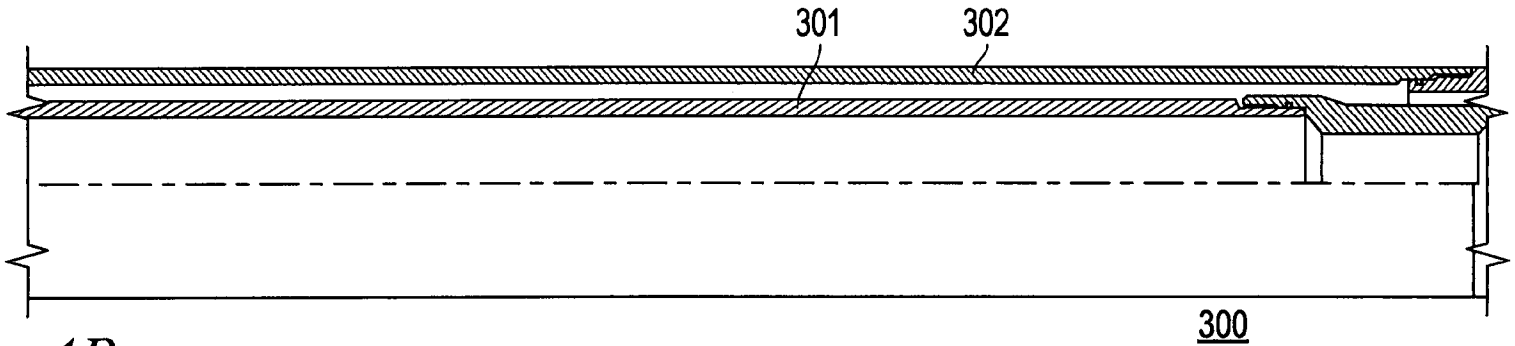
Figure 5B:
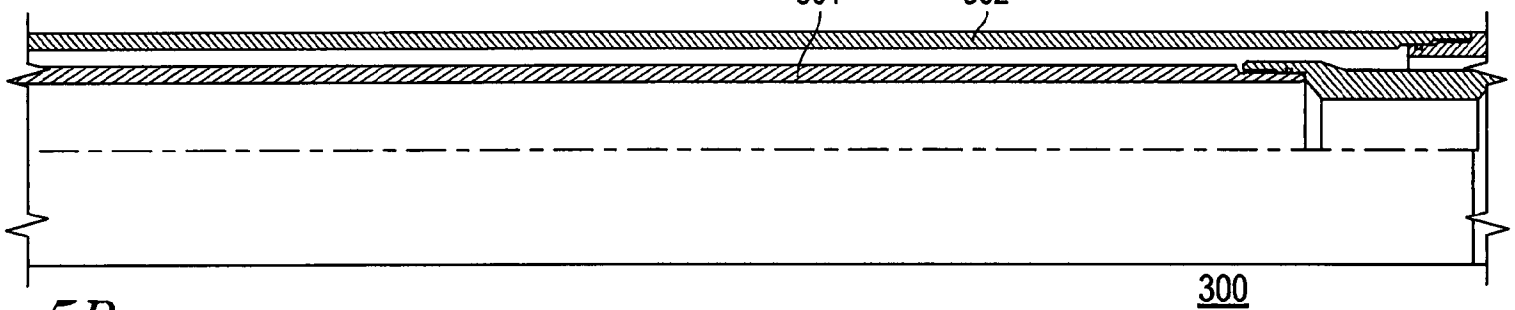
Figure 3C:
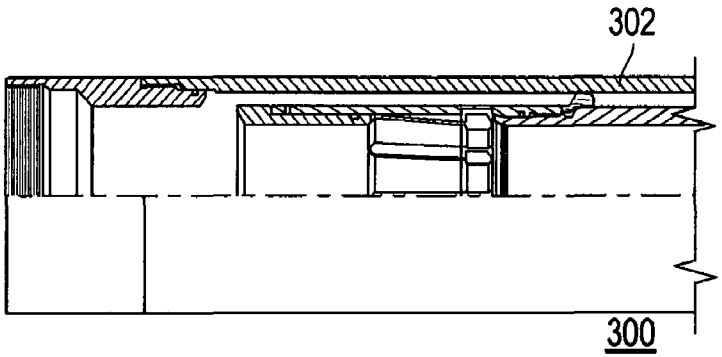
Figure 4C:
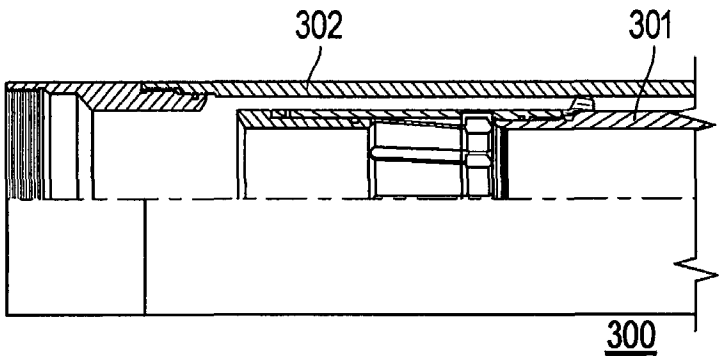
Figure 5C:
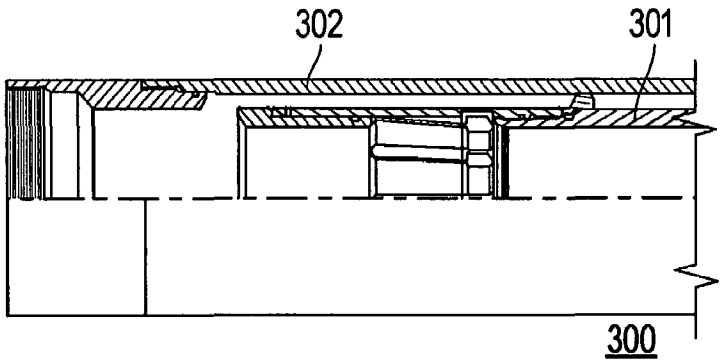
Figure 6A:
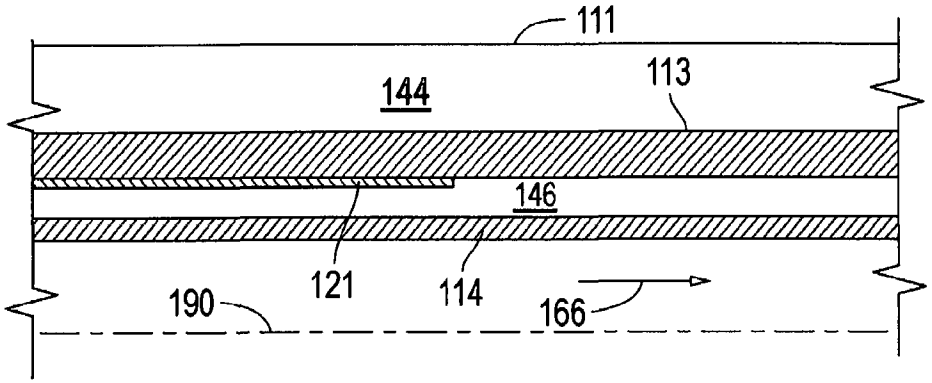
FIGS. 6A–6D are a side, partial cross-sectional, diagrammatic view of half of a PACV in accordance with the present invention in a locked-closed configuration. It will be understood that the cross-sectional view of the other half of the PACV is a mirror image taken along the longitudinal axis.
Figure 7A:
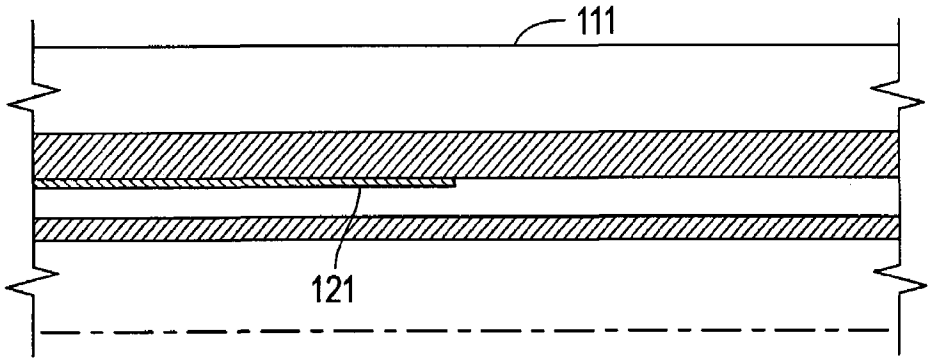
FIGS. 7A–7D illustrate the PACV of FIGS. 6A–6D in an unlocked-closed configuration.
Figure 6B:
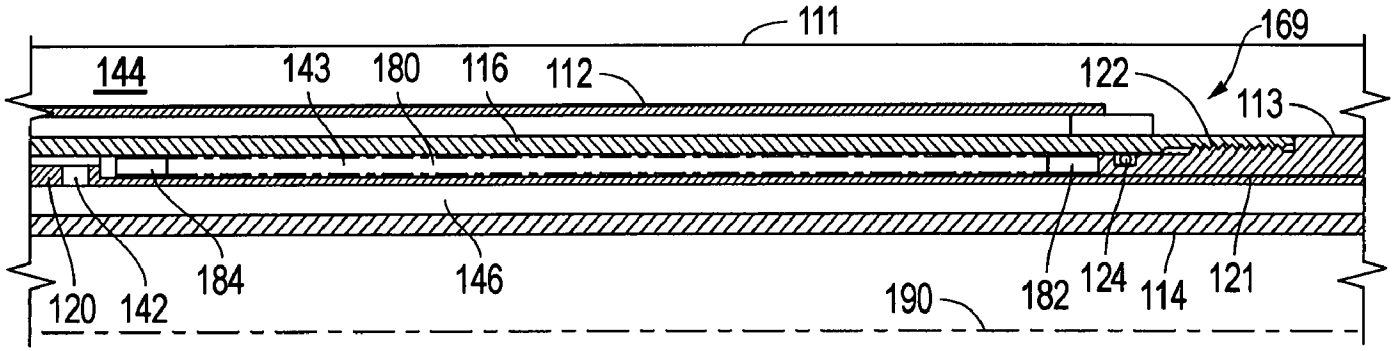
Figure 7B:
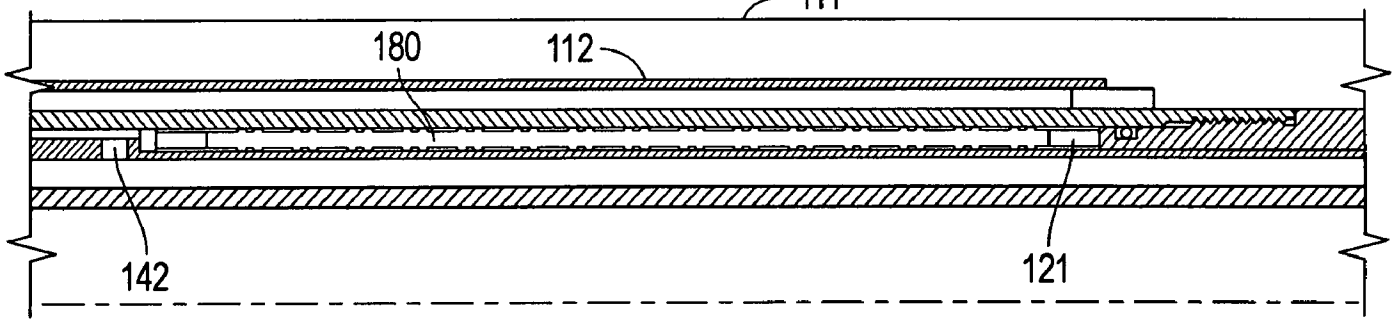
Figure 6C:
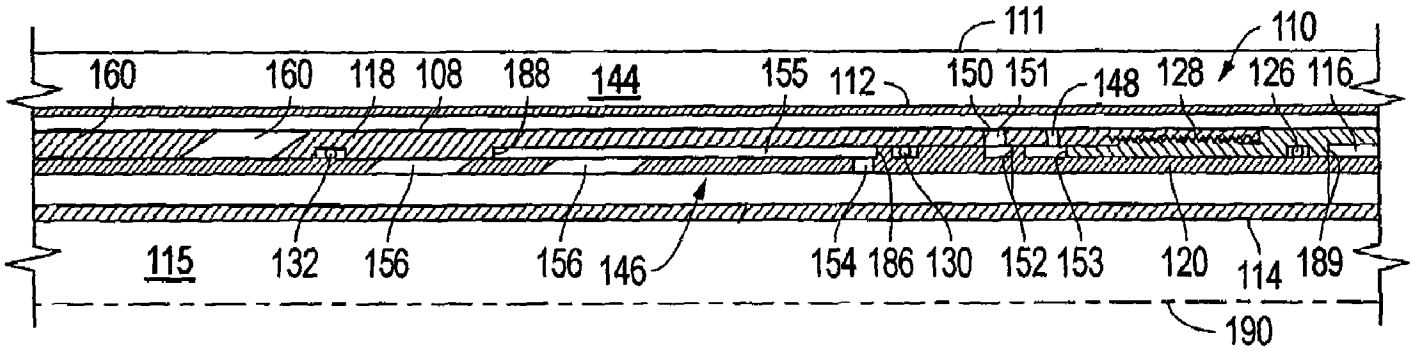
Figure 7C:
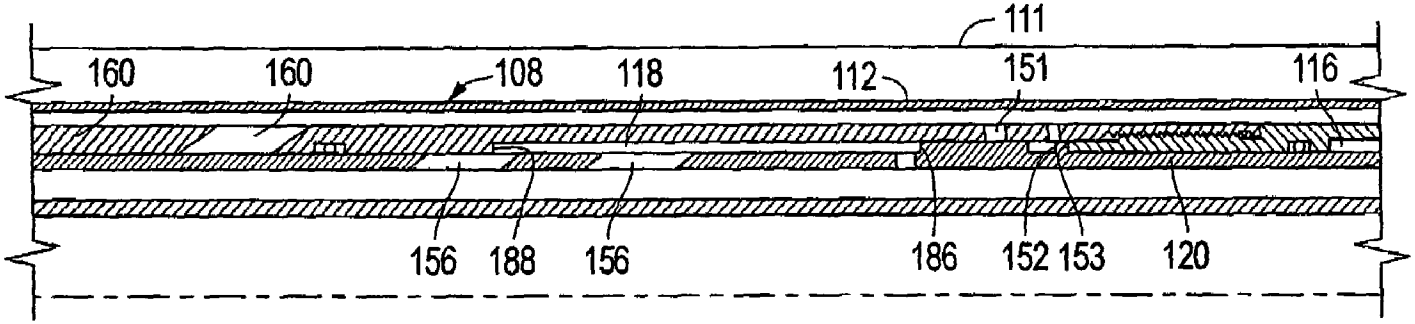

The other double-pin valve is the RFV, as shown in FIGS. 3A–5C. Similar to the AFV shown in FIGS. 1A–1C and 2A–2C, the RFV has inner and outer concentric subs. Also, the RFV is pressure activated. In FIGS. 3A–3C, the RFV is shown in an open configuration. In FIGS. 4A–4C, the RFV is shown in a closed, unlocked (sheared) configuration. In FIGS. 5A–5C, the RFV is shown in a closed, locked configuration.

Referring to FIGS. 3A–5C, the a cross-sectional side view of the RFV 300 is shown. The RFV 300 comprises a double-wall construction made up of an inner tube 301 and an outer tube 302. At the bottom of the valve there are inner and outer subs 303 and 304, respectively. A fluid flow path is defined by the inner and outer subs 303 and 304 to communicated fluid between the subs up to ports 305. The RFV 300 also has a sleeve 306 which is slidable within the inner tube 301 of the valve. The lower portion of the sleeve 306 is formed to slide over the ports 305 to completely restrict the flow of fluid through the ports 305. A pressure chamber 307 is defined by a portion of the sleeve 305 and a portion of a mounting ring 308. The inner and outer tubes 301 and 302 are mounted to the top of the mounting ring 308 and the inner and outer subs 303 and 304 are mounted to the bottom of the mounting ring 308. The ports 305 extend through the mounting ring 308. The valve also has a spring-biased lock ring 309 which engages teeth on the sleeve 306.

Typically, the RFV 300 is run in the well in a closed-locked configuration, as shown in FIGS. 5A–5C. In the closed-locked configuration, the sleeve 306 covers the ports 305. The RFV 300 is held in the closed-locked configuration by lock ring 313. The lock ring 313 has inner and outer rings which telescope into each other. The lock ring 313 is secured in an extended position by shear screws 314. In the extended position, the shear screws are screwed through both inner and outer rings of the lock ring 313. Because the lock ring 313 is fixed in an extended position, the lock ring 313 and sleeve 306 are unable to slide in the direction of the inner sub 303. The sleeve 306 is also secured to the mounting ring 308 to prevent it from sliding in the opposite direction of the inner sub 303. The sleeve 306 is secured to the mounting ring 308 by a snap ring 318, which is spring biased to expand itself radially outward. However, in the closed-locked configuration, the snap ring 318 is held in a groove in the outside, lower end of the sleeve 306 by the lowermost portion of the mounting ring 308. At the lowermost portion of the mounting ring 308, there is a shoulder 319 which prevents the snap ring 318, and hence the sleeve 306, from sliding in a direction away from the inner sub 303.

The RFV 300 may be reconfigured to a closed-unlocked (sheared) configuration, as shown in FIGS. 4A–4C. The RFV 300 is unlocked by creating a pressure differential between the inner diameter of the sleeve 306 and the pressure chamber 307. Fluid from the inner diameter bleeds through ports 315 in the sleeve 306 to work against annular wall 316. The sleeve 306 has a greater outside diameter above the pressure chamber 307 than it has below the pressure chamber 307. Thus, a relatively higher fluid pressure in the inner diameter of the sleeve 306 compared to the pressure chamber 307, drives the sleeve 306 toward the inner sub 303. As the sleeve 306 slides toward the inner sub 303, it bears on the lock ring 313. When the downward force becomes great enough, the lock ring 313 shears the shear screws 314 to release the inner and outer rings of the lock ring 313 so they are able to collapse into each other. Upon release, the lock ring 313 collapses and the sleeve 306 continues to move downwardly until they come to rest in the closed-unlocked (sheared) configuration shown in FIGS. 4A–4C. As the sleeve 306 moves downward, the snap ring 318 is pushed into a larger bore and expands out of the groove in the sleeve 306 to release the sleeve 306 from the mounting ring 308. In this position, the snap ring 318 holds the lock ring 313 in its sheared position. This RFV configuration is closed because the sleeve 306 is over the ports 305 to completely restrict the flow of fluid through the ports 305. Seals 317 are positioned above and below the ports 305 to ensure the integrity of the valve.

The RFV 300 also has a spring 320 which works between the lock ring 309 and a seal sleeve 321 to bias the sleeve 306 in the direction away from the inner sub 303. As noted above, the lock ring 309 is secured to the sleeve 306 by teeth 311 on the mating surfaces. In the closed-unlocked configuration of the RFV 300, the spring 320 is fully compressed, as shown in FIG. 4A.

FIGS. 3A–3C illustrate the RFV 300 in an open configuration. The valve is opened by reducing the pressure differential between the inner diameter of the sleeve 306 and the pressure chamber 307. When this pressure differential is reduced, the spring 320 pushes the sleeve 306 away from the ports 305 in a direction opposite from the inner sub 303 until the ports 305 are uncovered and until the lock ring 309 engages a shoulder 312. The valve also has a ratchet lock ring 322 between the seal sleeve 321 and the sleeve 306. As the sleeve 306 is pushed by the spring 320, the ratchet lock ring 322 jumps over the teeth on the sleeve 306 as it moves into the open position. Because of the configuration of the threads on the ratchet lock ring 322 and sleeve 306, the sleeve 306 is held in the open position by the ratchet lock ring 322 regardless of subsequent changes in the pressure differential.

Alternately, the RFV 300 may be opened by engaging the inner diameter profile 323 in the sleeve 306 with any one of several commonly available wireline or coiled tubing tools (not shown). Applying a downward force to the sleeve 306 shears the shear screws 314 and releases the snap ring 318. The spring 320 then pushes the sleeve 306 away from the ports 305 into the open position as described above. The wireline or coiled tubing tool is then released from the inner diameter profile 323 and removed from the well.

Two additional valves are utilized in different embodiments of the isolation strings of the present invention. The valves are placed in an isolation tube, which may be wire wrapped or placed adjacent a production screen as discussed below. One of the valves is pressure activated while the other is object activated.

Referring to FIGS. 6A–6D, there is shown a Pressure Activated Control Valve (PACV) in a production tubing assembly 110. The production tubing assembly 110 is mated in a conventional manner and will only be briefly described herein. Assembly 110 includes isolation pipe 140 that extends above the assembly and a production screen assembly 112 with the PACV assembly 108 controlling fluid flow through the screen assembly. In this illustration, the production screen assembly 112 is mounted on the exterior of PACV assembly 108. PACV assembly 108 is interconnected with isolation pipe 140 at the uphole end by threaded connection 138 and seal 136. Similarly on the downhole end 169, PACV assembly 108 is interconnected with isolation tubing extension 113 by threaded connection 122 and seal 124. In the views shown, the production tubing assembly 110 is disposed in well casing 111 and has inner tubing 114, with an internal bore 115, extending through the inner bore 146 of the assembly.

Referring now more particularly to PACV assembly 108, there is shown outer sleeve upper portion 118 joined with an outer sleeve lower portion 116 by threaded connection 128. Outer sleeve upper portion 118 includes a plurality of production openings 160 for the flow of fluid from the formation when the valve is in an open configuration. For the purpose of clarity in the drawings, these openings have been shown at a 45° inclination. Outer sleeve upper portion 118 also includes through bores 148 and 150. Disposed within bore 150 is shear pin 151, described further below. The outer sleeve assembly has an outer surface and an internal surface. On the internal surface, the outer sleeve upper portion 118 defines a shoulder 188 (see FIG. 6C) and an area of reduced wall thickness extending to threaded connection 128 resulting in an increased internal diameter between shoulder 188 and connection 128. Outer sleeve lower portion 116 further defines internal shoulder 189 and an area of reduced internal wall thickness extending between shoulder 189 and threaded connection 122. Adjacent threaded connection 138, outer sleeve portion 118 defines an annular groove 176 adapted to receive a locking ring 168.

Referring now more particularly to PACV assembly 108, there is shown outer sleeve upper portion 118 joined with an outer sleeve lower portion 116 by threaded connection 128. For the purpose of clarity in the drawings, these openings have been shown at a 45° inclination. Outer sleeve upper portion 118 includes a plurality of production openings 160 for the flow of fluid from the formation when the valve is in an open configuration. Outer sleeve upper portion 118 also includes through bores 148 and 150. Disposed within bore 150 is shear pin 151, described further below. The outer sleeve assembly has an outer surface and an internal surface. On the internal surface, the outer sleeve upper portion 118 defines a shoulder 188 (see FIG. 6C) and an area of reduced wall thickness extending to threaded connection 128 resulting in an increased internal diameter between shoulder 188 and connection 128. Outer sleeve lower portion 116 further defines internal shoulder 189 and an area of reduced internal wall thickness extending between shoulder 189 and threaded connection 122. Adjacent threaded connection 138, outer sleeve portion 118 defines an annular groove 176 adapted to receive a locking ring 168.

Disposed within the outer sleeves is inner sleeve 120. Inner sleeve 120 includes production openings 156 which are sized and spaced to correspond to production openings 160, respectively, in the outer sleeve when the valve is in an open configuration. Inner sleeve 120 further includes relief bores 154 and 142. On the outer surface of inner sleeve there is defined a projection defining shoulder 186 and a further projection 152. Further inner sleeve 120 includes a portion 121 having a reduced external wall thickness. Portion 121 extends down hole and slidably engages production pipe extension 113. Adjacent uphole end 167, inner sleeve 120 includes an area of reduced external diameter 174 defining a shoulder 172.

In the assembled condition shown in FIGS. 6A–6D, inner sleeve 120 is disposed within outer sleeves 116 and 118, and sealed thereto at various locations. Specifically, on either side of production openings 160, seals 132 and 134 seal the inner and outer sleeves. Similarly, on either side of shear pin 151, seals 126 and 130 seal the inner sleeve and outer sleeve. The outer sleeves and inner sleeve combine to form a first chamber 155 defined by shoulder 188 of outer sleeve 118 and by shoulder 186 of the inner sleeve. A second chamber 143 is defined by outer sleeve 116 and inner sleeve 120. A spring member 180 is disposed within second chamber 143 and engages production tubing 113 at end 182 and inner sleeve 120 at end 184. A lock ring 168 is disposed within recess 176 in outer sleeve 118 and retained in the recess by engagement with the exterior of inner sleeve 120. Lock ring 168 includes a shoulder 170 that extends into the interior of the assembly and engages a corresponding external shoulder 172 on inner sleeve 120 to prevent inner sleeve 120 from being advanced in the direction of arrow 164 beyond lock ring 168 while it is retained in groove 176.

The PACV assembly has three configurations as shown in FIGS. 6A–8E. In a first configuration shown in FIGS. 6A–6D, the production openings 156, in inner sleeve 120 are axially spaced from production openings 160 along longitudinal axis 190. Thus, PACV assembly 108 is closed and restricts flow through screen 112 into the interior of the production tubing. The inner sleeve is locked in the closed configuration by a combination of lock ring 168 which prevents movement of inner sleeve 120 up hole in the direction of arrow 164 to the open configuration. Movement down hole is prevented by shear pin 151 extending through bore 150 in the outer sleeve and engaging an annular recess in the inner sleeve. Therefore, in this position the inner sleeve is in a locked closed configuration.

In a second configuration shown in FIGS. 7A–7D, shear pin 151 has been severed and inner sleeve 120 has been axially displaced down hole in relation to the outer sleeve in the direction of arrow 166 until external shoulder 152 on the inner sleeve engages end 153 of outer sleeve 116. The production openings of the inner and outer sleeves continue to be axial displaced to prevent fluid flow therethrough. With the inner sleeve axial displaced down hole, lock ring 168 is disposed adjacent reduced outer diameter portion 174 of inner sleeve 120 such that the lock ring may contract to a reduced diameter configuration. In the reduced diameter configuration shown in FIG. 7, lock ring 168 may pass over recess 176 in the outer sleeve without engagement therewith. Therefore, in this configuration, inner sleeve is in an unlocked position.

In a third configuration shown in FIGS. 8A–8E, inner sleeve 120 is axially displaced along longitudinal axis 190 in the direction of arrow 164 until production openings 156 of the inner sleeve are in substantial alignment with production openings 160 of the outer sleeve. Axial displacement is stopped by the engagement of external shoulder 186 with internal shoulder 188. In this configuration, PACV assembly 108 is in an open position.

In the operation of a preferred embodiment, at least one PACV is mated with production screen 112 and, production tubing 113 and 140, to form production assembly 110. The production assembly according to FIG. 4 with the PACV in the locked-closed configuration, is then inserted into casing 111 until it is positioned adjacent a production zone (not shown). When access to the production zone is desired, a predetermined pressure differential between the casing annulus 144 and internal annulus 146 is established to shift inner sleeve 120 to the unlocked-closed configuration shown in FIG. 7. It will be understood that the amount of pressure differential required to shift inner sleeve 120 is a function of the force of spring 180, the resistance to movement between the inner and outer sleeves, and the shear point of shear pin 151. Thus, once the spring force and resistance to movement have been overcome, the shear pin determines when the valve will shift. Therefore, the shifting pressure of the valve may be set at the surface by inserting shear pins having different strengths.

A pressure differential between the inside and outside of the valve results in a greater amount of pressure being applied on external shoulder 186 of the inner sleeve than is applied on projection 152 by the pressure on the outside of the valve. Thus, the internal pressure acts against shoulder 186 to urge inner sleeve 120 in the direction of arrow 166 to sever shear pin 151 and move projection 152 into contact with end 153 of outer sleeve 116. It will be understood that relief bore 148 allows fluid to escape the chamber formed between projection 152 and end 153 as it contracts. In a similar fashion, relief bore 142 allows fluid to escape chamber 143 as it contracts during the shifting operation. After inner sleeve 120 has been shifted downhole, lock ring 168 may contract into the reduced external diameter of inner sleeve positioned adjacent the lock ring. Often, the pressure differential will be maintained for a short period of time at a pressure greater than that expected to cause the down hole shift to ensure that the shift has occurred. This is particularly important where more than one valve according to the present invention is used since once one valve has shifted to an open configuration in a subsequent step, a substantial pressure differential is difficult to establish.

The pressure differential is removed, thereby decreasing the force acting on shoulder 186 tending to move inner sleeve 120 down hole. Once this force is reduced or eliminated, spring 180 urges inner sleeve 120 into the open configuration shown in FIG. 6. Lock ring 168 is in a contracted state and no longer engages recess 176 such the ring now slides along the inner surface of the outer sleeve. In a preferred embodiment spring 180 has approximately 300 pounds of force in the compressed state in FIG. 7. However, varying amounts of force may be required for different valve configurations. Moreover, alternative sources other than a spring may be used to supply the force for opening. As inner sleeve 120 moves to the open configuration, relief bore 154 allows fluid to escape chamber 155 as it is contracted, while relief bores 148 and 142 allow fluid to enter the connected chambers as they expand.

Figure 8A:
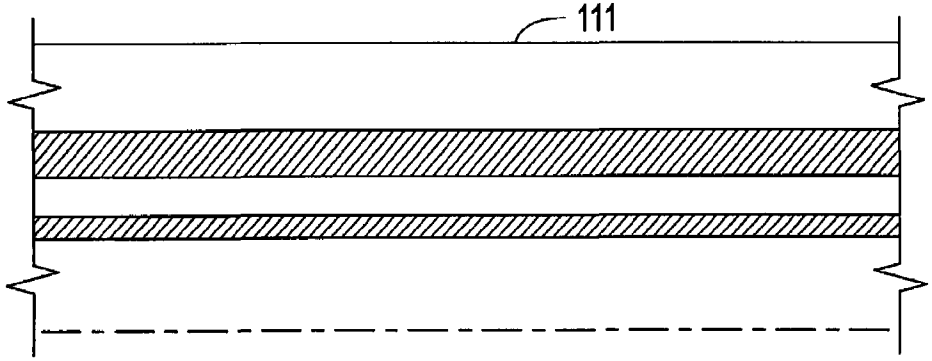
FIGS. 8A–8D illustrate the PACV of FIG. 6A–6D in an open configuration.
Figure 8B:
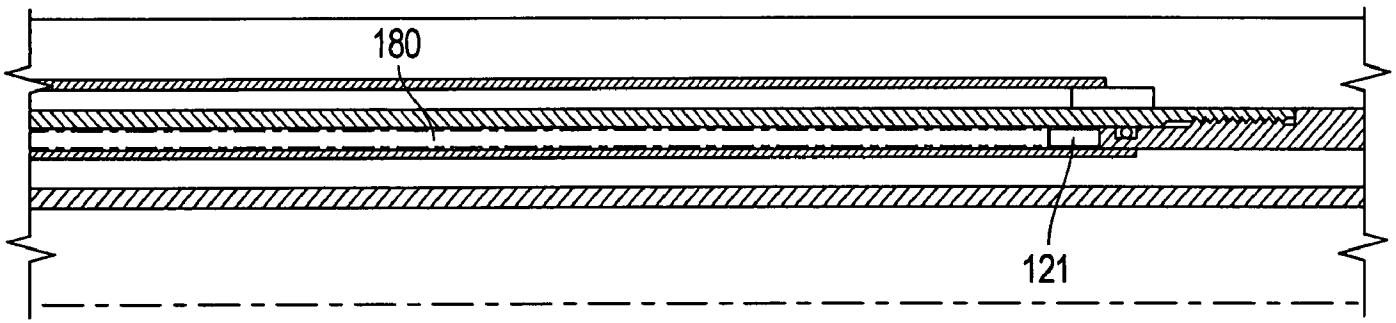
Figure 8C:
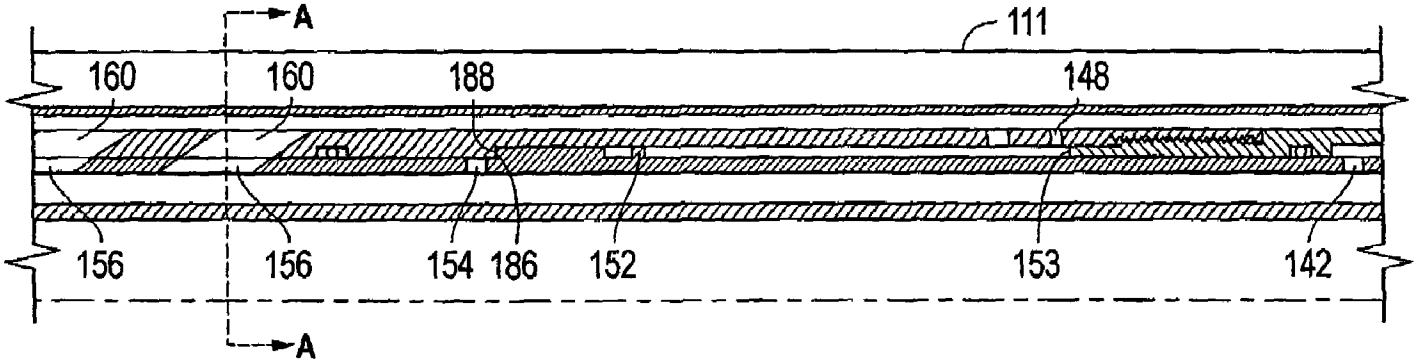
Figure 6D:
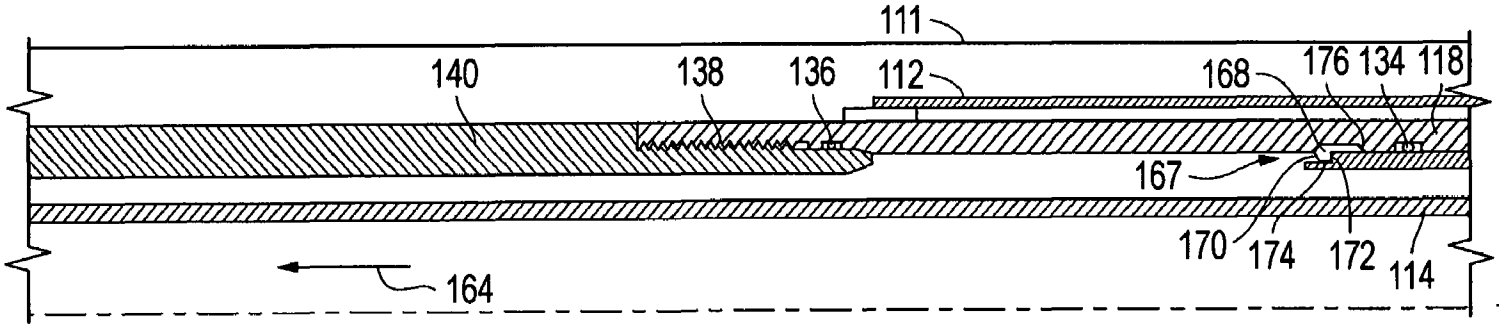
Figure 7D:
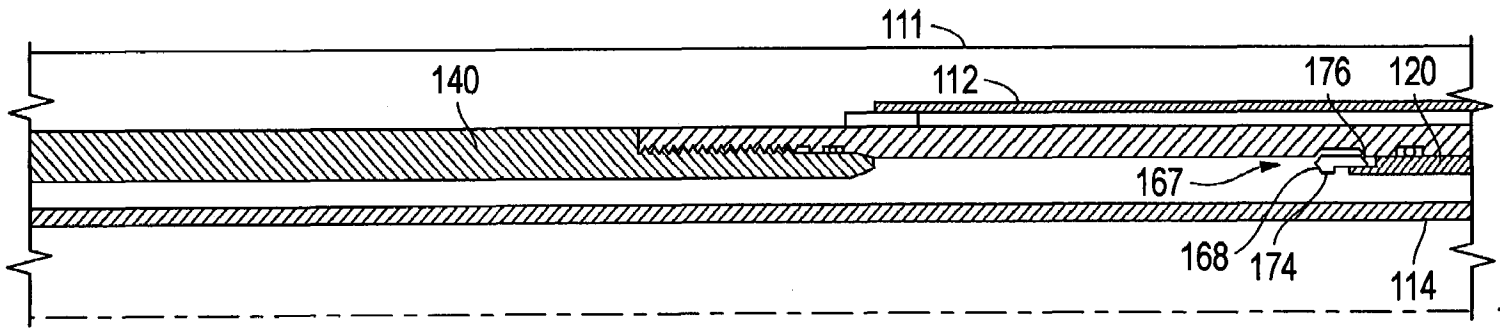
Figure 8D:
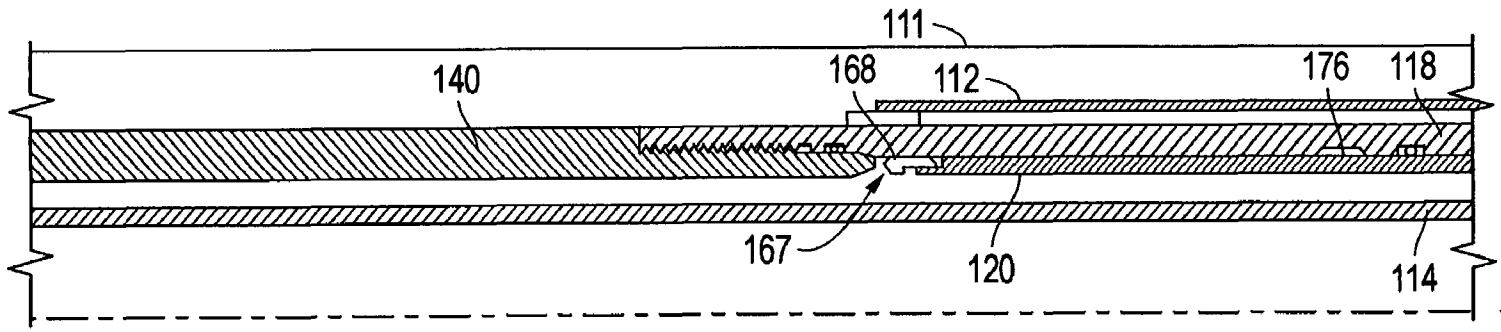
Figure 8E:
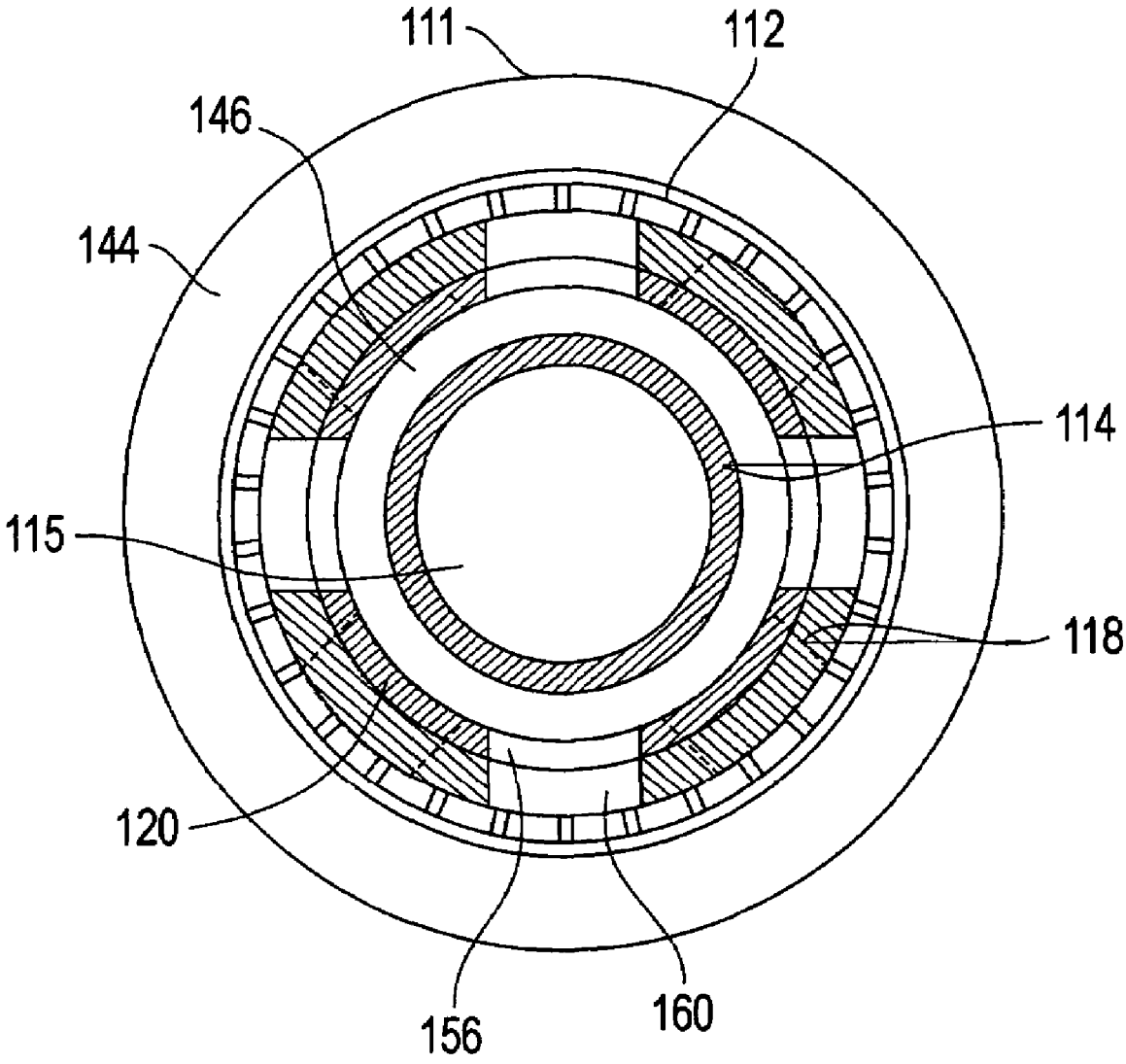
FIG. 8E is a cross-section, diagrammatic view taken along line A—A of the PACV of FIG. 8C showing the full assembly.

Shown in FIG. 8E is a cross-sectional, diagrammatic view taken along line A—A of FIG. 8C showing the full assembly.

Although only a single preferred PACV embodiment of the invention has been shown and described in the foregoing description, numerous variations and uses of a PACV according to the present invention are contemplated. As examples of such modification, but without limitation, the valve connections to the production tubing may be reversed such that the inner sleeve moves down hole to the open configuration. In this configuration, use of a spring 180 may not be required as the weight of the inner sleeve may be sufficient to move the valve to the open configuration. Further, the inner sleeve may be connected to the production tubing and the outer sleeve may be slidable disposed about the inner sleeve. A further contemplated modification is the use of an internal mechanism to engage a shifting tool to allow tools to manipulate the valve if necessary. In such a configuration, locking ring 168 may be replaced by a moveable lock that could again lock the valve in the closed configuration. Alternatively, spring 180 may be disengageable to prevent automatic reopening of the valve.

Further, use of a PACV is contemplated in many systems. One such system is the ISO system is described in U.S. Pat. No. 5,609,204; the disclosure therein is hereby incorporated by reference. A tool shiftable valve, such as the one described in the above reference patent, may be utilized in conjunction with the production screens to accomplish the gravel packing operation. Such a valve could be closed as the crossover tool string is removed to isolate the formation. The remaining production valves adjacent the production screen may be pressure actuated valves such that inserting a tool string to open the valves is unnecessary.

In some embodiments of the invention, a ball holding service tool is used to drop a drop ball on an IFV or other object activated valve to manipulate the valve. Two different ball holding service tools are illustrated below.

Figure 9A:
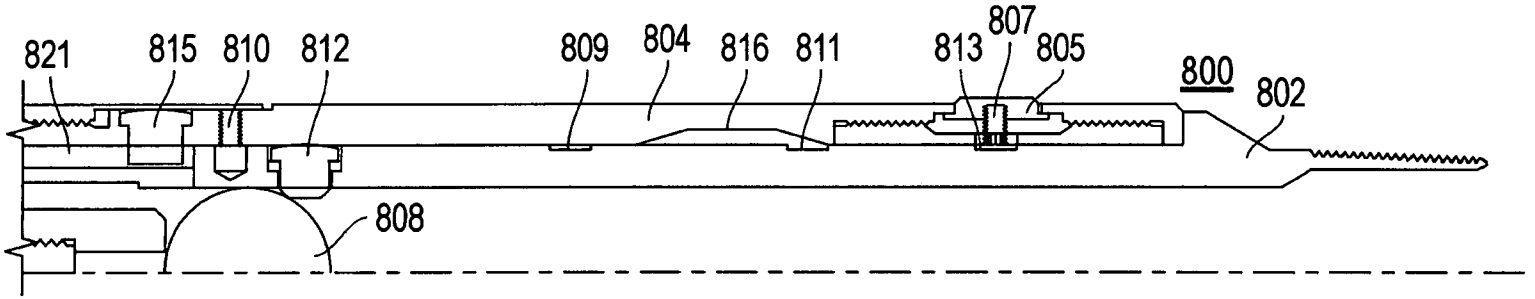
FIGS. 9A–9B illustrate a cross-sectional side view of a ball holding service tool, wherein the service tool is shown in a run-in position holding a drop ball in a locked configuration.
Figure 10A:
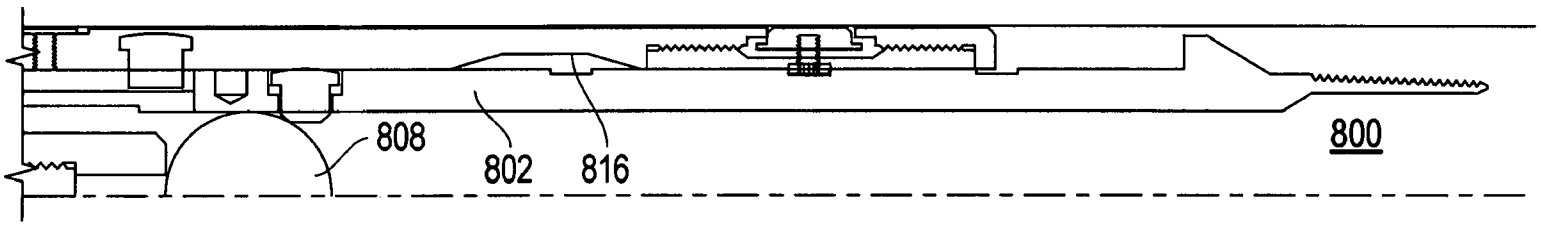
FIGS. 10A–10B illustrate a cross-sectional side view of the ball holding service tool of FIGS. 9A–9B, wherein the service tool is in a manipulation position with the drop ball is retained and the lock sleeve is moving between locked and unlocked configurations.
Figure 11A:
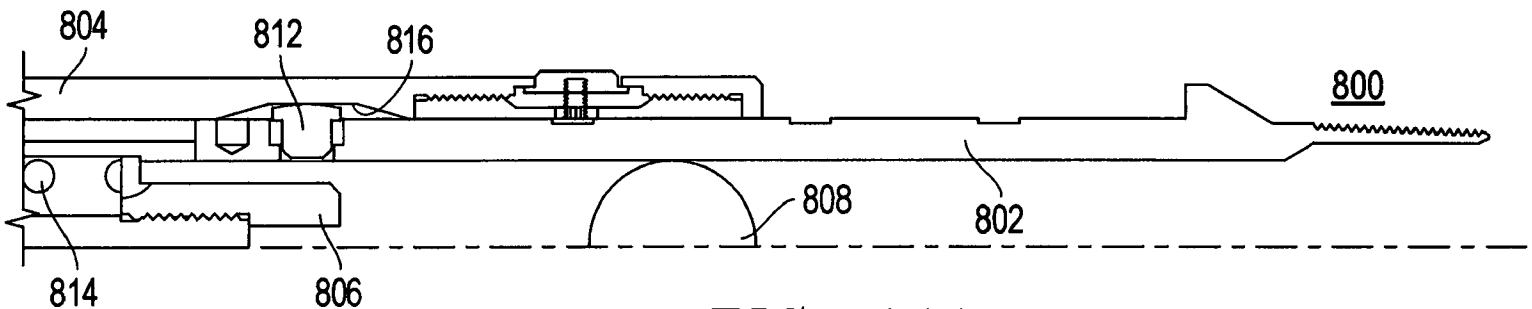
FIGS. 11A–11B show a cross-sectional side view of the ball holding service tool of FIGS. 9A–9B, wherein the service tool is shown in an unlocked, release position with the drop ball being ejected from the tool.
Figure 9B:
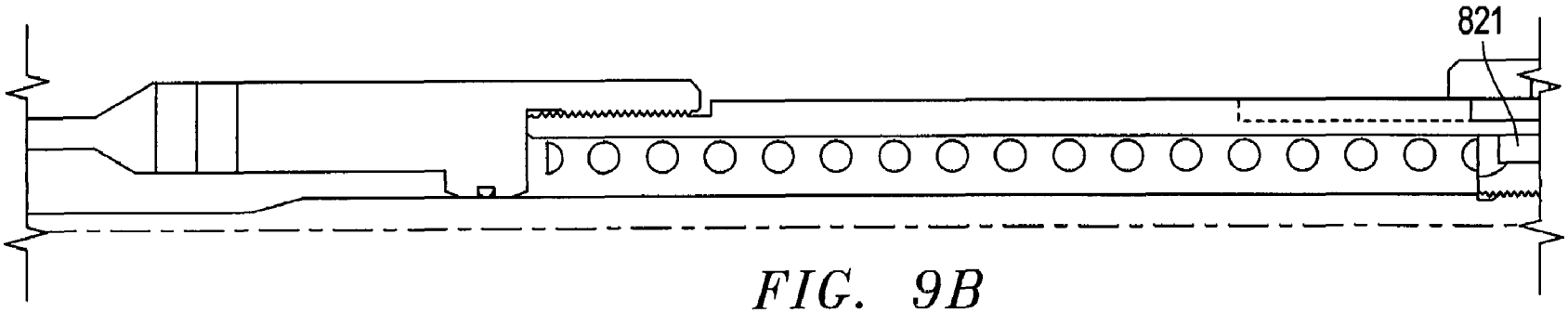
Figure 10B:
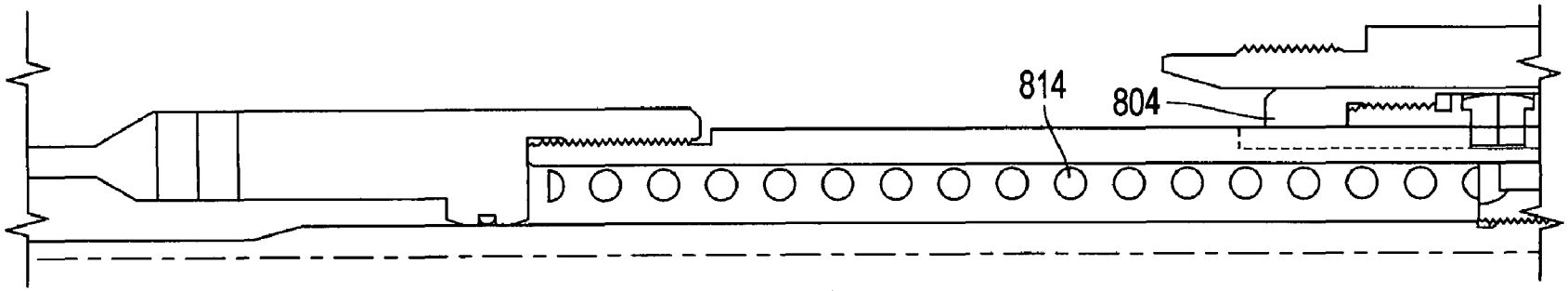
Figure 11B:
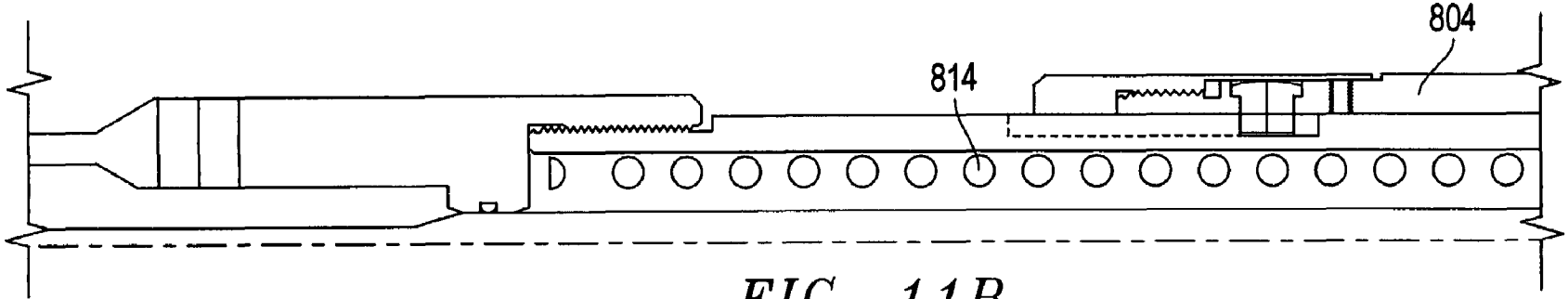

Referring now to FIGS. 9A–11B, side views of a ball holding service tool 800 are shown. In FIGS. 9A–9B, the ball holding service tool 800 is shown in a run-in position with a ball 808 retained. In FIGS. 10A–10B, the ball holding service tool 800 is shown in a manipulation position with the ball 808 retained. In FIGS. 11A–11B, the ball holding service tool 800 is shown in a release position with the ball 808 being ejected from the tool.

The ball holding service tool 800 comprises basic components including a support string 802, a lock sleeve 804, a plunger 806, and a drop ball 808. The inside section 802 does not move. As shown in FIGS. 10A–10B, the lock sleeve 804 is held in a fixed, run-in, position relative to the support string 802 by a shear pin 810. Further, the drop ball 808 is retained in the ball holding service tool 800 by lock dogs 812. In the run-in position, the lock dogs 812 are held in a radial inward position by the lock sleeve 804, so that the lock dogs 812 protrude into the interior of the support string 802 to support the drop ball 808. The drop ball is held firmly against the lock dogs 812 by the plunger 806, which is biased in the direction of the drop ball by a spring 814.

Mandrel lock dogs 805 are mounted on the lock sleeve. The mandrel lock dogs 805 have a locking pin 807 which projects inward. When the lock sleeve 804 is in a close fitting bore (see FIG. 10A), the mandrel lock dogs 805 are pushed inward which pushes the locking pins 807 into one of grooves 809, 811, or 813 on the support string 802. When the locking pins 807 are in any one of the three grooves 809, 811, or 813 on the support string 802, no relative movement is possible between the support string 802 and the lock sleeve 804.

As shown in FIGS. 10A–10B, the ball holding service tool 800 is manipulated by sliding the lock sleeve 804 relative to the support string 802. Of course, the shear pin 810 must be sheared to release the lock sleeve 804. In the position shown, the lock sleeve 804 has moved relative to the support string 802, but it has not moved a sufficient distance to release the lock dogs 812. The lock sleeve 804 has an annular recess groove 816 with beveled shoulders.

Figure 9C:
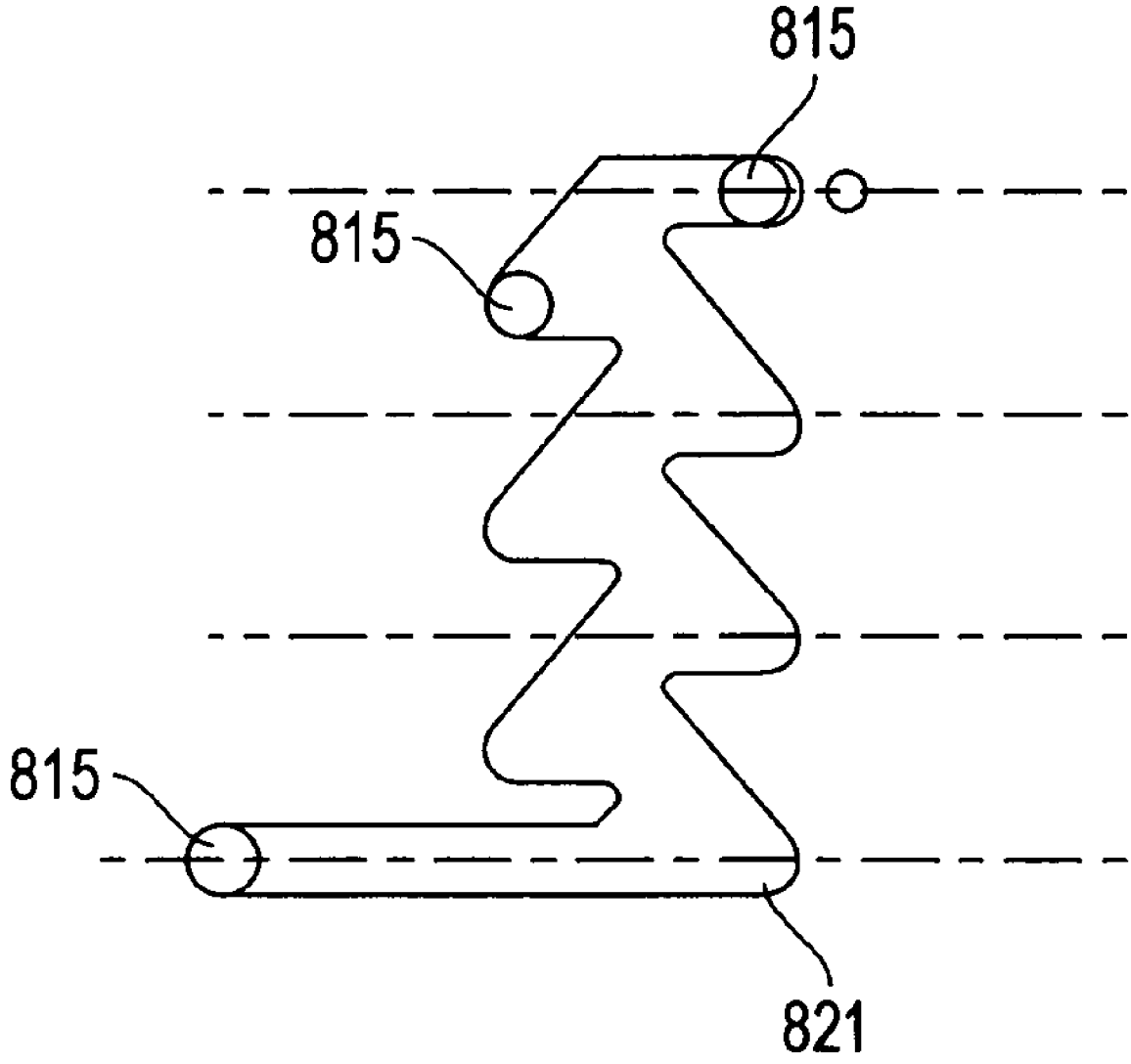
FIG. 9C shows a laid-out side view of a groove and a pin of the ball holding service tool shown in FIGS. 9A–9B, wherein the pin is shown in three separate positions within the groove.
Figure 12A:
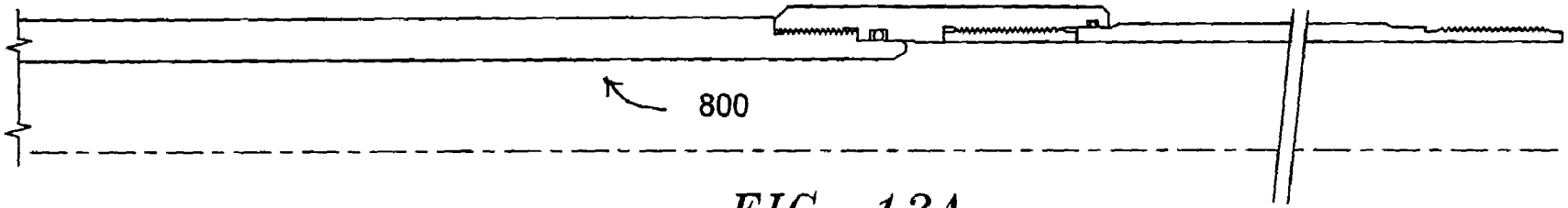
FIGS. 12A–12E illustrate cross-sectional side views of a ball holding service tool shown with a cross over tool and packer, wherein the service tool is in a run in configuration.
Figure 13A:
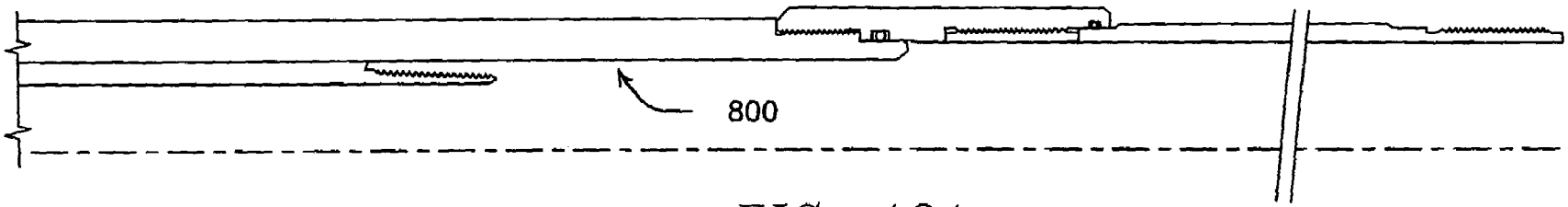
FIGS. 13A–13E illustrate cross-sectional side views of the ball holding service tool of FIGS. 12A–12E, wherein the service tool is in a dog retainer ring shear configuration.
Figure 12B:
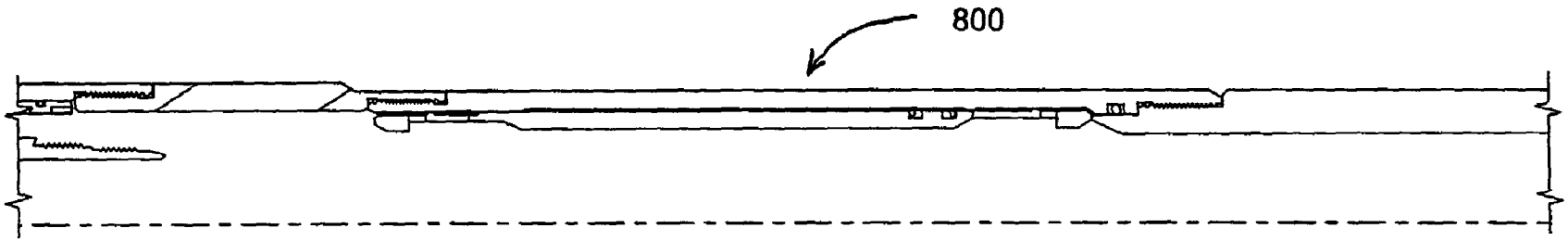
Figure 13B:
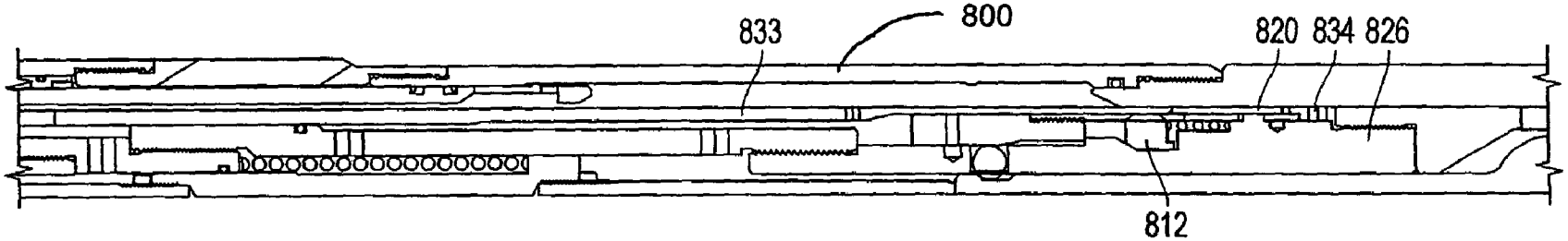
Figure 12C:
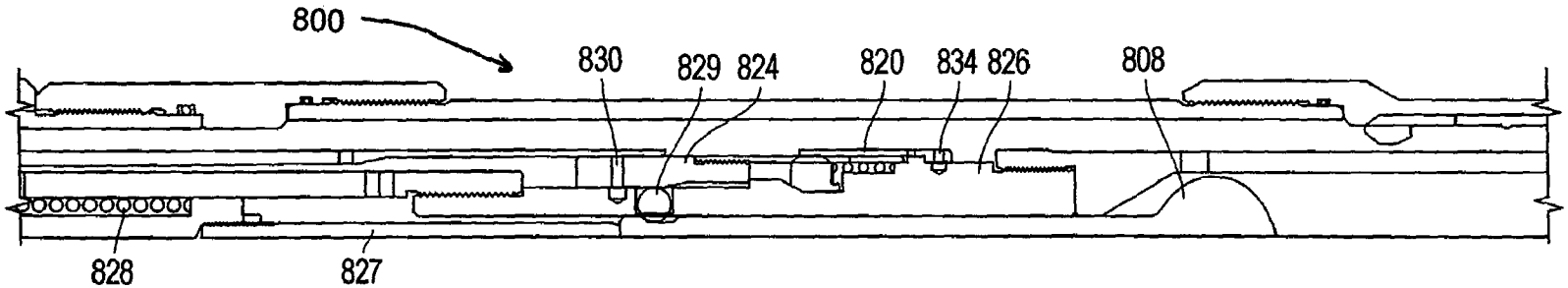
Figure 13C:
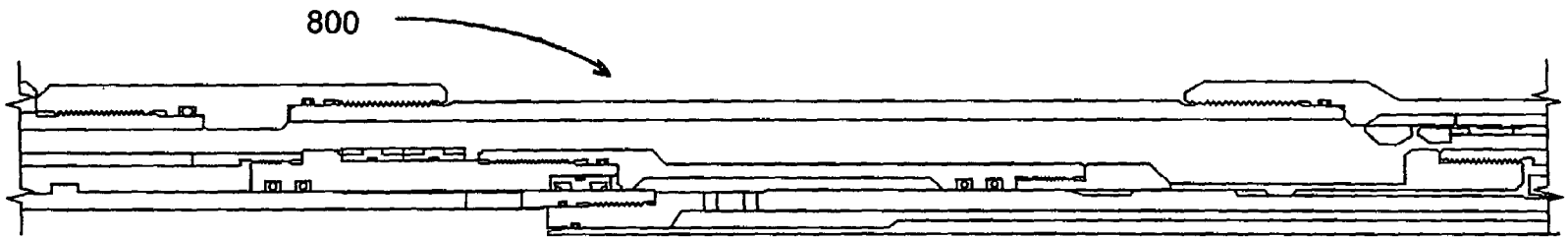

The lock sleeve 804 is additionally controlled by pin 815 which extends into groove 821 in support string 802. A laid-out side view of groove 821 is shown in FIG. 9C, wherein the pin 815 is shown in three separate positions within groove 821. Groove 821 in support string 802 is configured so that the lock sleeve 804 must be reciprocated one or more times before the lock sleeve 804 can move far enough to align recess groove 816 with lock dogs 812.

As shown in FIGS. 11A–11B, when the recess groove 816 becomes aligned with the lock dogs 812, the lock dogs 812 are free to move radially outward. With the lock dogs 812 no longer constrained, the spring-loaded plunger 806 pushes the drop ball 808 through the lock dogs 812 so as to eject the drop ball 808 from the ball holding service tool 800.

Referring now to FIGS. 12A–16E, side views of a second embodiment of a ball holding service tool 800 are shown with a cross over tool and packer. In FIGS. 12A–12E, the ball holding service tool 800 is shown in a run-in position with a drop ball 808 retained. In FIGS. 13A–13E, the ball holding service tool 800 is shown in a manipulation position with a dog retainer ring 820 sheared. In FIGS. 14A–14E, the ball holding service tool 800 is shown in a lock dog 812 release position. In FIGS. 15A–15E, the ball holding service tool 800 is shown in a ball retainer ring 824 shear position. In FIGS. 16A–16E, the ball holding service tool 800 is shown in a drop ball 808 release position.

In the run in configuration as shown in FIGS. 12A–12E, the drop ball 808 is secured firmly in the ball holding services tool 800. The drop ball 808 is a ball with a long tail, wherein the tail is secured by the service tool. The ball holding service tool 800 has a holding barrel 826 into which the tail of the drop ball 808 is inserted. The service tool also has an ejector mandrel 827 which is spring loaded. In particular, the ejector mandrel 827 is biased toward the drop ball 808 by spring 828. The drop ball 808 is held in its loaded position against the spring force by a plurality of balls 829. The drop ball 808 has a groove in its tail, wherein the balls 829 extend into the groove to hold the drop ball 808 in the holding barrel 826. The balls 829 are pushed into the groove of the drop ball 808 by a ball retainer ring 824. The ball retainer ring 824 is secured to the holding barrel 826 by shear screws 830. The ball holding service tool 800 also has a collet 831 which is squeezed into the crossover tool and packer. Because the collet 831 is made of flexible members, its outside diameter gets smaller as it is squeezed into the crossover tool and packer.

Figure 14A:
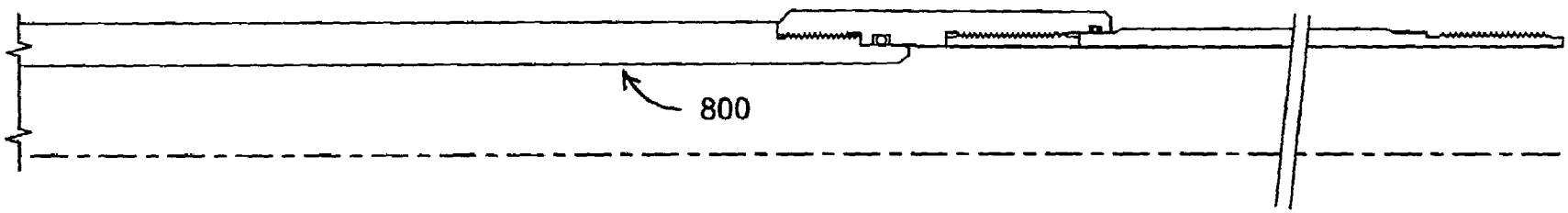
FIGS. 14A–14E illustrate cross-sectional side views of the ball holding service tool of FIGS. 12A–12E, wherein the service tool is in a dog release configuration.
Figure 14B:
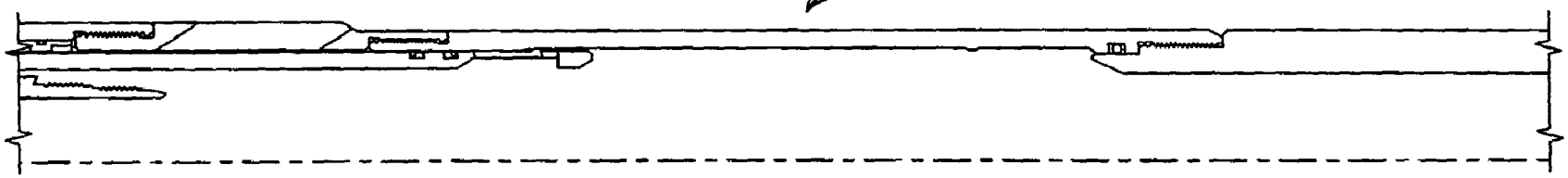
Figure 14C:
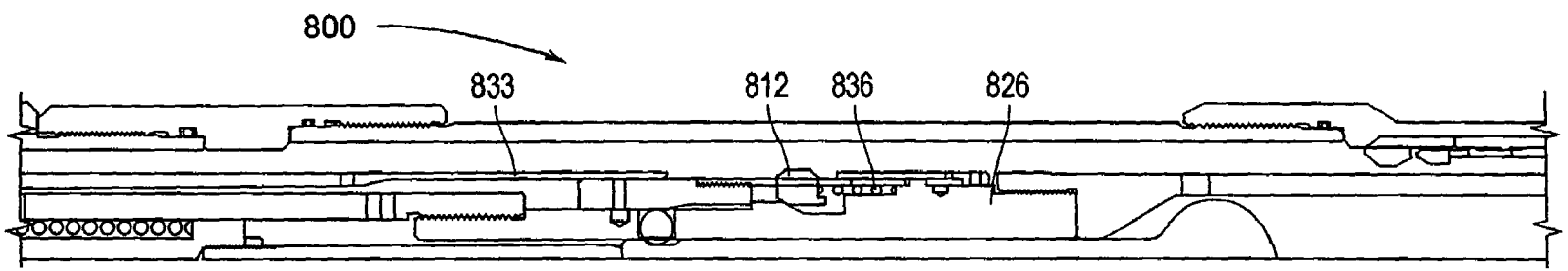
Figure 12D:
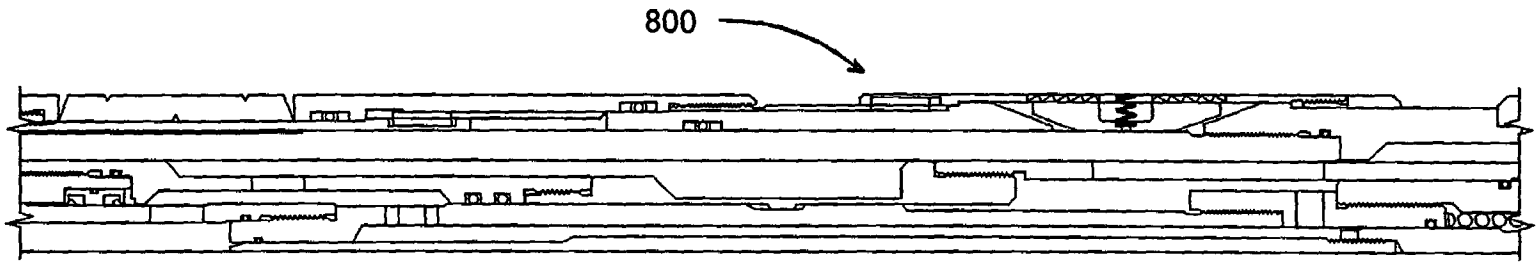
Figure 13D:
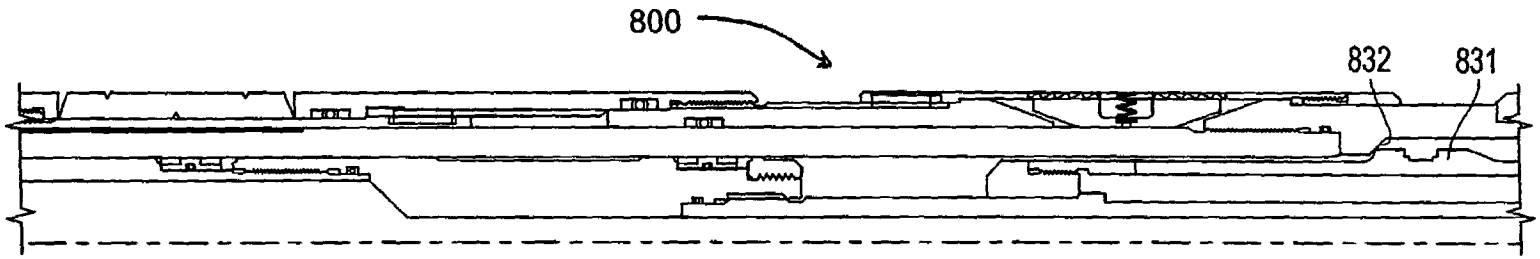
Figure 14D:
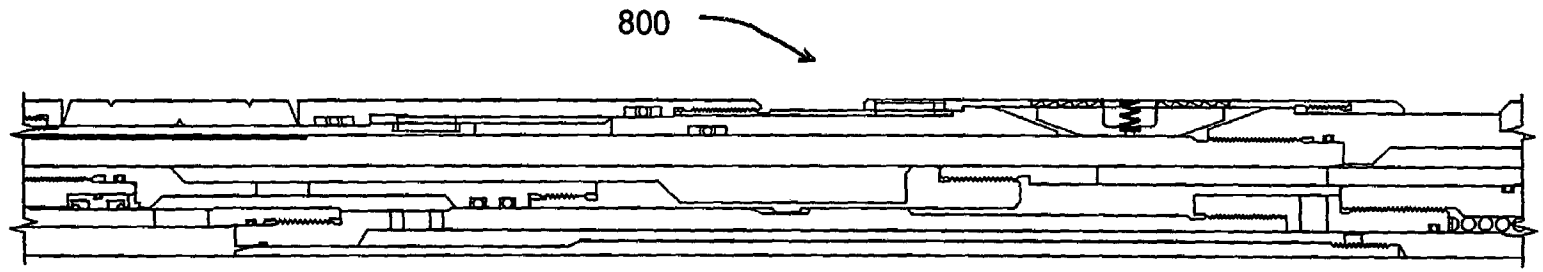
Figure 12E:
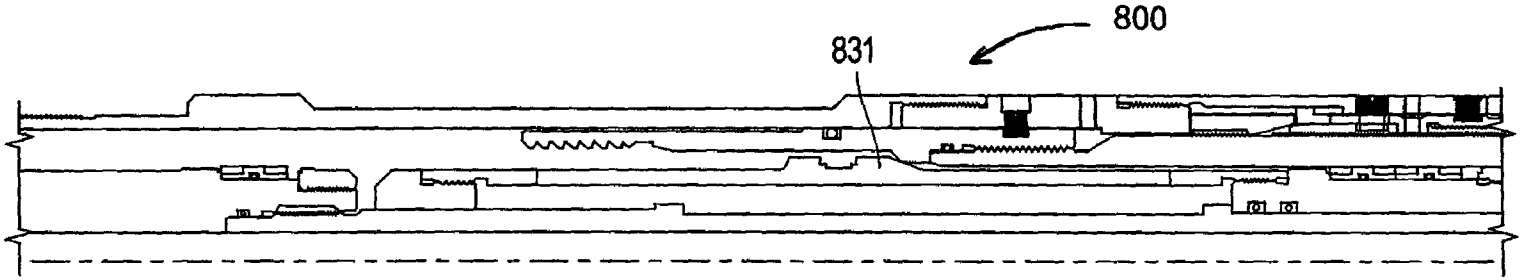
Figure 13E:
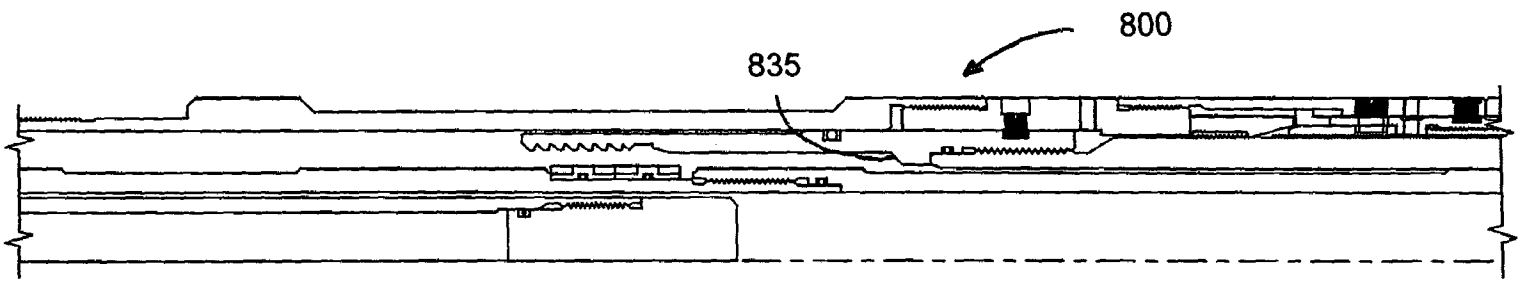
Figure 14E:
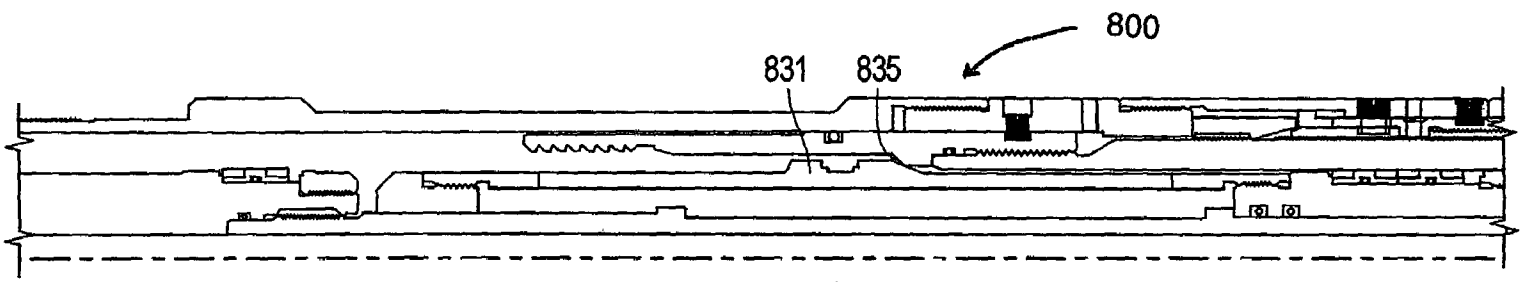
Figure 16A:
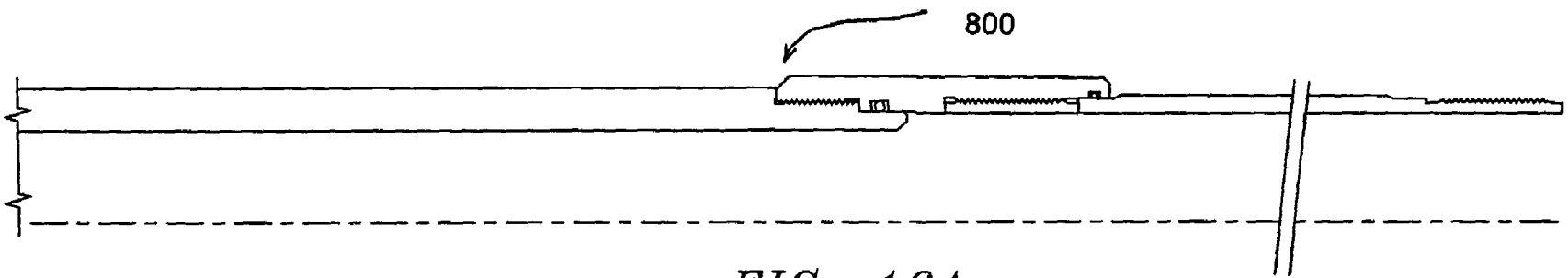
FIGS. 16A–16E illustrate cross-sectional side views of the ball holding service tool of FIGS. 12A–12E, wherein the service tool is in a drop ball release configuration.
Figure 16B:
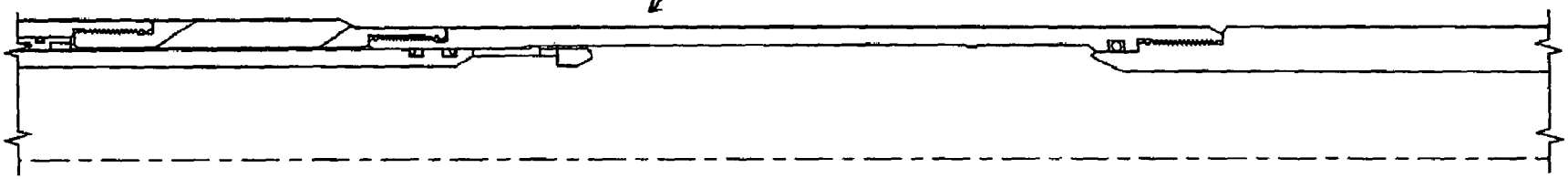
Figure 16C:
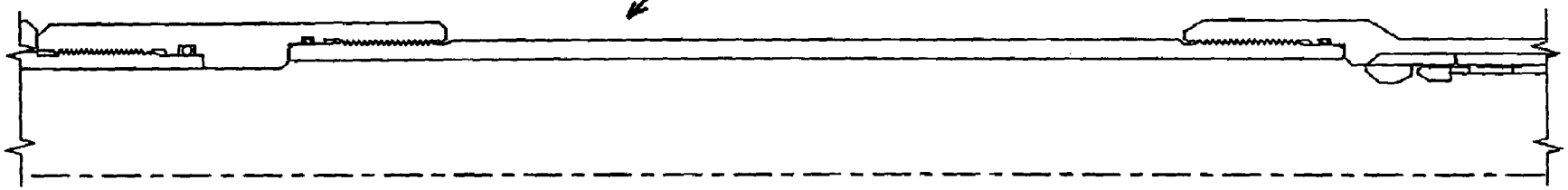
Figure 16D:
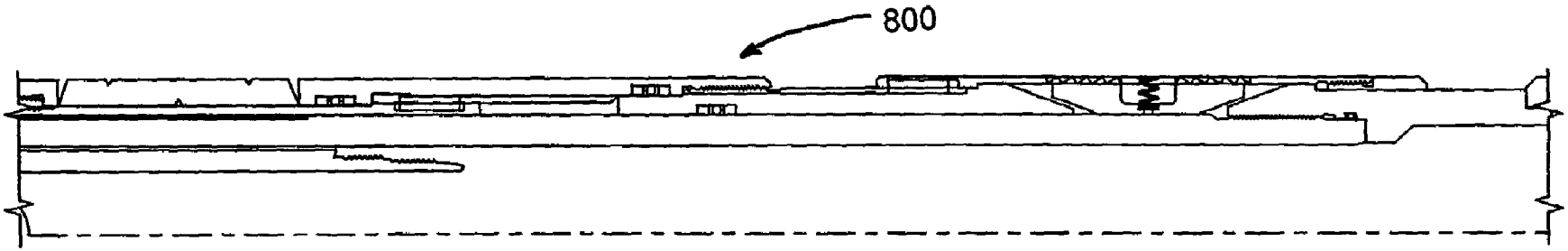

From the configuration shown in FIGS. 13A–13E, the ball holding service tool 800 is pulled further uphole to the position shown in FIGS. 14A–14E. In particular, the ball holding service tool 800 is brought to a position wherein the collet 831 is just above a shoulder 835 of the crossover tool and packer. As the ball holding service tool 800 is again run into the crossover tool and packer, the collet 831 remains stationery against the shoulder 835 so that the push ring 833 remains stationary relative to the downwardly moving holding barrel 826. As shown in FIG. 14C, this relative movement moves the lock dogs 812 out from under the push ring 833. The lock dogs 812 are biased in an uphole direction by a spring 836 such that upon being released by the push ring 833, the lock dogs 812 pop out of the groove in the holding barrel 826.

From the configuration shown in FIGS. 13A–13E, the ball holding service tool 800 is pulled further uphole to the position shown in FIGS. 14A–14E. In particular, the ball holding service tool 800 is brought to a position wherein the collet 831 is just above a shoulder 835 of the crossover tool and packer. As the ball holding service tool 800 is again run into the crossover tool and packer, the collet 831 remains stationery against the shoulder 835 so that the push ring 833 remains stationary relative to the downwardly moving holding barrel 826. As shown in FIG. 14C, this relative movement moves the lock dogs 812 out from under the push ring 833. The lock dogs 812 are biased in an uphole direction by a spring 836 such that upon being released by the push ring 833, the lock dogs 812 pop out of the groove in the holding mandrel 826.

Figure 15A:
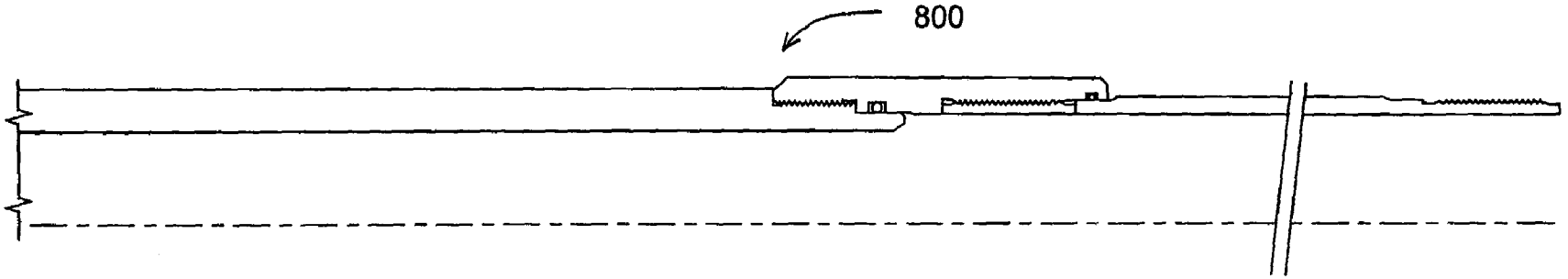
FIGS. 15A–15E illustrate cross-sectional side views of the ball holding service tool of FIGS. 12A–12E, wherein the service tool is in a ball retainer ring shear configuration.
Figure 15B:
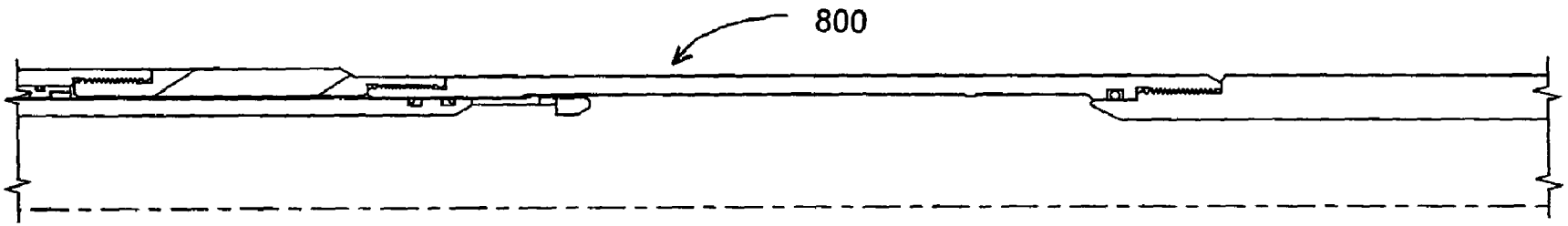
Figure 15C:
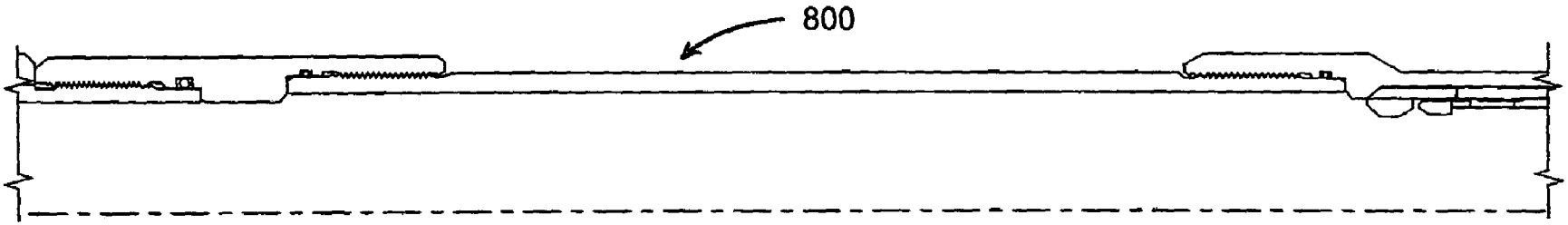
Figure 15D:
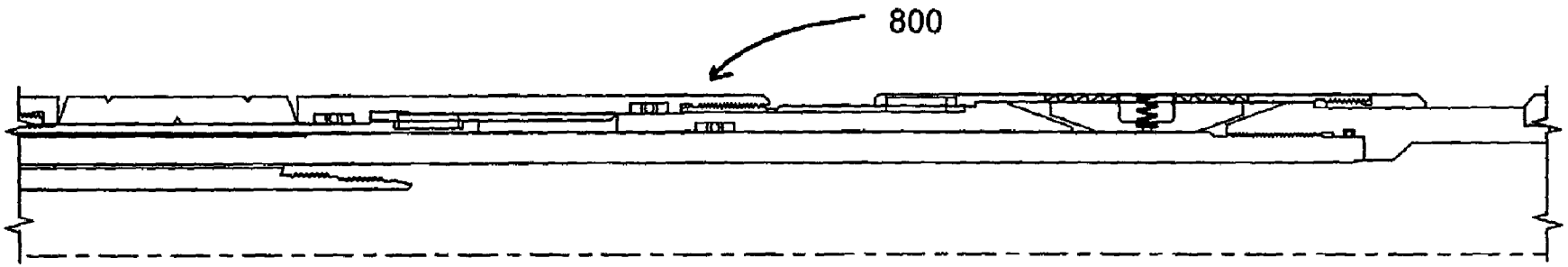
Figure 15E:
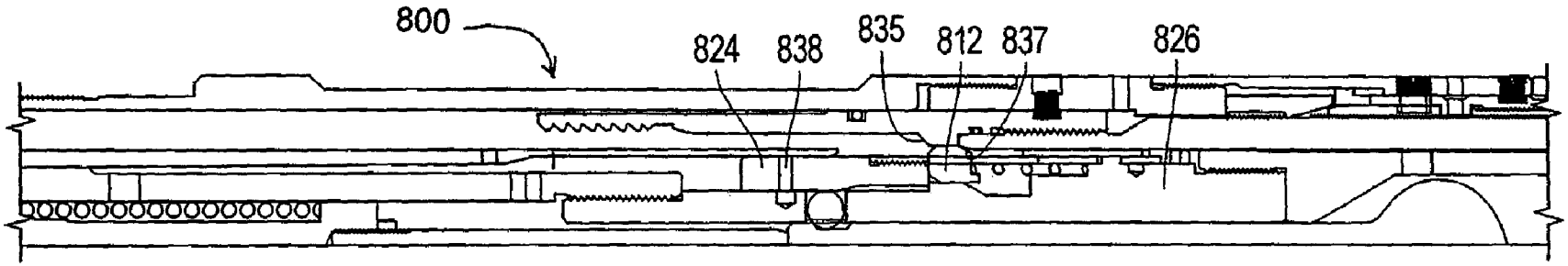

Once the lock dogs 812 are released, the ball holding service tool 800 is pulled uphole until the lock dogs 812 are above the shoulder 835 of the crossover tool and packer. The ball holding service tool 800 is then run downhole into the crossover tool and packer, to the position shown in FIGS. 15A–15E. In this position, the lock dogs 812 engage a smaller shoulder 837 of the crossover tool and packer. This smaller shoulder 837 holds the lock dogs 812 stationery while the crossover tool continues downhole. The lock dogs 812 work against the ball retaining ring 824 as shown in FIG. 15E. Shear screws 838 extend from the ball retaining ring 824 into the holding barrel 826. As the holding barrel 826 continues downhole, so that the shear screws 838 are eventually sheared.

The mandrel 826 continues to move downhole to a position shown in FIGS. 16A–16E. In this position, the ball retainer ring 824 is moved relative to the holding barrel 826 such that a portion of the ball retainer ring 824 having a relatively larger inside diameter is positioned over the balls 829. Further, the lock dogs 812 position themselves radially inward behind a shoulder 839 to retain the ball retaining ring 824 in its new position. In this configuration, the balls 829 are free to move radially outward so that they are no longer in the groove of the tail section of the drop ball 808. The energy stored in the spring 828 is then released to drive the ejector mandrel 827 into the holding barrel 826 to expel the drop ball 808 from the end of the holding barrel 826 (see FIG. 16E).

Figure 16E:
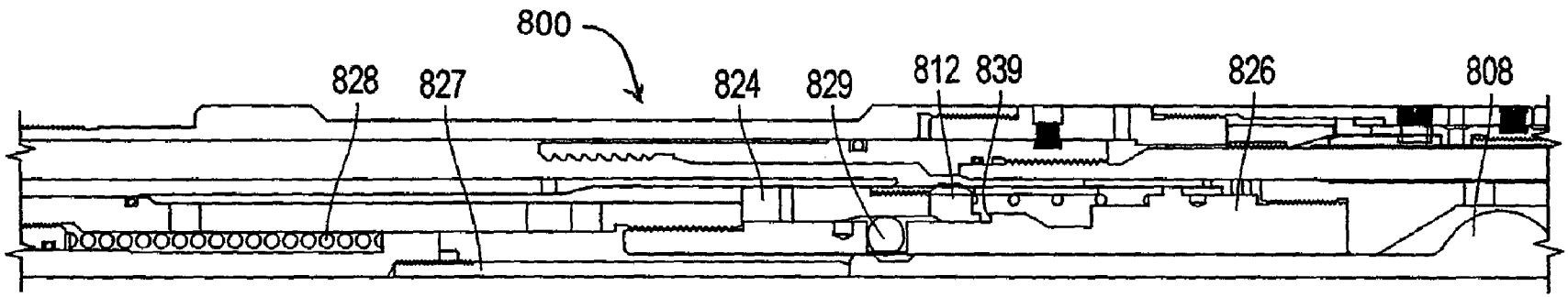
Figure 16F:
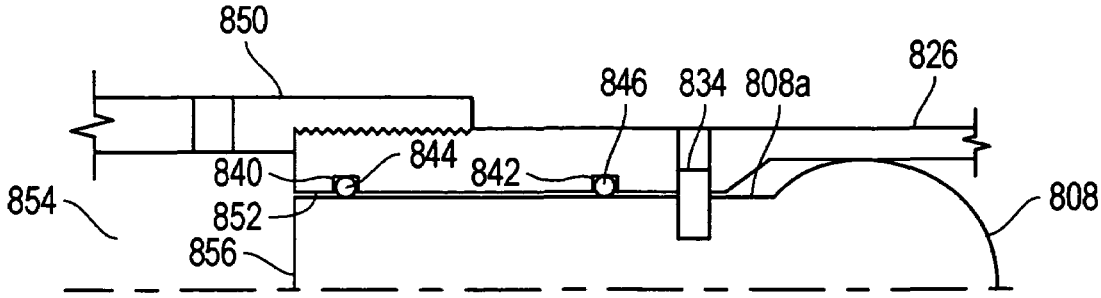
FIGS. 16F–16I illustrate cross-sectional views of another embodiment of an object holding service tool.
Figure 16G:
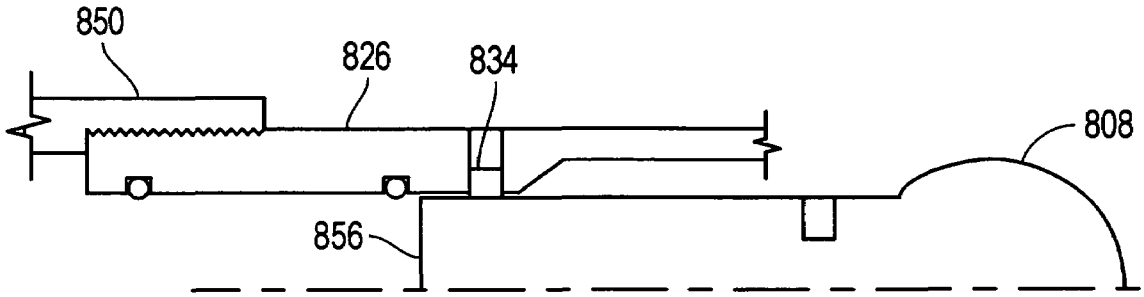
Figure 16H:
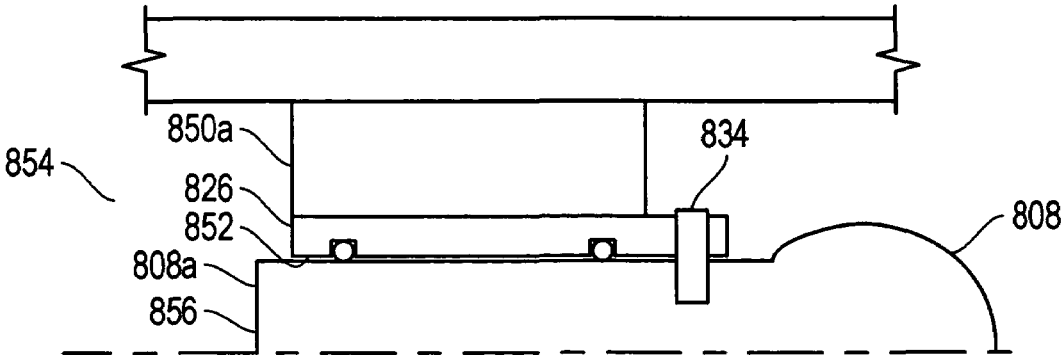
Figure 16I:
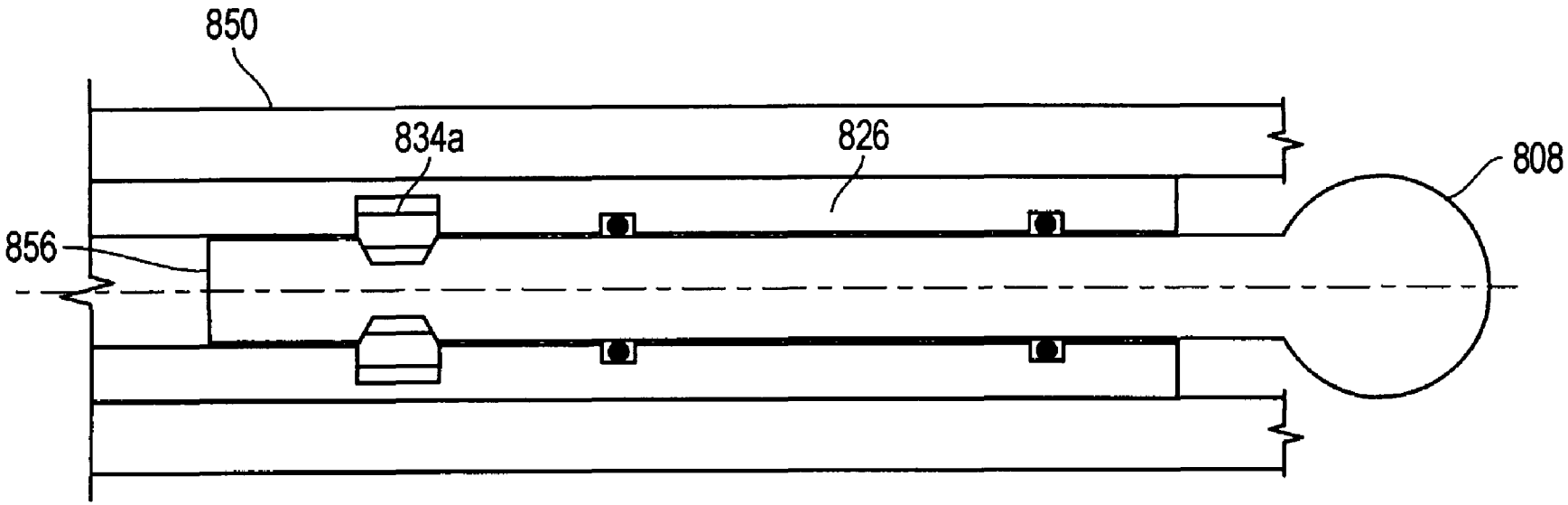

FIGS. 16F–16H are schematic cross-sectional views of another embodiment of an object holding service tool that incorporates features of the previous ball holding embodiments. The object holding service tool holds and releases the ball to manipulate one or more of valves, nominated herein as an object activated valve (OAV). Such valves include, for example, the IFV described in reference to FIGS. 18A–20C. Other valves that can be actuated by a "dropped" object in a well bore, whether pressurized by fluid or not, are known those with ordinary skill in the art and are included herein.

FIG. 16F illustrates this embodiment in a closed position with drop ball sealing a flow path in the tool. FIG. 16G illustrates the embodiment of FIG. 16F in a released condition with flow path open. The embodiment can be used advantageously in conjunction with the OAVs in the various well bore procedures and operations, and related systems and methods, described herein. The object holding service tool can be coupled to the various systems and other tools either temporarily or in relative permanence to remain in the wellbore. The term "coupled," "coupling", and like terms are used broadly herein and can include any method or device for securing, binding, bonding, fastening, attaching, joining, inserting therein, forming thereon or therein, communicating, or otherwise associating, a functional member with another, directly or indirectly through intervening members. Further, a given system can include more than one or more object holding service tools as may be desired to activate one or more valves.

In FIG. 16F, an object holding service tool can be used to retain the drop ball. The tool can be included with a crossover tool, such as shown in FIGS. 12A–16E; wireline and coiled tubing tools; downhole plugs, more particularly shown in FIG. 16H; mechanical sleeves that can be used to manually actuate the release of the drop ball, or other tools that can temporarily retain a drop ball.

The object holding service tool 850 generally includes a holding barrel 826. The holding barrel 826 can be engaged with the tool, formed integrally therewith, or otherwise coupled to the tool. The holding barrel 826 includes an internal bore 852 that can be slidably and sealingly engaged with the drop ball 808. However, in this embodiment, the drop ball 808 is releasably engaged with the holding barrel 826 by one or more shear screws 834, such as shown in FIGS. 16F–16H, one or more split rings 834*a*, such as shown in FIG. 161, or other restraining devices. Further, the holding barrel 826 includes one or more seal grooves 840, 842. One or more corresponding seals 844, 846 disposed in the seal grooves 840, 842 act to sealingly engage the drop ball 808, such as in a tail section 808*a*, with the holding barrel 826. Alternatively, the grooves could be formed in the drop ball 808. Further, the holding barrel can remain fixedly position relative to other parts of the object holding service tool 850 or move relative to the tool for other purposes. The release of the drop ball is generally independent of the position of the holding barrel 826 relative to other portions of the tool in this embodiment. Further, object holding service tool and the releasable drop ball can restrict bidirectional flow upstream and downstream in contrast to some flow restrictions in the field.

The drop ball 808 can be inserted into the holding barrel 826 of the object holding service tool 850 in an initial "run in" condition. The flow path 854 through the central bore of the tool is restricted by the drop ball 808. Various operations can be performed using the tools and procedures described herein. When a portion of the operations uses the central flow path 854 and the drop ball 808 is to be released, the central flow path is pressurized to a pressure that creates a force on an area 856 or other areas of the drop ball sufficient to shear or otherwise cause the one or more restraining devices restraining the drop ball to release the drop ball. The drop ball 808 is released and is forced to another location, generally downstream, by the pressure. The drop ball can engage an OAV described herein to close, open, or otherwise affect the valve.

The object holding service tool 850 can include a tool, such as a plug, that can temporarily hold a drop ball, such as shown in FIG. 16H and described above. The plug can comprise a packer plug, such as an equalizing packer plug having single or dual valves for equalizing, the basis of which are known in the art. The tool can include the holding barrel 826 separate or formed integrally therewith. In some embodiments, the holding barrel 826 can be a portion of the material forming the plug with the internal bore 852 formed therein.

The plug can be placed in position at a selected location such as an internal bore of a packer. At an appropriate time, the central flow path 854 can be pressurized to exert pressure on the drop ball 808 and force the drop ball out of the sealed engagement with the internal bore 852. The drop ball can then be used to engage an OAV.

Figure 16J:
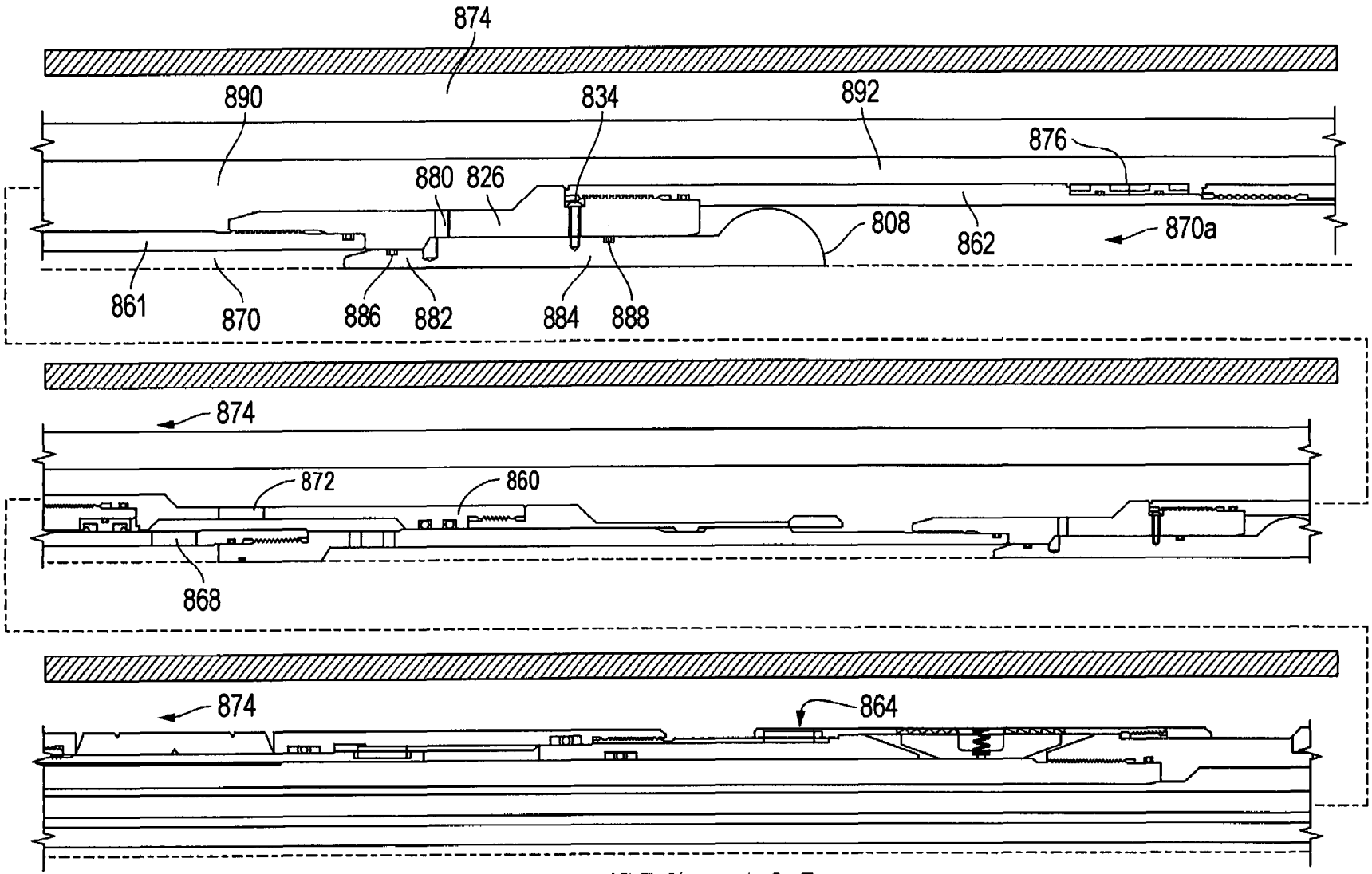
FIG. 16J illustrates a cross sectional view of a drop ball and a holding barrel in an alternative embodiment during a fracturing operation.

FIG. 16J illustrates a cross sectional view of a drop ball 808 and a holding barrel 826 in an alternative embodiment during a fracturing operation. A circulating valve 860 is coupled to the holding barrel 826 on one end of the holding barrel and a seal spacer 862 is coupled to the holding barrel on the other end. An assembly, such as a packer 864, is generally disposed external to the holding barrel 826 and seal spacer 862 at different stages of the operation. The packer includes a seal bore 866 that acts as a sealing surface to various assemblies that are manipulated in the well at different stages of operations. The circulating valve 860 includes a port 868 that allows fluid, such as fracturing carrier fluid, to flow from the flow path 892 out through a circulating port 872 into the annulus 874 above the packer.

The seal spacer 862 includes a seal 876. The seal 876 allows sealing of the holding barrel and related assemblies at different states of operation. When sealed, fluid in an upstream portion of the well can build to a sufficient pressure to sever a shear screw holding the drop ball, as described below.

The drop ball 808 is coupled to the holding barrel 826 with a shear screw 834 or other restraining device. A port 880 is formed in the holding barrel to allow fluid communication between a flow path 890 and the outside surface of the drop ball 808. The drop ball can include at least two cross sectional areas, a small portion 882 and a large portion 884. A first seal 886 is disposed on the small portion 882 between the drop ball and the holding barrel and a second seal 888 is disposed on the large portion 884 in like fashion on the distal side of the shear screw 834 from the first seal.

In the fracturing operation, the crossover tool is positioned in the packer 864 so that seals (not shown) in the crossover tool seal in the seal bore 866 of the packer upstream of the circulating port 868. The circulating port is open and allows fluid to flow therethrough from the flow path 892 into the bore 870. The holding barrel 826 and seal spacer 862 are disposed below the seal bore 866 of the packer and does not effectuate a seal therewith. Thus, fracturing return fluid flows above the holding barrel 826 and seal 876 of the seal spacer in the flow path 892 and around to the downstream portion of the drop ball, so that the pressures upstream and downstream from the holding barrel and drop ball are balanced.

Pressure in the bore 870 upstream of the drop ball 808 is substantially equivalent to the pressure in the bore below the drop ball during the fracturing operation. Further, the drop ball 808 is restrained in position in the holding barrel 826 using the shear screw 834. Thus, the combination of the equivalent pressures and location of seals offers a safety feature to restrict inadvertent deployment of the drop ball caused by unequal pressures.

Figure 16K:
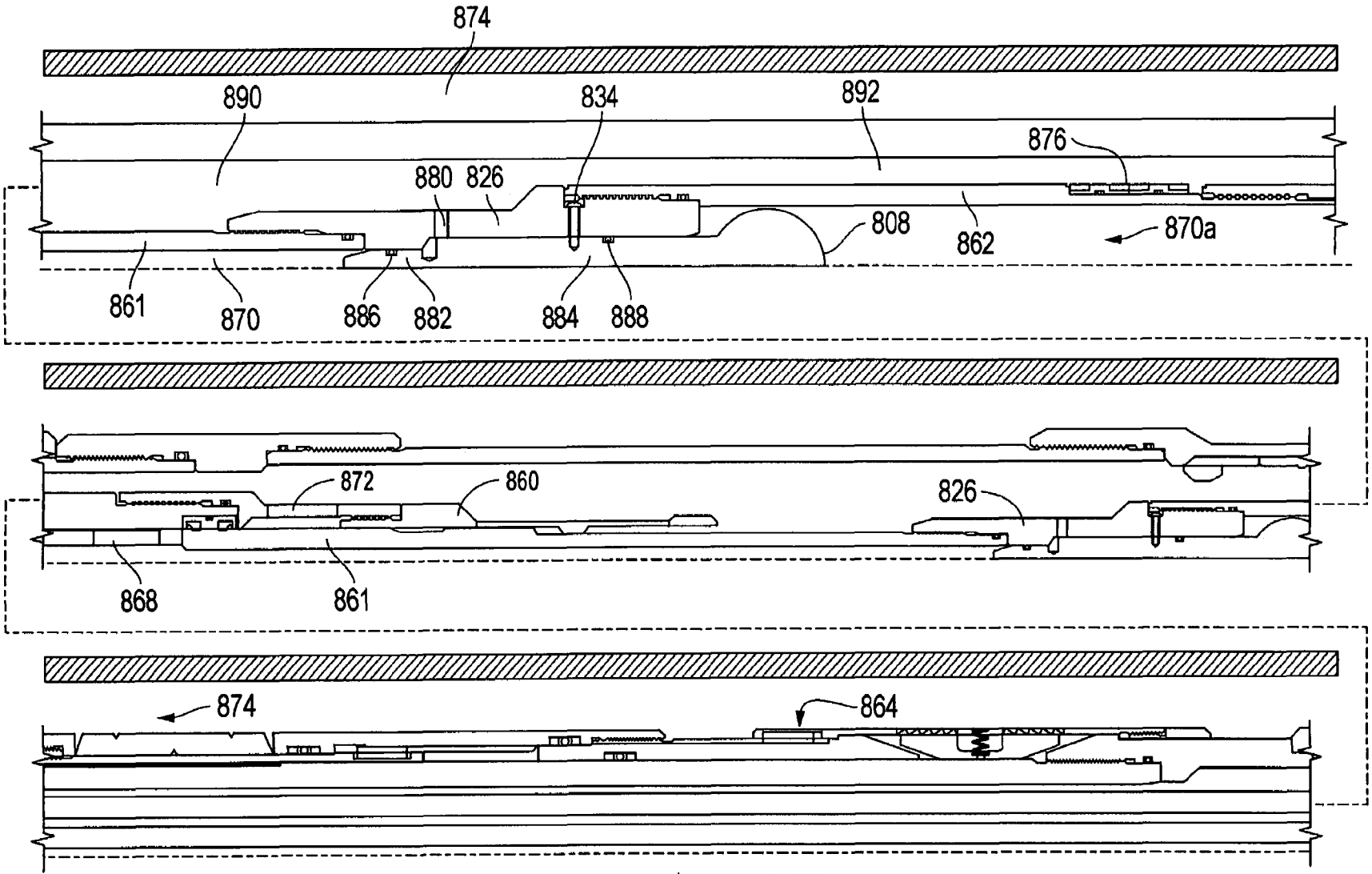
FIG. 16K illustrates the embodiment of FIG. 16J in a reversing stage of operations.

FIG. 16K illustrates the embodiment of FIG. 16J in a reversing stage of operations. Similar elements are similarly labeled. The reversing process is generally performed to flush out extraneous proppant left from the fracturing operation by reversing the flow path of fluid upstream of the formation. Generally, the crossover tool is pulled up in the well to disengage the packer seal bore 866 which closes the circulating valve 860 and fluid flows down the annulus 874, into the fracturing port (not shown), and upward through the tooling to the well surface. The seal 876 downstream of the holding barrel for the drop ball 808 is still positioned below the seal bore 866 of the packer 864. The pressure in the annulus 874 is isolated by seals or can be generally substantially equal to the pressure in the bore 870*a* downstream of the drop ball seal 888. Since seal 876 is not engaged in a seal bore, pressure is partially balanced around the drop ball 808. Thus, no pressure in the annulus 874 acts on the large portion 884 of the drop ball to cause the holding barrel 826 to release the drop ball. This aspect allows the drop ball to be controlled during the reversing process.

However, if an operator desired to cause the drop ball to release in the reversing stage, the operator could pressurize the bore to a pressure sufficient to exert a force upstream of the seal 886 on the small portion 882 of the drop ball that is exposed to the pressurized fluid. The pressure will be generally need to be higher with the small portion 882 compared to the large portion 884 of the drop ball 808. The force severs the shear screw 834 and the drop ball is released to a downstream location.

Figure 16L:
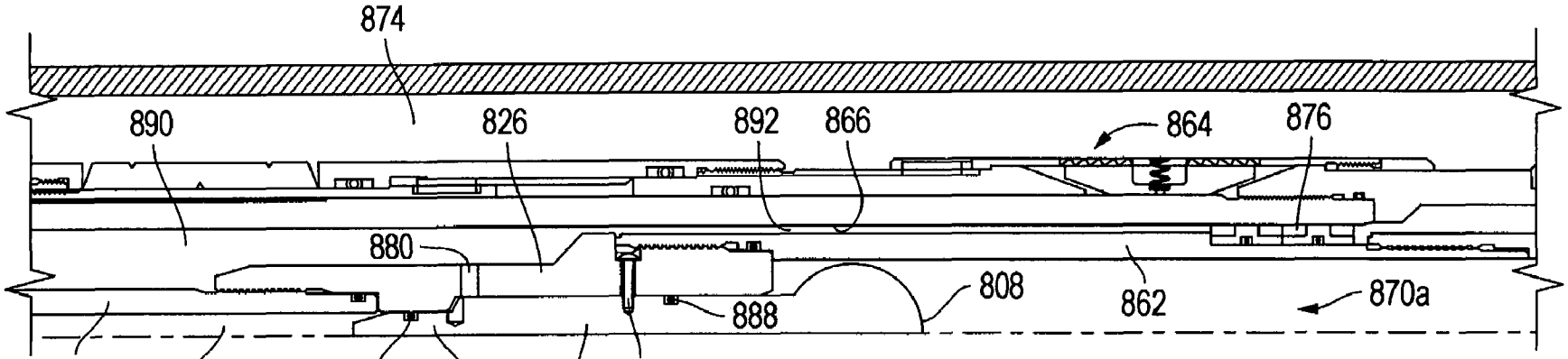
FIG. 16L illustrates a cross sectional schematic view of the embodiment of FIGS. 16J, 16K in a low pressure launch position.

FIG. 16L illustrates a cross sectional schematic view of the embodiment of FIGS. 16J, 16K in a low pressure launch position. Similar elements are similarly labeled. The holding barrel 826 can be moved toward the packer 864 relative to FIG. 16K, so that the seal 876 sealingly engages the seal bore 866. Fluid can flow in the bores 870, 870*a* and in various internal flow paths such as flow path 890 and 892 of the packer 864. The fluid is restricted from flowing past the seal 876 with the engagement of the seal bore 866 and can be pressurized upstream from the seal. The fluid external to the holding barrel 826 and internal to the seal bore 866 in the flow path 890 can enter port 880 and flow to the large portion 884 of the drop ball 808. The seal 888 downstream of port 880 restricts further fluid flow and allows the pressurized fluid to exert a force on the large portion 884. Also, pressure in the flow path 890 is free to enter the cross over tool into bore 870 and act on the seal 886 which assists the seal 888. Sufficient force severs the shear screw 834 and allows the holding barrel 826 to release the drop ball 808.

Another valve used in various embodiments of the present invention is the IFV. Three different embodiments of the IFV are illustrated herein.

Figure 17A:
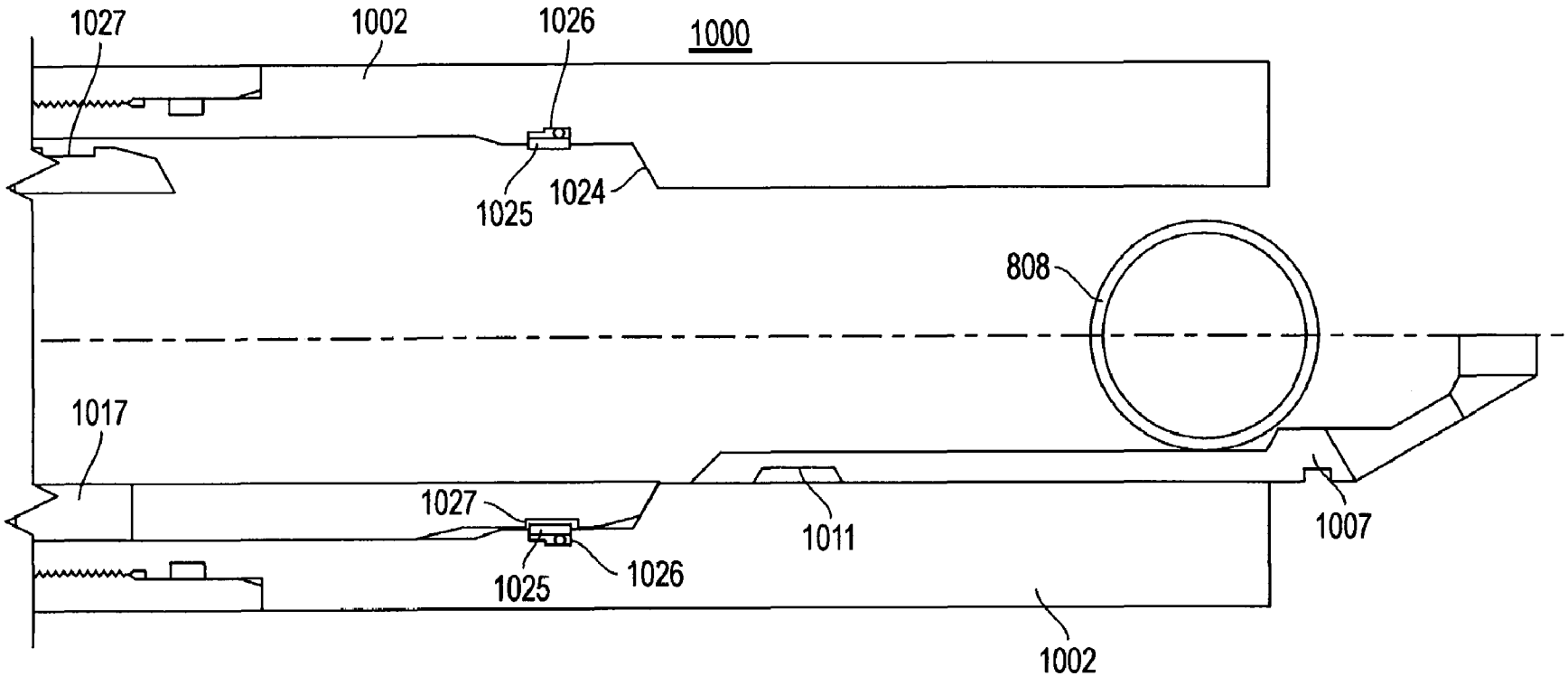
FIGS. 17A–17C illustrate cross-sectional side views of an IFV, wherein the valve above the midline is shown in an open configuration and the valve below the midline is shown in a closed configuration.
Figure 17B:
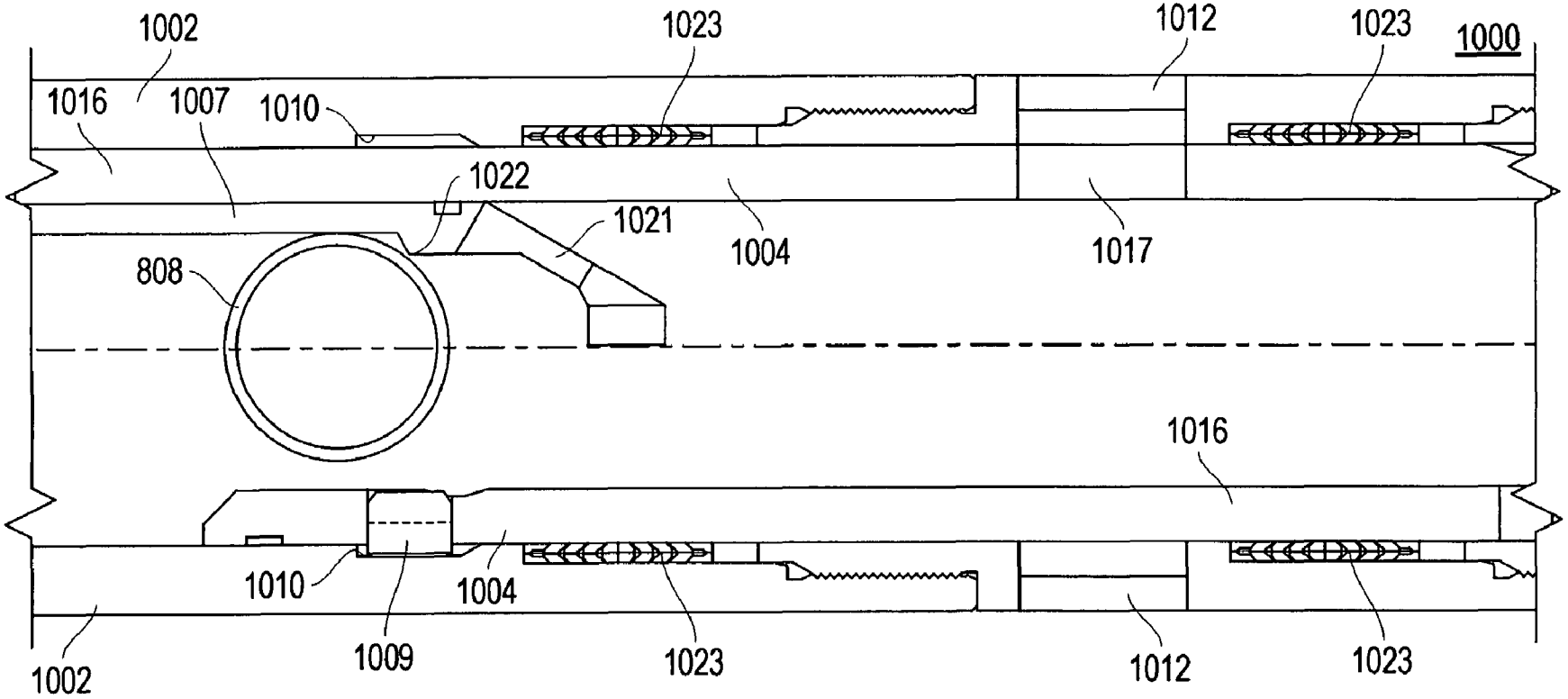
Figure 17C:
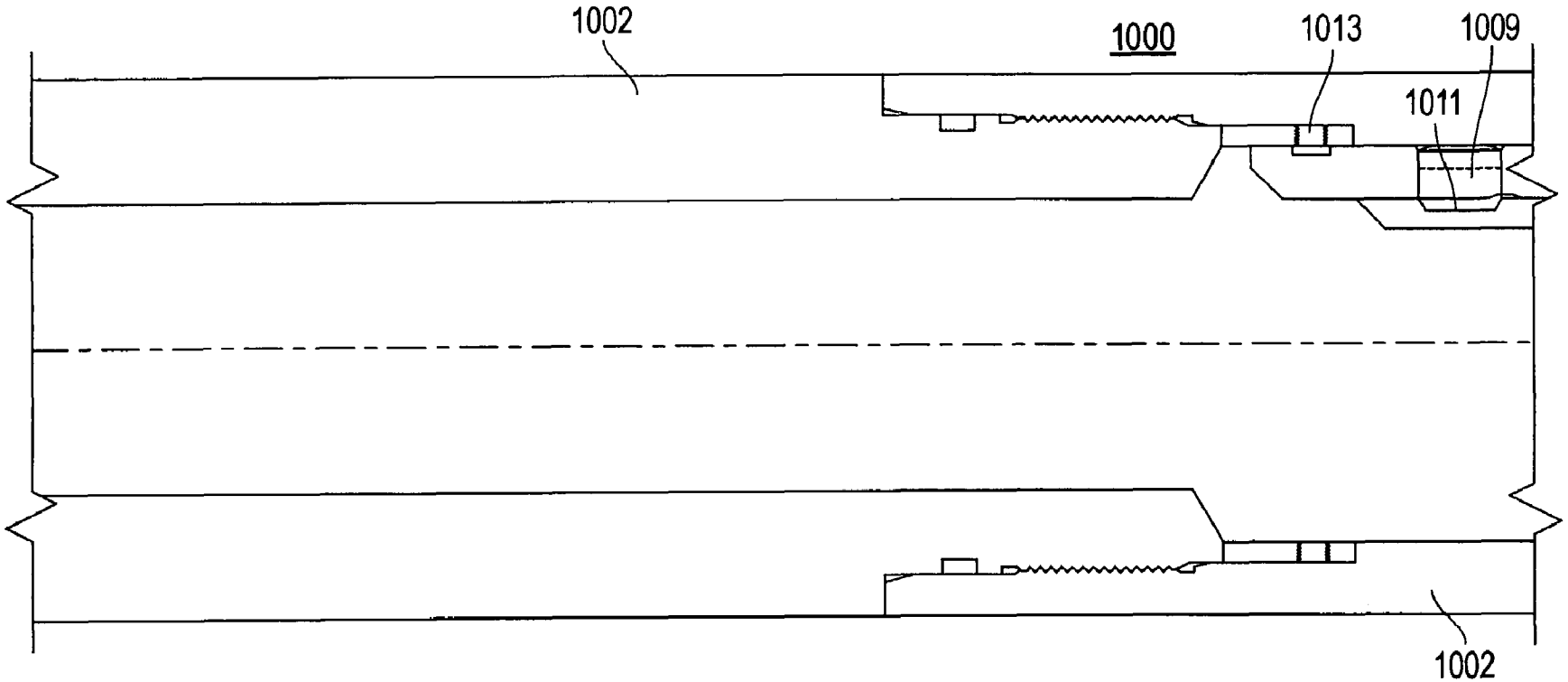

Referring to FIGS. 17A–17C, side views of a first embodiment of the IFV are shown, wherein the IFV 1000 is shown in two different configurations on each side of the center line. Above the center line, the valve is shown in an open configuration and below the line, the valve is shown in a closed configuration. The IFV 1000 comprises basic components including: a string 1002, a sliding sleeve 1004, and a basket 1007.

The string 1002 comprises several pipe sections made-up to form a single pipe string. The string 1002 also has a string port section 1012 which allows fluid to flow between the outside diameter and the inside diameter. The sliding sleeve 1004 is positioned concentrically within the string 1002. The sliding sleeve 1004 has seal section 1016 and a sleeve port section 1017. The basket 1007 has holes 1021 in its lower end to allow fluid to flow between the inside diameter of the sliding sleeve 1004 above the basket 1007 and the inside diameter of the sliding sleeve 1004 below the basket 1007. The basket 1007 also has a seat upon which a drop ball 808 may land.

In the open configuration (shown above the centerline), the sleeve port section 1017 is positioned adjacent the string port section 1012. The sliding sleeve 1004 is held in this position by shear screws 1013 which extend between the sliding sleeve 1004 and the string 1002. Also, in the open configuration of the IFV, the basket 1007 is held within the sliding sleeve 1004 by lock dogs 1009 which extend from the sliding sleeve 1004 into a retaining groove 1011 in the basket 1007. The lock dogs 1009 are held radially inward by the inside diameter of the string 1002.

The IFV 1000 is closed by dropping a drop ball 808 into the valve. The drop ball 808 lands on the seat 1022 in the basket 1007. The drop ball 808 mates with the seat 1022 to restrict fluid flow from the inside diameter above the valve, down through the basket 1007. As fluid pressure increases in the inside diameter above the drop ball 808, a downward force is exerted on the basket 1007. This downward force is transferred from the basket 1007 to the sliding sleeve 1004 through the lock dogs 1009. The downward force on the sliding sleeve 1004 becomes great enough to shear the shear screws 1013 to release the sliding sleeve 1004 from the string 1002. Upon shear of the shear screws 1013, the sliding sleeve 1004 and basket 1007 travel together down the string 1002 to close the valve. In particular, the seal section 1016 becomes positioned over the string port section 1012 to completely restrict the flow of fluid through the string port section 1012. Seals 1023 are located above and below the string port section 1012 to insure the integrity of the valve.

The sliding sleeve 1004 continues its downward movement until the lock dogs 1009 engage a release groove 1010 and the sliding sleeve 1004 bottoms out on shoulder 1024. The sliding sleeve 1004 is held in the closed position by a ring 1025 (see FIG. 17A) which is positioned within a groove 1026 in the string 1002. Because the leading end of the sliding sleeve 1004 is tapered to sting into the ring 1025. The sliding sleeve 1004 is pushed into the ring 1025 until the ring snaps into a groove 1027 in the sliding sleeve 1004. The ring 1025 is retained in both grooves 1026 and 1027 to prevent the sliding sleeve 1004 from moving back into the open position.

When the lock dogs 1009 engage the release groove 1010 of the string 1002, the lock dogs 1009 are released to move radially outward. The lock dogs 1009 move radially outward from a position protruding into the basket 1007, through the sliding sleeve 1004, and to a position protruding into the release groove 1010. This radial movement of the lock dogs 1009 releases the basket 1007 from the sliding sleeve 1004 to allow both the basket 1007 and drop ball 808 to fall freely out the bottom of the IFV.

Figure 18A:
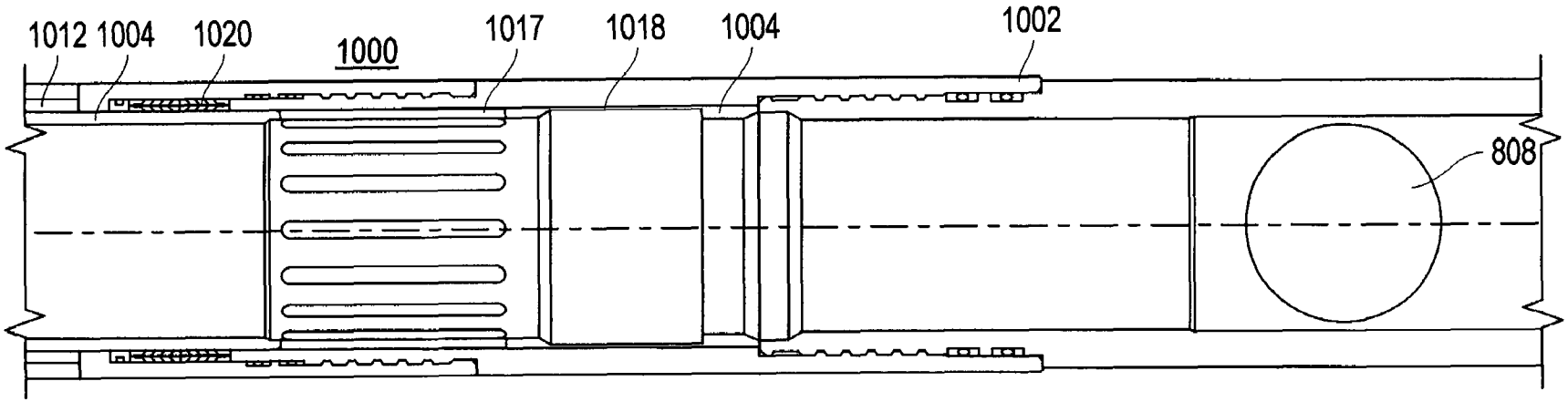
FIGS. 18A–18C illustrate cross-sectional side views of an IFV, wherein the valve is in a closed configuration.
Figure 19A:
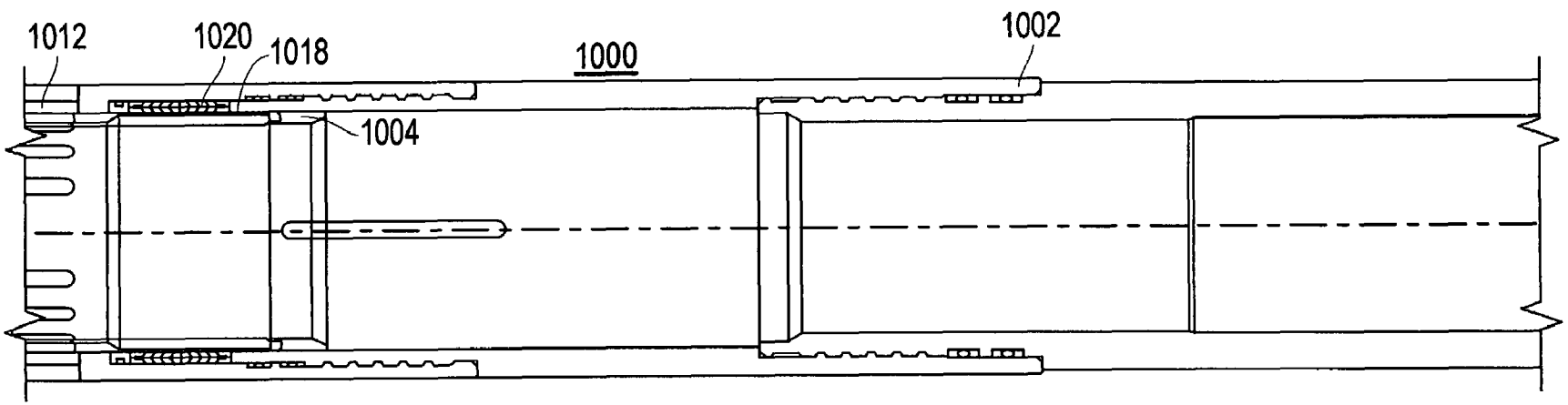
FIGS. 19A–19C illustrate cross-sectional side views of the IFV shown in FIGS. 18A–18C, wherein the valve is in an open configuration.
Figure 18B:
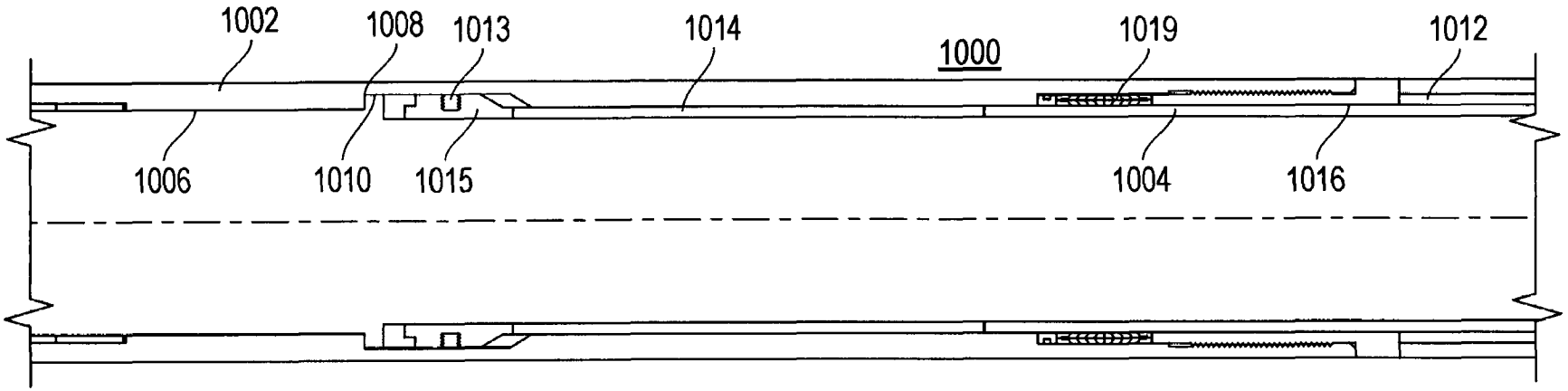
Figure 19B:
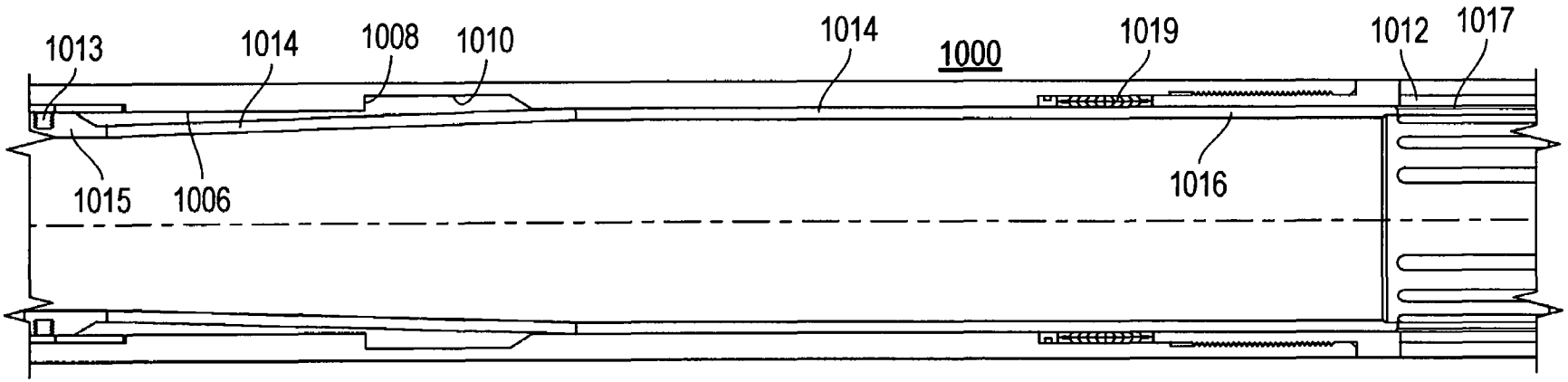
Figure 18C:
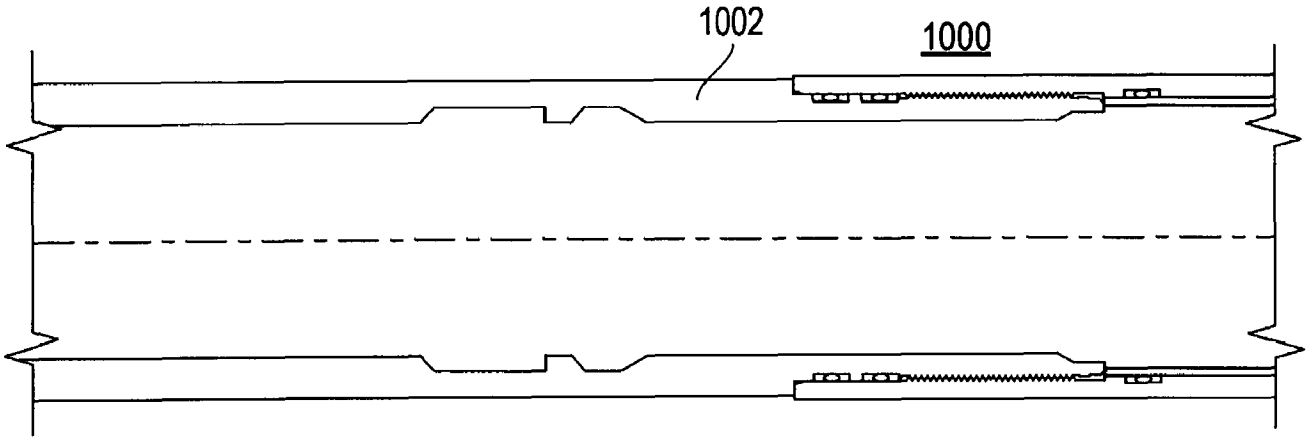
Figure 19C:
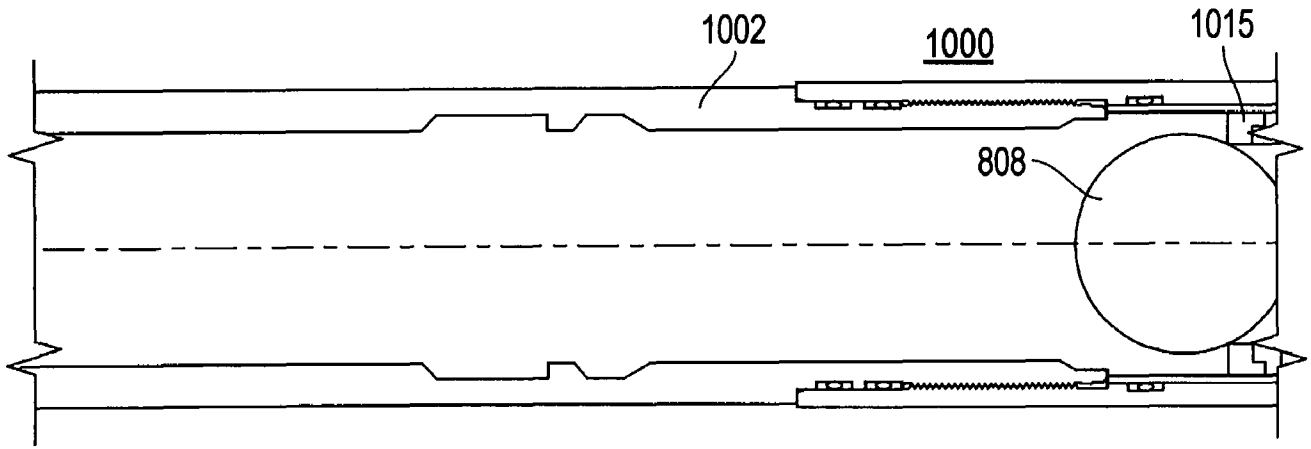

Referring to FIGS. 18A–19C, side views of a second embodiment of an IFV are shown, wherein the valve is in an open configuration in FIGS. 19A–19C and a closed configuration in FIGS. 18A–18C. The IFV 1000 comprises basic components including: a string 1002 and a sliding sleeve 1004. The string 1002 comprises several pipe sections made-up to form a single pipe string. The string 1002 has a slip bore 1006 immediately adjacent a release groove 1010, wherein the slip bore 1006 and the release groove 1010 are separated by a shoulder 1008. Thus, the internal radius of the slip bore 1006 is smaller than the internal radius of the release groove 1010 such that the difference is the height of the shoulder 1008. The string 1002 also has a string port section 1012 having a plurality of lengthwise ports evenly spaced around the string 1002.

The sliding sleeve 1004 of the IFV 1000 is positioned coaxially within the string 1002. The sliding sleeve 1004 is basically comprised of a plurality of cantilever fingers 1014, a middle seal section 1016, a sleeve port section 1017, and an end seal section 1018. The cantilever fingers 1014 extend from one end of the middle seal section 1016 and are evenly spaced from each other. Each cantilever finger 1014 has a spreader tip 1015 at its distal end. In the open configuration, shown in FIGS. 19A–19C, the spreader tips 1015 rest on the slip bore 1006 of the string 1002, and in the closed position, the spreader tips 1015 rest in the release groove 1010 of the string 1002. When the spreader tips 1015 rest on the slip bore 1006, the spreader tips define a relatively smaller diameter sufficient to form a seat for catching a drop ball 808. The middle seal section 1016 has a cylindrical outer surface for mating with annular seals 1019 and 1020, which are fixed to the string 1002 above and below the string port section 1012, respectively. In the open position, the middle seal section 1016 mates only with the annular seal 1019, but in the closed position, the middle seal section 1016 mates with both annular seal 1019 and 1020. Further, in the closed position, the middle seal section 1016 spans the string port section 1012 (see FIGS. 18A and 18B). The sleeve port section 1017 has a plurality of lengthwise ports evenly spaced around the sliding sleeve 1004. When the IFV 1000 is in an open configuration, the sleeve port section 1017 is adjacent the string port section 1012. The end seal section 1018 has a cylindrical outer surface for mating with annular seal 1020 when the valve is in an open configuration. To hold the IFV 1000 in the open position, shear pins 1013 (see FIG. 19B) are fastened between the spreader tips 1015 and the slip bore 1006.

The IFV 1000 is reconfigured from the open configuration to the closed configuration by dropping a drop ball 808 from a ball holding service tool 800 onto the seat defined by the spreader tips 1015 of the IFV 1000. The outside diameter of the drop ball 808 is larger than the inside diameter of a circle defined by the interior of the spreader tips 1015, when the spreader tips 1015 are seated in the slip bore 1006. Thus, when the drop ball 808 falls on the spreader tips 1015, the ball is supported by the spreader tips 1015 and does not pass therethrough. The weight of the drop ball and fluid pressure behind the drop ball 808 combine to produce sufficient force to the spreader tips 1015 to shear the shear pins 1013. Fluid pressure behind the drop ball 808 then pushes the sliding sleeve 1004 until the middle seal section 1016 mates with both annular seals, 1019 and 1020, and spans the string port section 1012. At this position, the spreader tips 1015 clear the shoulder 1008 and snap into the release groove 1010 (see FIG. 18B). Because the internal radius of the slip bore 1006 is smaller than the internal radius of the release groove 1010, the inside diameter of a circle defined by the interior of the spreader tips 1015 becomes larger as the spreader tips snap into the release groove 1010. The cantilever fingers 1014 are prestressed to bias the spreader tips 1015 radially outward. The circle defined by the interior of the spreader tips 1015 becomes large enough to release the drop ball 808 so that the drop ball 808 passes through the IFV 1000 and down into the rat hole of the well (see FIG. 18A). The IFV 1000 becomes locked in the closed configuration because the shoulder 1008 prevents the spreader tips 1015 from reversing direction once they have snapped into the release groove 1010.

Figure 20A:
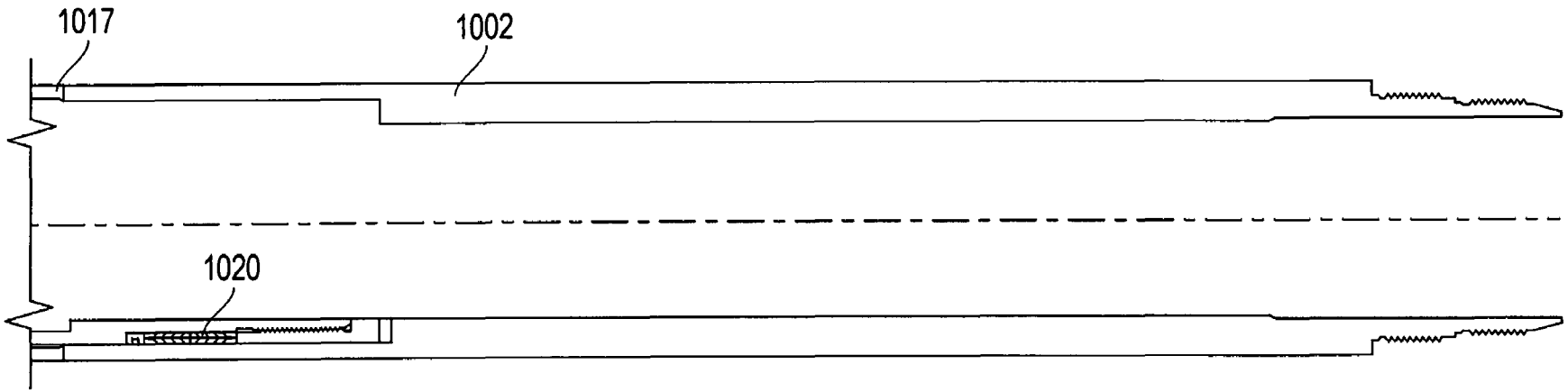
FIGS. 20A–20C illustrate cross-sectional side views of an IFV, wherein the valve above the midline is shown in an open configuration and the valve below the midline is shown in a closed configuration.
Figure 20B:
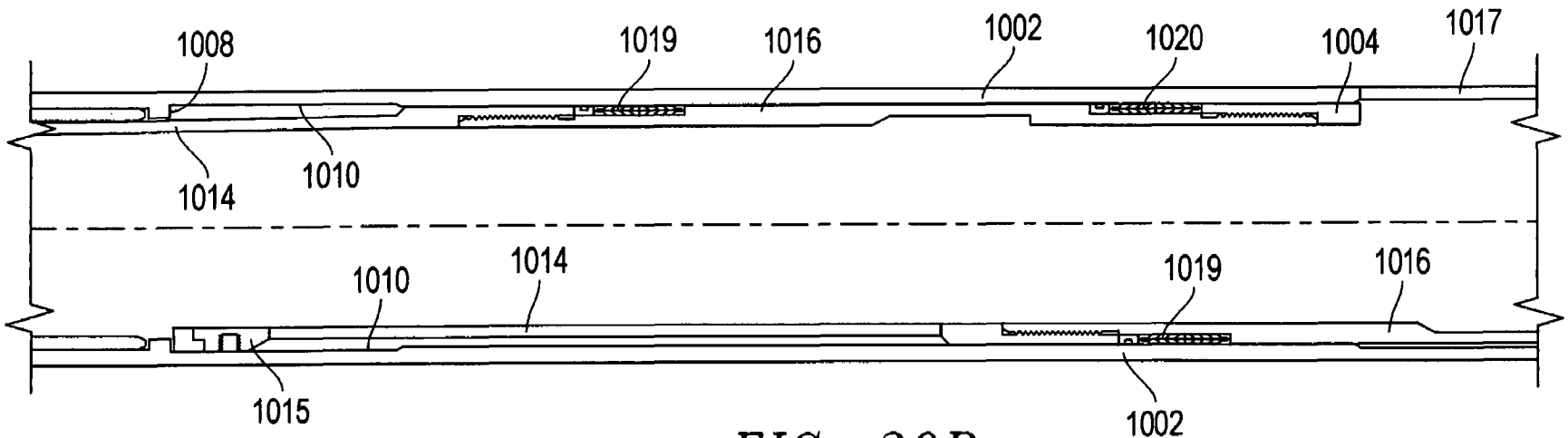
Figure 20C:
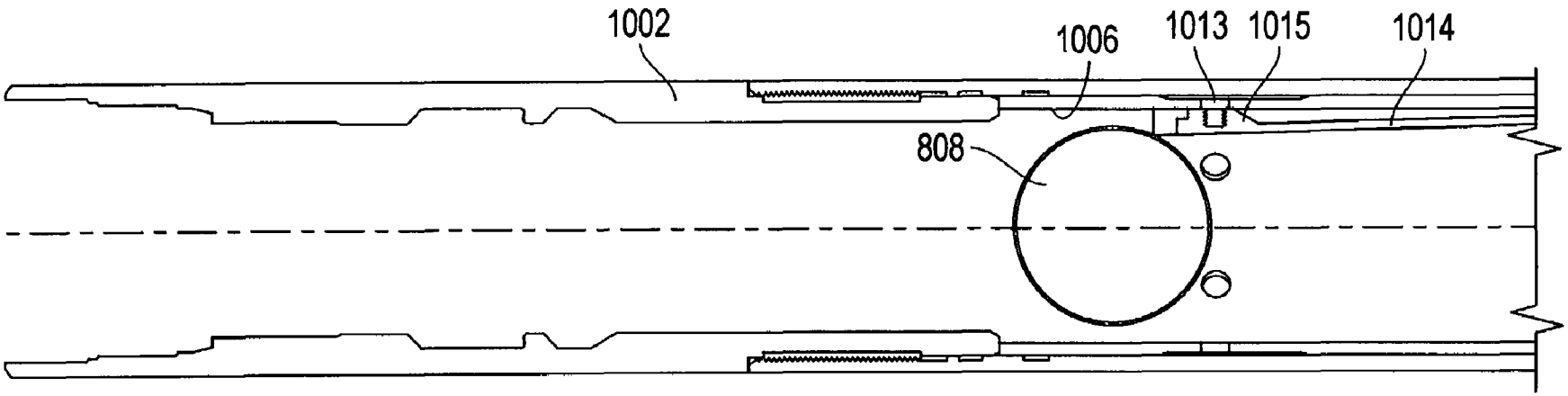

An alternate embodiment of an IFV 1000 is shown in FIGS. 20A–20C. This embodiment is very similar to that illustrated above. In FIGS. 20A–20C, the configuration illustrated above the center line is an open configuration and that illustrated below the center line is a closed configuration. As before, this IFV 1000 has a string port section 1012 in a string 1002. However, in this embodiment, the sliding sleeve 1004 is basically comprised of a plurality of cantilever fingers 1014 and a seal section 1016. The cantilever fingers 1014 extend from one end of the seal section 1016 and are evenly spaced from each other. Each cantilever finger 1014 has a spreader tip 1015 at its distal end. In the open configuration, shown above the center line, the spreader tips 1015 rest on the slip bore 1006 of a tube held within the string 1002. To hold the IFV 1000 in the open position, shear screws 1013 (see FIG. 20B) are fastened between the spreader tips 1015 and the tube defining the slip bore 1006. In the open position, the seal section 1016 and annular seals 1019 and 1020 are positioned above the string port section 1012.

In the closed position, the spreader tips 1015 rest in the release groove 1010 of the string 1002. When the spreader tips 1015 rest on the slip bore 1006, the spreader tips define a relatively smaller diameter sufficient to form a seat for catching a drop ball 808. The seal section 1016 has a cylindrical outer surface with annular seals 1019 and 1020 fixed to the sliding sleeve 1004 at each end of the seal section 1016. In the closed position, the seal section 1016 spans the string port section 1012 and annular seal 1019 and 1020 contact the string 1002 on either side to ensure the integrity of the closed valve. The sleeve port section 1017 has a plurality of lengthwise ports evenly spaced around the sliding sleeve 1004.

To manipulate the IFV from the open configuration to the closed configuration, a drop ball 808 is used as described with reference to the IFV embodiment illustrated in FIGS. 19A–19C.

Figure 20D:
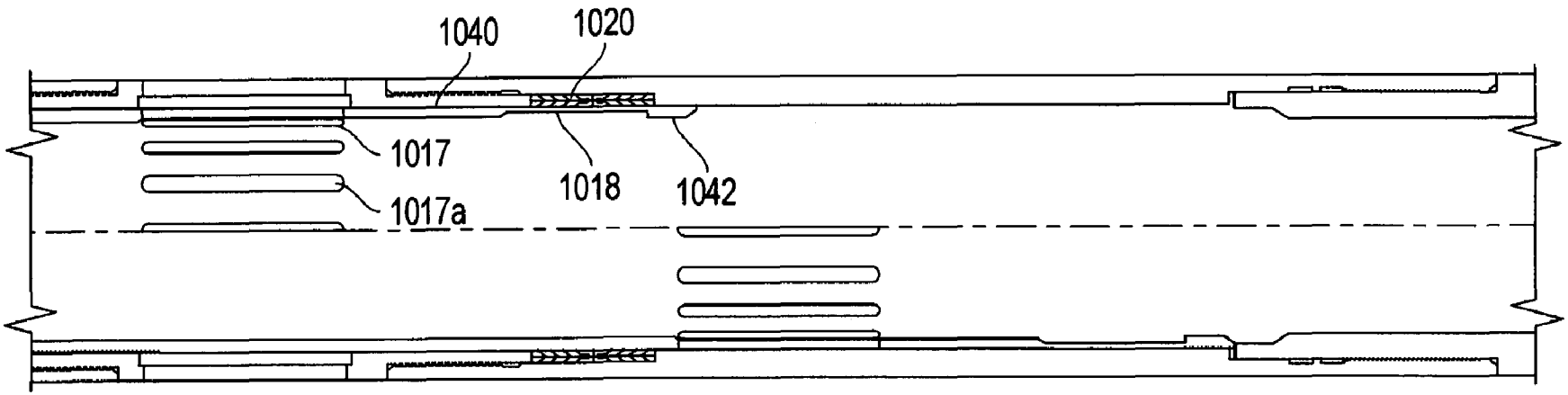
FIGS. 20D–20F illustrate a cross sectional schematic of a drop ball engagement and actuation of an object activated valve.
Figure 20E:
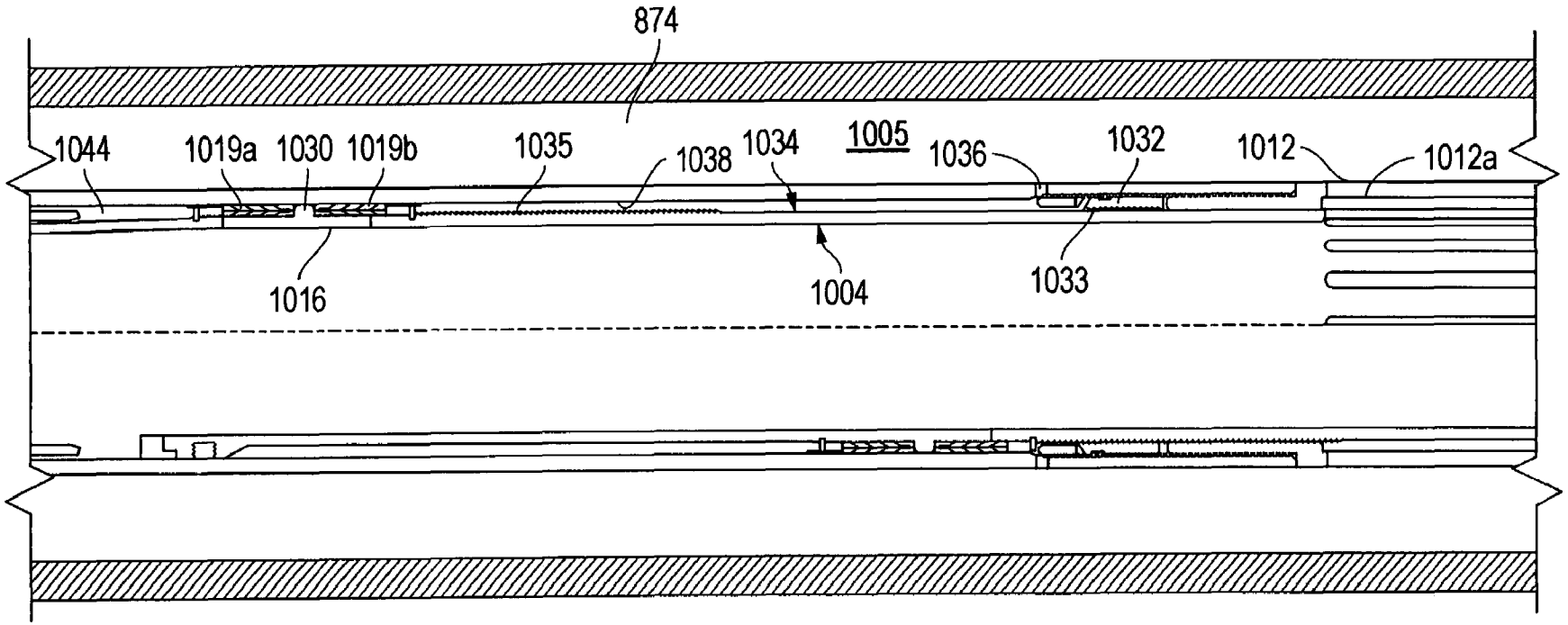
Figure 20F:
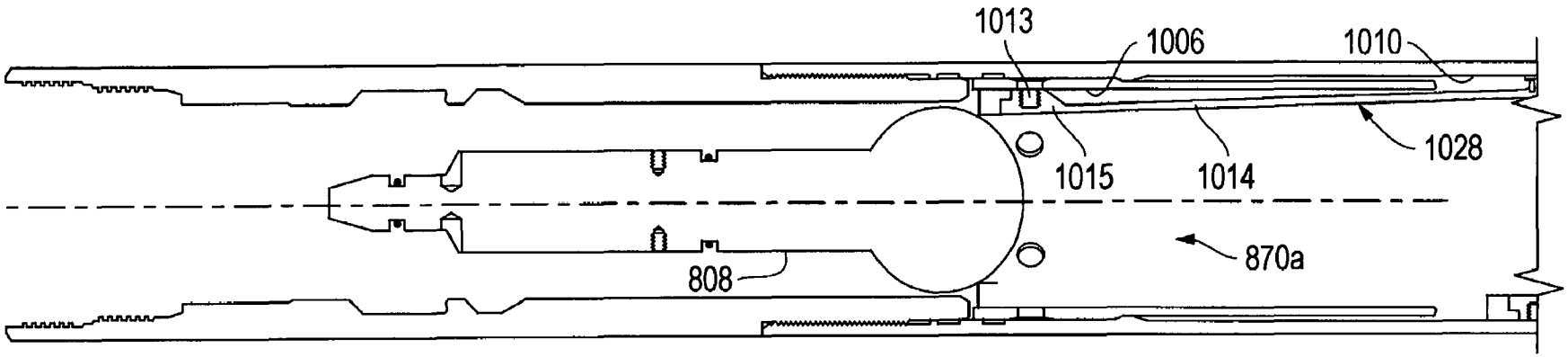

FIGS. 20D–20F illustrate a cross sectional schematic of a drop ball 808 engagement and actuation of a valve 1005. The upper portion of these figures illustrates a drop ball in engagement with an open valve having a sliding sleeve 1004 with a collet assembly 1028. The lower portion illustrates a closed valve after the drop ball has actuated the valve through movement of the sliding sleeve 1004.

The valve 1005 can be coupled downstream of a holding barrel with a drop ball, described above. The valve can be, but is not limited to, a sliding sleeve valve, such as the IFV 1000 described in FIGS. 18A–20B. The holding barrel 826 can be, but is not limited to, the holding barrels described in FIGS. 12A–16N. The valve can include a slip bore 1006 and a port section 1012. The slip bore 1006 can be formed in the inner surfaces of the valve for slidably engaging internal structures of the valve. The port section 1012 can allow fluid to flow between an internal bore 870*a* of the valve and an external annulus 874 formed between the valve and well casing.

The valve 1005 includes a sliding sleeve 1004 disposed inward of the slip bore 1006. The sliding sleeve generally includes a seal section 1016, a sleeve port section 1017 coupled to the seal section, and an end seal section 1018 coupled to the sleeve port section. The valve also includes a collet assembly 1028 coupled to the sliding sleeve 1004 and flexibly and outwardly engaged with the internal surfaces of the slip bore 1006. Generally, the collet assembly 1028 includes cantilever fingers 1014 biased outwardly. The cantilever fingers 1014 include spreader tips 1015 used to catch and release the drop ball 808. The collet assembly 1028 is restrained with the valve by a shear screw 1013 or other restraining device.

Fluid flow through the sliding sleeve 1004 can be controlled by selective engagement with seals 1019*a*, 1019*b* disposed between an outer surface of the sliding sleeve 1004 and internal surfaces of the valve 1005. The seals 1019*a*, 1019*b* can be longitudinally separated by a piston 1030 coupled to the sliding sleeve 1004. The piston 1030 allows a force to be generated by applying a pressurized fluid over an area formed by an inner seal surface 1038 of the valve 1005 minus an area formed by an outer seal surface 1040 of the sliding sleeve 1004. A relief port 1036 formed in the valve allows fluid trapped between inner surfaces of the valve and outer surfaces of the sliding sleeve to escape upon actuation and closure of the valve.

A lock ring 1032 is disposed internal to the valve and can be used to restrict reverse movement of the sliding sleeve 1004. The lock ring 1032 can engage external surfaces of a portion 1034 of the sliding sleeve 1004. For example, the reverse movement can be restricted by grooves 1035 in the external surfaces of the portion 1034 engaging corresponding internal surfaces 1033 on the lock ring.

The port section 1012 includes ports 1012*a*. Generally, ports 1012*a* in the port section 1012 allow fluid flow between the bore 870*a* and the annulus 874 when aligned with corresponding ports 1017*a* in the sleeve port section 1017 of the sliding sleeve 1004.

A seal 1020 is disposed downstream of the port section 1012 between the outer surfaces of the sliding sleeve 1004 and the inner surfaces of the valve. The seal 1020 is used to seal the sliding sleeve 1004 as it traverses in the valve. A shifting profile 1042 is coupled to the sliding sleeve and forms a projection for a mechanical engagement with a tool (not shown) to assist in actuating the valve, if the valve is not shifted through the drop ball, as described below.

In operation, the drop ball 808 is released from the holding barrel described in various figures above, and travels downstream to the valve 1005. The drop ball sealingly engages the collet assembly 1028 at the spreader tips 1015 and allows pressurized fluid upstream of the drop ball to create a force on the collet assembly in combination with any inertia from the drop ball released from the holding barrel. A sufficient force severs the shear screw 1013 to allow the sliding sleeve 1004 to move longitudinally downstream. As the sliding sleeve 1004 moves downstream, the lock ring 1032 engages the portion 1034 of the sliding sleeve to restrict reverse travel. Fluid, trapped in the space between the outer surface of the sliding sleeve 1004 and the inner surfaces of the valve, is allowed to exit through the relief port 1036. The sleeve port section 1017 of the sliding sleeve 1004 becomes offset with the port section 1012 in the valve and flow is restricted.

With sufficient travel, the collet assembly 1028 enters a portion of the valve assembly having a larger internal dimension, such as a release groove 1010. Further, the pressurized fluid is allowed to flow into the area 1044 upstream of the piston 1030. The piston 1030 is forced to move downstream to further assist in moving the sliding sleeve 1004 so that the valve 1005 closes. The collet assembly 1028 is allowed to spread outwardly and release the drop ball 808 to a downstream portion of the well, so as to not further restrict flow in the valve 1005.

As shown in the lower portion of FIGS. 20D–20F, after the valve is actuated to a closed position, the sleeve port section 1017 is disposed at least partially downstream of the seal 1020. The seal 1019*b* is disposed upstream of the port section 1012 of the valve. The sliding sleeve 1004 forms an inner wall to the valve in the vicinity of the port sections 1012, 1017. Thus, fluid flow is restricted between the bore 870*a* and the annulus 874 of the well and the valve is "closed". The engagement between the lock ring 1032 and the sliding sleeve 1004 assists in maintaining the closed position.

In multi-zone wells, the above assemblies can be assembled to the completion string of the well in the various production zones. A similar procedure could be followed for each zone that is to be closed. For example and without limitation, a lower zone could be closed and then an upper zone closed by a second system of the drop ball and valve.

Figure 21:
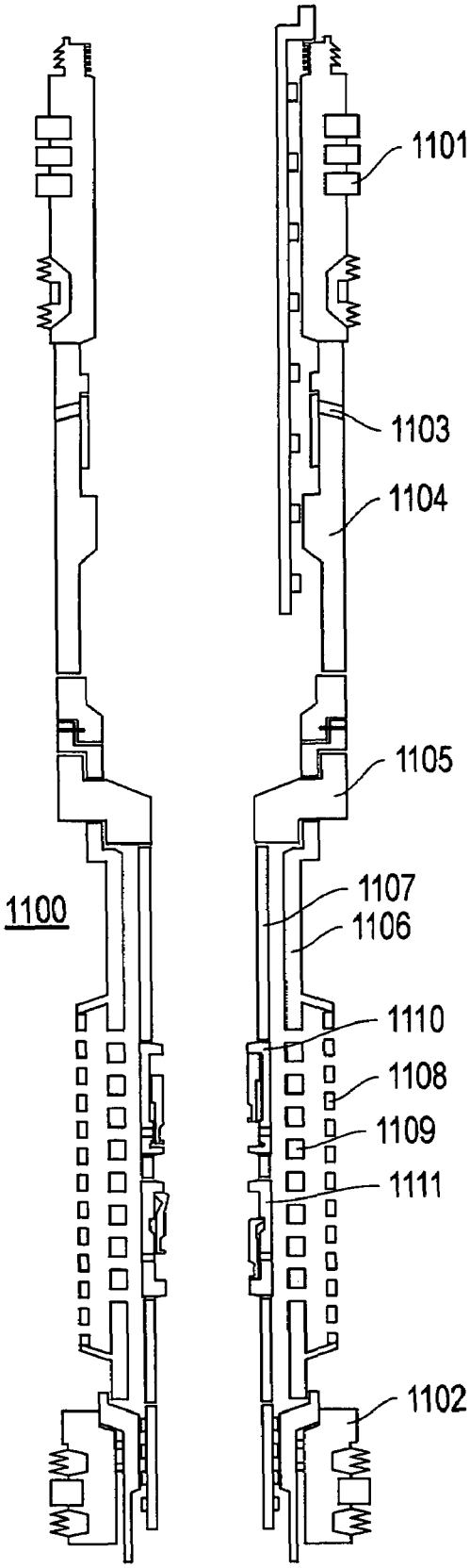
FIG. 21 illustrates cross-sectional side views of an isolation string having an IFV and PACV and separate isolation and production pipes, wherein the valves on the left are shown in a run-in configuration and the valves on the right are shown in a production configuration.

Referring to FIG. 21, a side view is shown of a fixed isolation string with a PACV and an IFV. The isolation string 1100 has a packer 1101 at its top for securing and sealing the top of the isolation string 1100 in a well casing. It also has a packer 1102 at its bottom for sealing the bottom of the isolation string 1100. The string further comprises cross-over ports 1103 for use during a gravel pack operation. A portion of a production tube is shown stung into the isolation string 1100 for seating in a seal bore 1104. A double-pin sub 1105 is made-up to the string below the seal bore 1104. A screen pipe 1106 and an isolation pipe 1107 are made-up to the bottom of the double-pin sub 1105. The bottom of the screen pipe 1106 is made up to the packer 1102. Further, the isolation pipe 1107 is stung into and landed in a seal bore of the packer 1102 to seal the bottom of the isolation pipe 1107. The screen pipe 1106 has a production screen 1108 around a perforated base pipe section 1109. The isolation pipe 1107 has two valves: a PACV 1110 and an IFV 1111.

The isolation system illustrated in FIG. 21 may be used to complete a well. The isolation string 1100 is run-in the well on a cross-over service tool and set in the casing with the production screen 1108 adjacent perforations in the casing. When the isolation string 1100 is run-in the well, the PACV 1110 is closed and the IFV 1111 is open. A gravel pack operation is performed by circulating a slurry through cross-over ports 1103 to deposit the gravel pack in the annulus between the production screen 1108 and the casing, while the filtered suspension fluid is circulated through the open IFV 1111. When the gravel pack operation is complete a drop ball 808 is dropped from the service tool having a ball holding service tool 800 (see FIGS. 9A–16E). The drop ball 808 operates on the IFV 1111 to close the valve and isolate the gravel packed production zone. The service tool is then released from the isolation string 1100 and withdrawn from the well. A production string is then run-in the well and stung into the isolation string 1100. Pressure differential between the inner bore and the annulus is then used to open the PACV 1110 to bring the well into production.

Figure 22:
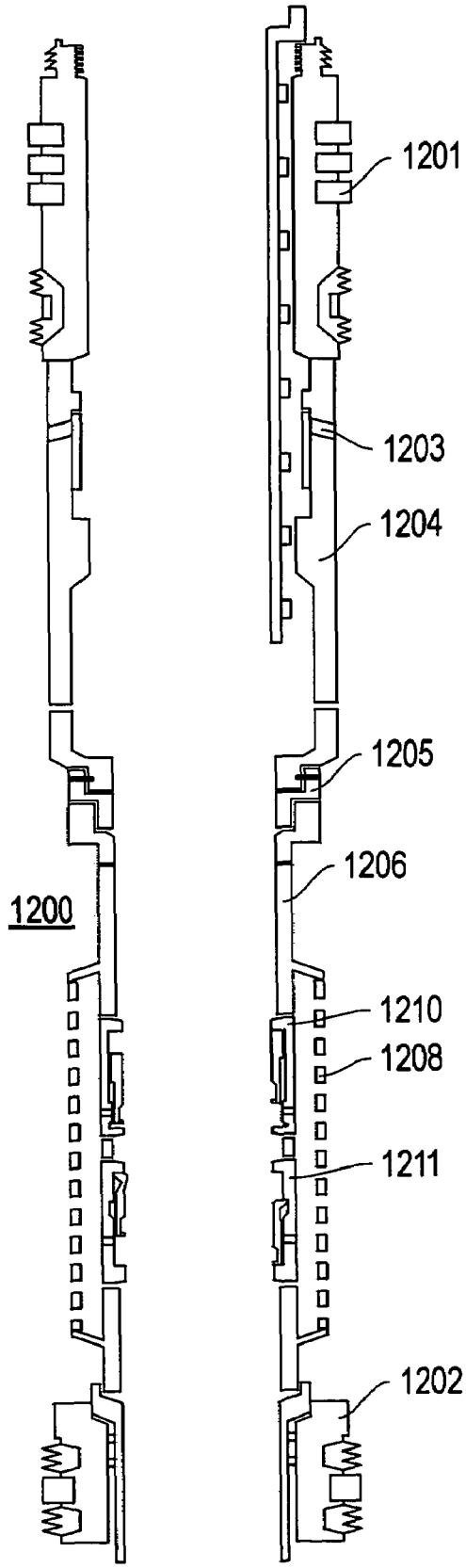
FIG. 22 illustrates cross-sectional side views of an isolation string having an IFV and a PACV, wherein the valves are wire wrapped with a production screen, and wherein the valves on the left are shown in a run-in configuration and the valves on the right are shown in a production configuration.

Referring to FIG. 22, a side view is shown of a screen wrapped isolation string with a PACV and an IFV. The isolation string 1200 has a packer 1201 at its top for securing and sealing the top of the isolation string 1200 in a well casing. It also has a packer 1202 at its bottom for sealing the bottom of the isolation string 1200. The string further comprises cross-over ports 1203 for use during a gravel pack operation. A portion of a production tube is shown stung into the isolation string 1200 for seating in a seal bore 1204. A safety shear sub 1205 is made-up to the string below the seal bore 1204. A blank pipe 1206 is made-up to the bottom of the safety shear sub 1205. The bottom of the blank pipe 1206 is made up to the packer 1202. The blank pipe 1206 has two valves: a PACV 1210 and an IFV 1211. A wire wrap production screen 1208 is wrapped around the blank pipe 1206, the PACV 1210, and the IFV 1211.

The isolation system illustrated in FIG. 22 may be used to complete a well. The isolation string 1200 is run-in the well on a cross-over service tool and set in the casing with the production screen 1108 adjacent perforations in the casing. The cross-over service tool is not shown in FIG. 22, but it has a ball drop service tool 800 as shown in FIGS. 9A–16E. When the isolation string 1200 is run-in the well, the PACV 1210 is closed and the IFV 1211 is open. A gravel pack operation is performed by circulating a slurry through cross-over ports 1203 to deposit the gravel pack in the annulus between the production screen 1208 and the casing, while the filtered suspension fluid is circulated through the open IFV 1211. When the gravel pack operation is complete a drop ball 808 is dropped from the service tool having a ball holding service tool 800 (see FIGS. 9A–16E). The drop ball 808 operates on the IFV 1211 to close the valve and isolate the gravel packed production zone. The service tool is then released from the isolation string 1200 and withdrawn from the well. A production string is then run-in the well and stung into the isolation string 1200. Pressure differential between the inner bore and the annulus is then used to open the PACV 1210 to bring the well into production.

Figure 23:
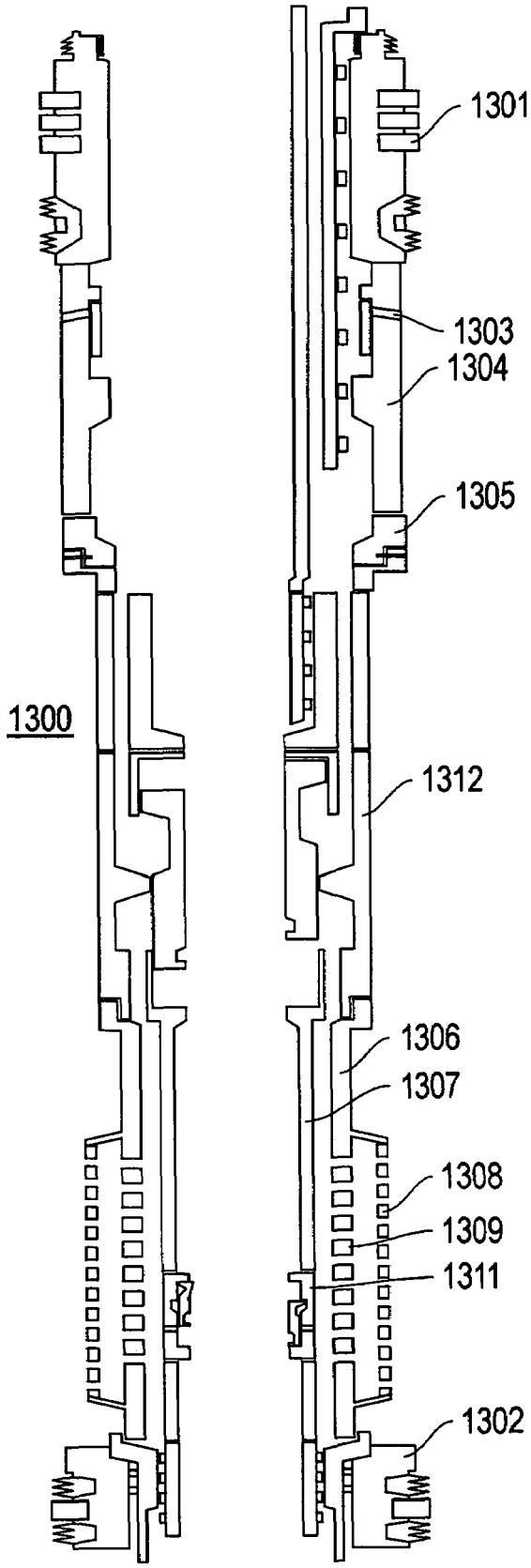
FIG. 23 illustrates cross-sectional side views of an isolation string having an IFV and a RFV and separate isolation and production pipes connected to the RFV, wherein the valves on the left are shown in a run-in configuration and the valves on the right are shown in a production configuration.

Referring to FIG. 23, a side view is shown of a lower zone isolation string with a RFV and an IFV. The isolation string 1300 has a packer 1301 at its top for securing and sealing the top of the isolation string 1300 in a well casing. It also has a packer 1302 at its bottom for sealing the bottom of the isolation string 1300. The string further comprises cross-over ports 1303 for use during a gravel pack operation. A portion of a production tube is shown stung into the isolation string 1300 for seating in a seal bore 1304. A safety shear sub 1305 is made-up to the string below the seal bore 1304. A RFV 1312 is made up to the bottom of the safety shear sub 1305 and is pressure activated to open and allow fluids to flow radially from an annulus below the RFV 1312. Both a screen pipe 1306 and an isolation pipe 1307 are made-up to the bottom of the RFV 1312. The bottom of the screen pipe 1306 is made up to the packer 1302. Further, the isolation pipe 1307 is stung into and landed in a seal bore of the packer 1302 to seal the bottom of the isolation pipe 1307. The screen pipe 1306 has a production screen 1308 around a perforated base pipe section 1309. The isolation pipe 1307 has an IFV 1311.

The isolation system illustrated in FIG. 23 may be used to complete a well. The isolation string 1300 is run-in the well on a cross-over service tool and set in the casing with the production screen 1308 adjacent perforations in the casing. The cross-over service tool is not shown in FIG. 23, but it has a ball drop service tool 800 as shown in FIGS. 9A–16E. When the isolation string 1300 is run-in the well, the RFV 1312 is closed and the IFV 1311 is open. A gravel pack operation is performed by circulating a slurry through cross-over ports 1303 to deposit the gravel pack in the annulus between the production screen 1308 and the casing, while the filtered suspension fluid is circulated through the open IFV 1311. When the gravel pack operation is complete, a drop ball 808 is dropped from the service tool having a ball holding service tool 800 (see FIGS. 9A–16E). The drop ball 808 operates on the IFV 1311 to close the valve and isolate the gravel packed production zone. The service tool is then released from the isolation string 1300 and withdrawn from the well. A production string is then run-in the well and stung into the RFV 1312. Pressure differential between the inner bore and the annulus is then used to open the RFV 1312 to bring the well into production.

Figure 24:
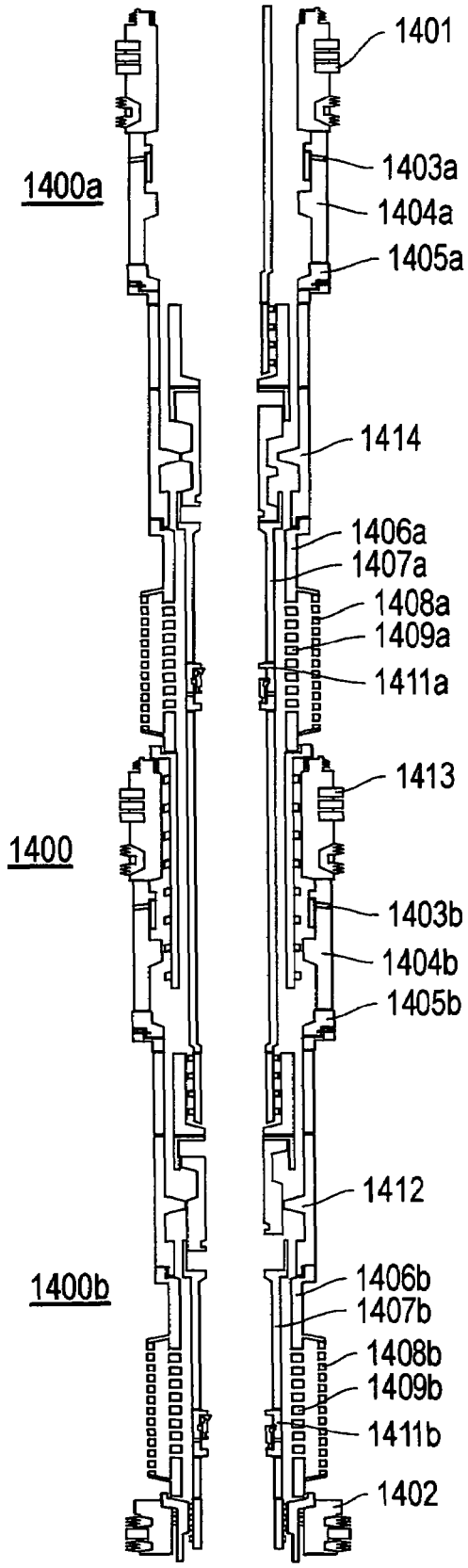
FIG. 24 illustrates cross-sectional side views of a dual zone isolation string. The lower section of the string has an IFV and a RFV with separate isolation and production pipes connected to the RFV. The upper section of the string has an IFV and a AFV with separate isolation and production pipes connected to the AFV. The valves on the left are shown in a run-in configuration and the valves on the right are shown in a production configuration.

Referring to FIG. 24, a side view is shown of a dual-zone, selective isolation string with AFV, a RFV, and two IFV. The isolation string 1400 has a top packer 1401 at its top for securing and sealing the top of the isolation string 1400 in a well casing. It also has a bottom packer 1402 at its bottom for sealing the bottom of the isolation string 1400. Further, the string has a middle packer 1413 for sealing the annulus between upper and lower zones. The string further comprises cross-over ports 1403*a* and 1403*b* for use during gravel pack operations. A safety shear sub 1405*a* is made-up to the string below a seal bore 1404*a*. An AFV 1414 is made up to the bottom of the safety shear sub 1405*a* and is pressure activated to open and allow fluids to flow from an annulus below the valve 1414 to an annulus above. A portion of a production tube is shown stung into the AFV 1414. Both a screen pipe 1406*a* and an isolation pipe 1407*a* are made-up to the bottom of the AFV 1414. The bottom of the screen pipe 1406*a* is stung into and landed out in a seal bore 1404*b* below the middle packer 1413. Further, the isolation pipe 1407*a* is stung into and landed in a seal bore of a RFV 1412 to seal the bottom of the isolation pipe 1407*a*. The screen pipe 1406*a* has a production screen 1408*a* around a perforated base pipe section 1409*a*. The isolation pipe 1407*a* has a IFV 1411*a*. A safety shear sub 1405*b* is made-up to the string below the seal bore 1404*b*. The RFV 1412 is made up to the bottom of the safety shear sub 1405*b* and is pressure activated to open and allow fluids to flow radially from an annulus below the valve 1412 to the inner bore of the valve. Both a screen pipe 1406*b* and an isolation pipe 1407*b* are made-up to the bottom of the RFV 1412. The bottom of the screen pipe 1406*b* is stung into and landed out in the lower packer 1402. Further, the isolation pipe 1407*b* is stung into and landed in a seal bore of the lower packer 1402 to seal the bottom of the isolation pipe 1407*b*. The screen pipe 1406*b* has a production screen 1408*b* around a perforated base pipe section 1409*b*. The isolation pipe 1407*b* has a IFV 1411*b*.

The isolation system illustrated in FIG. 24 may be used to complete two production zones in a well. The isolation string 1400 is run-in the well on a cross-over service tool in two separate trips. The lower section 1400*b* of the isolation string 1400 is run-in the well and set in the casing with the production screen 1408*b* adjacent perforations for the lower zone in the casing. The cross-over service tool is not shown in FIG. 24, but it has a ball drop service tool 800 as shown in FIGS. 9A–16E. When the upper section 1400*a* of the isolation string 1400 is run-in the well, the RFV 1412 is closed and the IFV 1411*b* is open. A gravel pack operation is performed by circulating a slurry through cross-over ports 1403*b* to deposit the gravel pack in the annulus between the production screen 1408*b* and the casing, while the filtered suspension fluid is circulated through the open IFV 1411*b*. When the gravel pack operation is complete, a drop ball 808 is dropped from the service tool having a ball holding service tool 800 (see FIGS. 9A–16E). The drop ball 808 operates on the IFV 1411*b* to close the valve and isolate the gravel packed lower production zone. The service tool is then released from the lower section 1400*b* of the isolation string 1400 and withdrawn from the well.

In a second trip into the well, the upper section 1400*a* of the isolation string 1400 is run-in the well and set in the casing with the production screen 1408*a* adjacent perforations for the upper zone in the casing. The distal end of the upper section 1400*a* is stung into the lower section 1400*b*. In particular, the screen pipe 1406*a* is stung into the middle packer 1413 and the isolation pipe 1407*a* is stung into the RFV 1412. The cross-over service tool is not shown in FIG. 24, but it has a ball drop service tool 800 as shown in FIGS. 9A–16E. Of course, before running into the well for this second trip, the ball drop service tool 800 is charged with a second drop ball 808. When the upper section 1400*a* of the isolation string 1400 is run-in the well, the AFV 1414 is closed and the IFV 1411*a* is open. A gravel pack operation is performed by circulating a slurry through cross-over ports 1403*a* to deposit the gravel pack in the annulus between the production screen 1408*a* and the casing, while the filtered suspension fluid is circulated through the open IFV 1411*a*. When the gravel pack operation is complete, a drop ball 808 is dropped from the service tool having a ball holding service tool 800 (see FIGS. 9A–16E). The drop ball 808 operates on the IFV 1411*a* to close the valve and isolate the gravel packed production zone. The service tool is then released from the upper section 1400*a* of the isolation string 1400 and withdrawn from the well.

A production string is then run-in the well and stung into the AFV 1414. Pressure differential between the inner bore and the annulus is then used to open the AFV 1414 and RFV 1412 to bring the well into production. The upper zone production flows through the annulus on the outside of the production string to the surface. The lower zone production flows through the inner bore of the production string to the surface.

Figure 25:
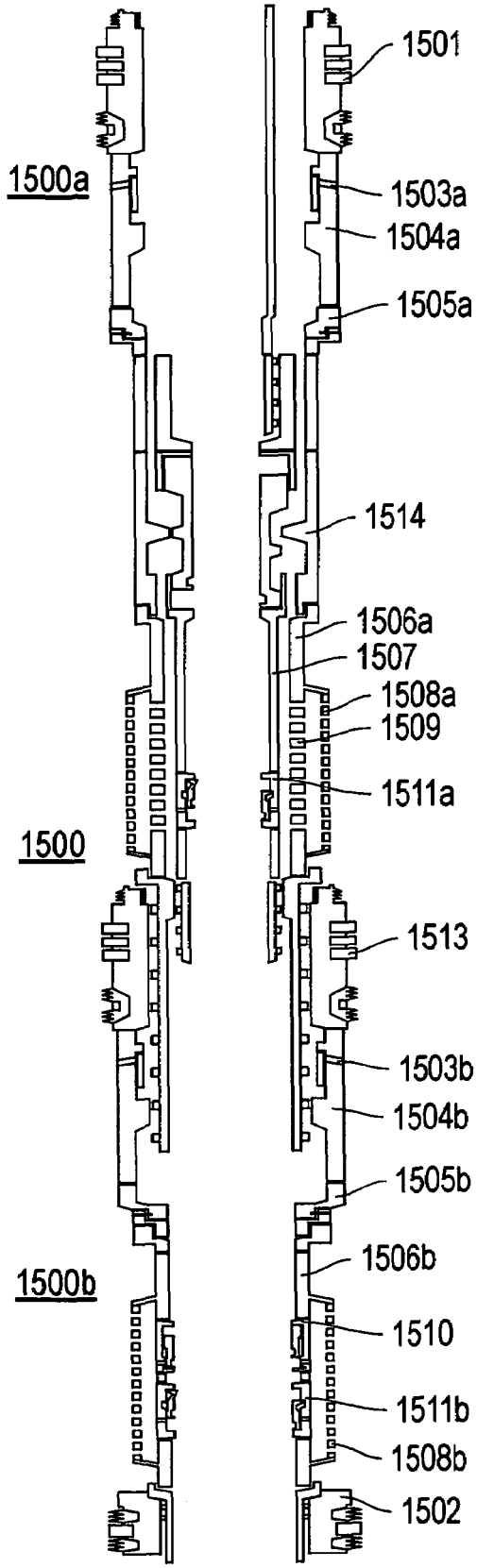
FIG. 25 illustrates cross-sectional side views of a dual zone isolation string. The lower section of the string has an IFV and a PACV, wherein both valves are wire wrapped with a production screen. The upper section of the string has an IFV and a AFV with separate isolation and production pipes connected to the AFV. The valves on the left are shown in a run-in configuration and the valves on the right are shown in a production configuration.

Referring to FIG. 25, a side view is shown of a dual-zone, selective isolation string with an AFV and an IFV for the upper zone, and an IFV and a PACV for the lower zone. The isolation string 1500 has a top packer 1501 at its top for securing and sealing the top of the isolation string 1500 in a well casing. It also has a bottom packer 1502 at its bottom for sealing the bottom of the isolation string 1500. Further, the string has a middle packer 1513 for sealing the annulus between upper and lower zones. The string further comprises cross-over ports 1503*a* and 1503*b* for use during gravel pack operations. A safety shear sub 1505*a* is made-up to the string below a seal bore 1504*a*. An AFV 1514 is made up to the bottom of the safety shear sub 1505*a* and is pressure activated to open and allow fluids to flow from an annulus below the valve 1514 to an annulus above. A portion of a production tube is shown stung into the AFV 1514. Both a screen pipe 1506*a* and an isolation pipe 1507 are made-up to the bottom of the AFV 1514. The bottom of the screen pipe 1507 is stung into and landed out in a seal bore 1504*b* below the middle packer 1513. Further, the isolation pipe 1507 is stung into and landed in a seal bore of the screen pipe 1506*a* to seal the bottom of the isolation pipe 1507. The screen pipe 1506*a* has a production screen 1508*a* around a perforated base pipe section 1509. The isolation pipe 1507 has an IFV 1511*a*. A safety shear sub 1505*b* is made-up to the string below the seal bore 1504*b*. A blank screen pipe 1506 is made-up to the bottom of the safety shear sub 1505*b*. The bottom of the blank screen pipe 1506 is made up to the lower packer 1502. The blank screen pipe 1506 has two valves: a PACV 1510 and an IFV 1511*b*. A wire wrap production screen 1508*b* is wrapped around the blank screen pipe 1506*b*, the PACV 1510, and the IFV 1511*b*.

The isolation system illustrated in FIG. 25 may be used to complete a well. The isolation string 1500 is run into the well in two separate trips. The lower section 1500*b* of the isolation string 1500 is run-in the well and set in the casing with the production screen 1508*b* adjacent perforations for the lower zone in the casing. The lower section 1500*b* of the isolation string 1500 is run-in the well on a cross-over service tool and set in the casing with the production screen 1508*b* adjacent the lower zone perforations in the casing. The cross-over service tool is not shown in FIG. 25, but it has a ball drop service tool 800 as shown in FIGS. 9A–16E. When the lower section 1500*b* is run-in the well, the PACV 1510 is closed and the IFV 1511*b* is open. A gravel pack operation is performed by circulating a slurry through cross-over ports 1503*b* to deposit the gravel pack in the annulus between the production screen 1508*b* and the casing, while the filtered suspension fluid is circulated through the open IFV 1511*b*. When the gravel pack operation is complete a drop ball 808 is dropped from the service tool having a ball holding service tool 800 (see FIGS. 9A–16E). The drop ball 808 operates on the IFV 1511*b* to close the valve and isolate the gravel packed lower production zone. The service tool is then released from the lower section 1500*b* of the isolation string 1500 and withdrawn from the well.

In a second trip into the well, the upper section 1500*a* of the isolation string 1500 is run-in the well and set in the casing with the production screen 1508*a* adjacent perforations for the upper zone in the casing. The distal end of the upper section 1500*a* is stung into the lower section 1500*b*. In particular, the screen pipe 1506*a* is stung into the middle packer 1513 and the isolation pipe 1507 is already stung into the distal end of the isolation pipe 1507. The cross-over service tool is not shown in FIG. 25, but it has a ball drop service tool 800 as shown in FIGS. 9A–16E. Of course, before running into the well for this second trip, the ball drop service tool 800 is charged with a second drop ball 808. When the upper section 1500*a* of the isolation string 1500 is run-in the well, the AFV 1514 is closed and the IFV 1511*a* is open. A gravel pack operation is performed by circulating a slurry through cross-over ports 1503*a* to deposit the gravel pack in the annulus between the production screen 1508*a* and the casing, while the filtered suspension fluid is circulated through the open IFV 1511*a*. When the gravel pack operation is complete, a drop ball 808 is dropped from the service tool having a ball holding service tool 800 (see FIGS. 9A–16E). The drop ball 808 operates on the IFV 1511*a* to close the valve and isolate the gravel packed upper production zone. The service tool is then released from the upper section 1500*a* of the isolation string 1500 and withdrawn from the well.

A production string is then run-in the well and stung into the AFV 1514 of the isolation string 1500. Pressure differential between the inner bore and the annulus is then used to open the AFV 1514 and the PACV 1510 to bring the well into production. Production from the upper zone flows through the annulus around the production pipe and production from the lower zone flows through the inner bore of the production pipe.

Many of the components described herein are generally available from industry sources as known to persons of skill in the art. For example, packers, cross-over ports, double-pin subs, screen pipe, isolation pipe, production screens, and other components which are generally known to persons of skill in the art may be used in the various embodiments of the present invention.

While the foregoing is directed to various embodiments of the present invention, other and further embodiments can be devised without departing from the basic scope thereof Further, the various methods and embodiments of the invention can be included in combination with each other to produce variations of the disclosed methods and embodiments. Discussion of singular elements can include plural elements and vice-versa. Further, the use of any numeric quantities herein, particularly regarding the claims, such as "a" or "the", includes at least such quantity and can be more. The use of a term in a singular tense is not limiting of the number of items. Any directions shown or described such as "top," "bottom," "left," "right," "upper," "lower," "down," "up," "side," and other directions and orientations are described herein for clarity in reference to the figures and are not to be limiting of the actual device or system or use of the device or system. The device or system can be used in a number of directions and orientations.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Additionally, any headings herein are for the convenience of the reader and are not intended to limit the scope of the invention.

Further, any references mentioned in the application for this patent as well as all references listed in any information disclosure originally filed with the application are hereby incorporated by reference in their entirety to the extent such may be deemed essential to support the enabling of the invention. However, to the extent statements might be considered inconsistent with the patenting of the invention, such statements are expressly not meant to be considered as made by the Applicants.

What is claimed is:

1. A valve system for a well, comprising:

an isolation string, comprising an upper packer; and an isolation pipe in mechanical communication with the upper packer, wherein the isolation pipe comprises a pressure activated valve, an object activated valve; and an object holding service tool coupled to the isolation string and adapted to release an object to engage the object activated valve.

2. The valve system of claim 1, wherein the object holding service tool comprises a holding barrel having a bore in which the object is slidably and sealingly engaged, the object holding service tool being adapted to slidably release the object with sufficient pressure applied to the object to cause a restraining device holding the object to release the object.

3. The valve system of claim 1, wherein the pressure activated valve comprises:

a tube having at least one opening;

a sleeve being movably connected to the tube, wherein the tube and sleeve are configurable in at least locked-closed, unlocked-closed and open configurations, wherein the sleeve covers the at least one opening in the locked-closed and unlocked-closed configurations and the sleeve does not cover the at least one opening in the open configuration;

a lock between the sleeve and the tube which locks the sleeve and tube in the locked- closed configuration; and a pressure area on the sleeve, wherein a pressure acting on the pressure area unlocks the lock and configures the tube and sleeve between the locked-closed and unlocked-closed configurations.

4. The valve system of claim 1, wherein the object activated valve comprises:

a tube having at least one opening;

a sleeve being movably connected to the tube, wherein the sleeve covers the at least one opening in a closed configuration and the sleeve does not cover the at least one opening in an open configuration; and an object seat in mechanical communication with the sleeve, wherein the seat receives the object for manipulating the valve from the open configuration to the closed configuration.

5. The valve system of claim 4, further comprising a piston coupled to the sleeve to assist the sleeve in covering the at least one opening.

6. The valve system of claim 1, further comprising a production screen, wherein fluid passing from the exterior of the production screen is communicable with the pressure activated valve and the object activated valve.

7. The valve system of claim 6, wherein the production screen is attached to a screen pipe separate from the pressure activated valve and the object activated valve.

8. The valve system of claim 6, wherein the production screen is wrapped around the outside of the pressure activated valve and the object activated valve.

9. The valve system of claim 1, further comprising a lower packer in mechanical communication with the isolation pipe.

10. A method for isolating a production zone of a well, comprising:

running-in an isolation string with an object holding service tool having an object held therewith into the well, the isolation string, but not the service tool, comprising a pressure activated valve; and an object activated valve;

setting the isolation string in the casing adjacent perforations in the casing;

pressurizing an area of the object to cause the object to be released from the object holding service tool, whereby the object travels to the object activated valve;

at least partially closing the object activated valve with the released object; and withdrawing the object holding service tool from the well.

11. The method of claim 10, wherein the object activated tool slidably releases the object upon the pressurizing the area by shearing a restraining device.

12. The method of claim 10, wherein the setting comprises setting a packer above the production zone, wherein the packer is in mechanical communication with the isolation string.

13. The method of claim 10, further comprising stinging a production string into the isolation string, and opening the pressure activated valve.

14. The method of claim 10, further comprising assisting in closing the object activated valve by pressurizing an area of a piston coupled to a sliding sleeve of the object activated valve.

15. A valve system for a well, comprising:

an isolation string, comprising:

an upper packer;

a pressure activated, double-sub valve comprising first and second concentric subs, wherein the double-sub valve is in mechanical communication with the upper packer;

an isolation pipe in mechanical communication with the first sub of the double-sub valve, wherein the isolation pipe comprises an object activated valve; and a production pipe in mechanical communication with the second sub of the double-sub valve; and an object holding service tool coupled to the isolation string and comprising a holding barrel having a bore in which an object is slidably and sealingly engaged, the object holding service tool being adapted to slidably release the object with sufficient pressure applied to the object to cause a restraining device holding the object to release the object from the service tool.

16. The valve system of claim 15, wherein the object holding service tool is adapted to slidably release the object when the restraining device holding the object is sheared through sufficient pressure applied to the object.

17. The valve system of claim 15, wherein the double-sub valve comprises an annulus-to-annulus flow valve, comprising:

an upper annulus defined by upper outer and inner tubes, wherein the upper inner tube is concentric within the upper outer tube;

a lower annulus defined by lower inner and outer tubes, wherein the lower inner tube is concentric within the lower outer tube;

a sleeve positioned within the upper and lower inner tubes, wherein the sleeve is configurable in at least locked-closed, unlocked-closed and open configurations, wherein the sleeve partially defines a port between the upper and lower annuluses in the open configuration and defines a seal between the upper and lower annuluses in the locked-closed and unlocked-closed configurations; and a pressure chamber which communicates with the sleeve to move the sleeve from the locked-closed configuration to the unlocked-closed configuration.

18. The valve system of claim 15, wherein the double-sub valve is an annulus-to- interior valve, comprising:

an outer tube;

an inner tube concentrically positioned within the outer tube;

at least one port between an interior of the inner tube and an annulus between the inner and outer tubes;

a sleeve positioned within the inner tube, wherein the sleeve is configurable in at least locked-closed, unlocked-closed and open configurations, wherein the sleeve covers the at least one port in the locked-closed and unlocked-closed configurations and the sleeve does not cover the at least one port in the open configuration; and a pressure chamber which communicates with the sleeve to move the sleeve from the locked-closed configuration to the unlocked-closed configuration.

19. The valve system of claim 15, wherein the object activated valve comprises:

a tube having at least one opening;

a sleeve having at least one other opening and being movably connected to the tube, wherein the at least one opening and the at least one other opening are adjacent in an open configuration and nonadjacent in a closed configuration; and an object seat in mechanical communication with the sleeve, wherein the seat receives an object for manipulating the valve between the open and closed configurations.

20. The valve system of claim 15, wherein the isolation pipe is stingable into another isolation string.

21. The valve system of claim 15, wherein the production pipe is stingable into another isolation string.

22. The valve system of claim 15, further comprising a production screen attached to the production pipe, wherein fluid passing through the production screen is communicable with the double-sub valve and the object activated valve.

23. The valve system of claim 15, further comprising a lower packer in mechanical communication with the isolation pipe.

24. A method for isolating a production zone of a well, comprising:

running-in an isolation string with an object holding service tool having an object held therewith into the well, wherein the isolation string, but not the service tool, comprises a double-sub valve, and an object activated valve;

setting the isolation string in the casing adjacent perforations in the casing;

pressurizing an area on the object to cause the object to be released from the object holding service tool, whereby the object travels to the object activated valve in the isolation string;

at least partially closing the object activated valve with the released object; and withdrawing the object holding service tool from the isolation string.

25. The method of claim 24, wherein the object is released by applying sufficient pressure to the object to shear a restraining device holding the object.

26. The method of claim 24, wherein the setting comprises setting a packer above the production zone.

27. The method of claim 24, wherein the setting comprises setting a packer above the production zone and stinging the isolation string into another isolation string.

28. The method of claim 24, wherein the closing comprises reconfiguring the object activated valve from an open configuration to a closed configuration with the object.

29. The method of claim 24, further comprising stinging a production string into the double-sub valve of the isolation string, and opening the double-sub valve.

30. The method of claim 24, further comprising assisting in closing the object activated valve by pressurizing an area of a piston coupled to a sliding sleeve of the object activated valve.

31. A valve system for a well, comprising:

an object;

an object holding service tool comprising a holding barrel having a bore in which the object is slidably and sealingly engaged, the object holding service tool being adapted to slidably release the object with sufficient pressure applied to the object to cause a restraining device holding the object to release the object, and an object activated valve unassociated with the service tool, comprising:

a tube having at least one opening, a sleeve being movably connected to the tube, wherein the sleeve covers the at least one opening in a closed configuration and the sleeve does not cover the at least one opening in an open configuration, and an object seat in mechanical communication with the sleeve, wherein the seat receives the object for manipulating the valve from the open configuration to the closed configuration.

32. The valve system of claim 31, further comprising a pressure activated valve coupled to the object holding service tool.

33. The valve system of claim 31, further comprising a sleeve coupled to the object holding service tool and adapted to allow actuation of the object holding service tool.

34. The valve system of claim 31, further comprising a piston adapted to at least partially assist in closing the object activated valve.

35. An isolation string for a wellbore, comprising an object holding service tool comprising a holding barrel having a bore adapted to slidably and sealingly engage an object held therewith, the object holding service tool being adapted to slidably release the object with sufficient pressure applied to the object to cause a restraining device holding the object to release the object;

an object activated valve adapted to receive the object from the object holding service tool and cause a flow path change in the valve; and a pressure activated valve coupled to the object activated valve.

36. The isolation string of claim 35, wherein the object holding service tool is adapted to slidably release the object when the restraining device holding the object is sheared through sufficient pressure applied to the object.

37. A valve system for a well having multiple zones for isolation, comprising:

an isolation string, comprising:

a lower isolation section, comprising:

a lower section upper packer; and a lower section isolation pipe in mechanical communication with the lower section upper packer, wherein the lower section isolation pipe comprises a pressure activated valve and a lower section object activated valve;

an upper isolation section, comprising:

an upper section upper packer;

a double-sub valve comprising first and second concentric subs, wherein the double-sub valve is in mechanical communication with the upper section upper packer;

an upper section isolation pipe in mechanical communication with the first sub of the double-sub valve, wherein the isolation pipe comprises an upper section object activated valve; and a production pipe in mechanical communication with the second sub of the double-sub valve;

wherein the upper section isolation pipe and the production pipe sting into the lower section upper packer; and an object holding service tool, comprising a holding barrel having a bore in which an object is slidably and sealingly engaged, the object holding service tool being adapted to slidably release the object with sufficient pressure applied to the object to cause a restraining device holding the object to release the object, the object holding service tool being coupled to at least one of the isolation sections.

38. The valve system of claim 37, wherein the object holding service tool is adapted to slidably release the object when the restraining device holding the object is sheared through sufficient pressure applied to the object.

39. A valve system for a well, comprising:

an isolation string, comprising an upper packer; and an isolation pipe in mechanical communication with the upper packer, wherein the isolation pipe comprises an operable valve and an object activated valve comprising a tube having at least one opening;

a sleeve being movably connected to the tube, wherein the sleeve covers the at least one opening in a closed configuration and the sleeve does not cover the at least one opening in an open configuration; and an object seat in mechanical communication with the sleeve, wherein the seat receives an object for manipulating the valve from the open configuration to the closed configuration; and an object holding service tool coupled to the object activated valve and adapted to release an object to engage the object activated valve.

40. The valve system of claim 39, further comprising a piston coupled to the sleeve to assist the sleeve in covering the at least one opening.

* * * * *